US005994051A

United States Patent [19]

Gould et al.

[11] Patent Number: 5,994,051

[45] Date of Patent: Nov. 30, 1999

[54] SILVER HALIDE LIGHT SENSITIVE EMULSION LAYER HAVING ENHANCED PHOTOGRAPHIC SENSITIVITY

[75] Inventors: Ian R. Gould, Pittsford; Samir Farid, Rochester; Stephen A. Godleski; Jerome R. Lenhard, both of Fairport; Annabel A. Muenter; Paul A. Zielinski, both of Rochester, all of N.Y.

[73] Assignee: Eastman Kodak Company, Rochester, N.Y.

[21] Appl. No.: 09/118,536

[22] Filed: Jul. 17, 1998

Related U.S. Application Data

[63] Continuation-in-part of application No. 08/900,956, Jul. 25, 1997.

[51] Int. Cl.[6] ..... G03C 1/08

[52] U.S. Cl. ..... 430/588; 430/583; 430/584; 430/595; 430/599; 430/600; 430/607; 430/613

[58] Field of Search ..... 430/588, 583, 430/599, 600, 607, 613, 584, 595

[56] References Cited

U.S. PATENT DOCUMENTS

| | | | |
|---|---|---|---|
| 2,419,975 | 5/1947 | Trivelli et al. . | |
| 2,875,058 | 2/1959 | Carroll et al. . | |
| 2,937,089 | 5/1960 | Jones et al. . | |
| 3,457,078 | 7/1969 | Riester . | |
| 3,458,318 | 7/1969 | Brooks . | |
| 3,615,632 | 10/1971 | Shiba et al. . | |
| 3,695,888 | 10/1972 | Hiller et al. . | |
| 3,706,567 | 12/1972 | Hiller et al. . | |
| 3,809,561 | 5/1974 | Ulbing et al. . | |
| 4,607,006 | 8/1986 | Hirano et al. | 430/572 |
| 4,897,343 | 1/1990 | Ikeda et al. . | |
| 4,971,890 | 11/1990 | Okada et al. . | |
| 5,306,612 | 4/1994 | Philip et al. . | |
| 5,436,121 | 7/1995 | Suga et al. . | |
| 5,459,052 | 10/1995 | Skriver et al. . | |
| 5,478,719 | 12/1995 | Hioki et al. . | |
| 5,747,235 | 5/1998 | Farid et al. | 430/583 |
| 5,747,236 | 5/1998 | Farid et al. | 430/583 |

FOREIGN PATENT DOCUMENTS

| | | |
|---|---|---|
| 554856 A1 | 11/1993 | European Pat. Off. . |
| 1064193 | 4/1967 | United Kingdom . |
| 1255084 | 11/1971 | United Kingdom . |

OTHER PUBLICATIONS

*The Theory of the Photographic Process,* Fourth Edition, T.H. James, Ed., pp. 265–266, (Macmillan, 1977).

Co–pending applicantoin Serial No. 08/740,536 (our docket No. 69500A) filed Oct. 30, 1997, entitled Silver Halide Light Sensitive Emulsion Layer Having Enhanced Photographic Sensitivity, Inventor(s) Farid et al.

Co–pending application Serial No. 08/900,694 (our docket No. 76145 filed Jul. 25, 1997, entitled Silver Halide Light Sensitive Emulsion Layer Having Enhanced Photographic Sensitivity, Inventor(s) Farid et al.

Co–pending application Serial No. 08/739,921 (our docket No. 73258) filed Oct. 30, 1996, entitled Silver Halide Light Sensitive Emulsion Layer Having Enhanced Photographic Sensitivity, Inventor(s) Lenhard et al.

Co–pending application Serial No. 08/900,957 (our docket No. 76239) filed Jul. 25, 1997, entitled Silver Halide Light Sensitive Emulsion Layer Having Enhanced Photographic Sensitivity, Inventor(s) Adin et al.

Co–pending application Serial No. 08/739,911 (our docket No. 73257A) filed Oct. 30, 1996, entitled Silver Halide Light Sensitive Emulsion Layer Having Enhanced Photographic Sensitivity, Inventor(s) Farid et al.

*Primary Examiner*—Thorl Chea
*Attorney, Agent, or Firm*—Edith A. Rice

[57] ABSTRACT

This invention comprises a photographic element comprising at least one silver halide emulsion layer in which the silver halide is sensitized with a compound of the formula X—H, wherein X is an electron donor moiety to which a base, $B^-$, is covalently linked and H is a leaving hydrogen atom, and wherein:

1) X—H has an oxidation potential between 0 and about 1.4 V; and
2) the oxidized form of X—H undergoes deprotonation reaction with the base $B^-$, to give the radical $X^{\bullet}$ and the protonated base B-H.

In a preferred embodiment of the invention, the radical X• has an oxidation potential <–0.7V.

59 Claims, No Drawings

SILVER HALIDE LIGHT SENSITIVE EMULSION LAYER HAVING ENHANCED PHOTOGRAPHIC SENSITIVITY

CROSS-REFERENCE TO RELATED APPLICATIONS

This application is a continuation-in-part of application Ser. No. 08/900,956, filed Jul. 25, 1997, the entire disclosures of which are incorporated herein by reference.

This application is related to the following commonly assigned copending U.S. patent applications:

Ser. No. 08/740,536 filed Oct. 30, 1996, which is a continuation-in-part of Ser. No. 08/592,106 filed Jan. 26, 1996;

Ser. No. 08/739,911 filed Oct. 30, 1996, which is a continuation-in-part of Ser. No. 08/592,166 filed Jan. 26, 1996;

Ser. No. 08/739,921 filed Oct. 30, 1996, which is a continuation-in-part of Ser. No. 08/592,826 filed Jan. 26, 1996;

Ser. No. 08/900,694 filed concurrently herewith, (Attorney Docket No. 76145); and Ser. No. 08/900,957 filed concurrently herewith (Attorney Docket No. 76239).

The entire disclosures of these applications are incorporated herein by reference.

FIELD OF THE INVENTION

This invention relates to a photographic element comprising at least one light sensitive silver halide emulsion layer which has enhanced photographic sensitivity.

BACKGROUND OF THE INVENTION

A variety of techniques have been used to improve the light-sensitivity of photographic silver halide materials.

Chemical sensitizing agents have been used to enhance the intrinsic sensitivity of silver halide. Conventional chemical sensitizing agents include various sulfur, gold, and group VIII metal compounds.

Spectral sensitizing agents, such as cyanine and other polymethine dyes, have been used alone, or in combination, to impart spectral sensitivity to emulsions in specific wavelength regions. These sensitizing dyes function by absorbing long wavelength light that is essentially unabsorbed by the silver halide emulsion and using the energy of that light to cause latent image formation in the silver halide.

Many attempts have been made to further increase the spectral sensitivity of silver halide materials. One method is to increase the amount of light captured by the spectral sensitizing agent by increasing the amount of spectral sensitizing agent added to the emulsion. However, a pronounced decrease in photographic sensitivity is obtained if more than an optimum amount of dye is added to the emulsion. This phenomenon is known as dye desensitization and involves sensitivity loss in both the spectral region wherein the sensitizing dye absorbs light, and in the light sensitive region intrinsic to silver halide. Dye desensitization has been described in The Theory of the Photographic Process, Fourth Edition, T. H. James, Editor, pages 265–266, (Macmillan, 1977).

It is also known that the spectral sensitivity found for certain sensitizing dyes can be dramatically enhanced by the combination with a second, usually colorless organic compound that itself displays no spectral sensitization effect. This is known as the supersensitizing effect.

Examples of compounds which are conventionally known to enhance spectral sensitivity include sulfonic acid derivatives described in U.S. Pat. Nos. 2,937,089 and 3,706,567, triazine compounds described in U.S. Pat. Nos. 2,875,058 and 3,695,888, mercapto compounds described in U.S. Pat. No. 3,457,078, thiourea compounds described in U.S. Pat. No. 3,458,318, pyrimidine derivatives described in U.S. Pat. No. 3,615,632, aminothiatriazoles as described in U.S. Pat. No. 5,306,612 and hydrazines as described in U.S. Pat. Nos. 2,419,975, 5,459,052 and 4,971,890 and European Patent Application No. 554,856 A1. The sensitivity increases obtained with these compounds generally are small, and many of these compounds have the disadvantage that they have the undesirable effect of deteriorating the stability of the emulsion or increasing fog.

Various electron donating compounds have also been used to improve spectral sensitivity of silver halide materials. U.S. Pat. No. 3,695,588 discloses that the electron donor ascorbic acid can be used in combination with a specific tricarbocyanine dye to enhance sensitivity in the infrared region. The use of ascorbic acid to give spectral sensitivity improvements when used in combination with specific cyanine and merocyanine dyes is also described in U.S. Pat. No. 3,809,561, British Patent No. 1,255,084, and British Patent No. 1,064,193. U.S. Pat. No. 4,897,343 discloses an improvement that decreases dye desensitization by the use of the combination of ascorbic acid, a metal sulfite compound, and a spectral sensitizing dye.

Electron donating compounds that are covalently attached to a sensitizing dye or a silver-halide adsorptive group have also been used as supersensitizing agents. U.S. Pat. Nos. 5,436,121 and 5,478,719 disclose sensitivity improvements with the use of compounds containing electron-donating styryl bases attached to monomethine dyes. Spectral sensitivity improvements are also described in U.S. Pat. No. 4,607,006 for compounds containing an electron-donating group derived from a phenothiazine, phenoxazine, carbazole, dibenzophenothiazine, ferrocene, tris(2,2'-bipyridyl)ruthenium, or a triarylamine skeleton which are connected to a silver halide adsorptive group. However, these latter compounds generally have no silver halide sensitizing effect of their own and provide only minus-blue sensitivity improvements when used in combination with a sensitizing dye.

PROBLEM TO BE SOLVED BY THE INVENTION

There is a continuing need for materials which, when added to photographic emulsions, increase their sensitivity. Ideally such materials should be useable with a wide range of emulsion types, their activity should be controllable and they should not increase fog beyond acceptable limits. This invention provides such materials.

SUMMARY OF THE INVENTION

We have now discovered that an electron donating compound that upon donating an electron undergoes a deprotonation reaction can be used to sensitize a silver halide emulsion. The terms "sensitize" and "sensitization" is used in this patent application to mean an increase in the photographic response of the silver halide emulsion layer of a photographic element and the term "sensitizer" is used to mean a compound that provides sensitization when present in a silver halide emulsion layer.

One aspect of this invention comprises a photographic element comprising at least one silver halide emulsion layer in which the silver halide is sensitized with a compound of the formula X—H, wherein X is an electron donor moiety to which a base, $B^-$, is covalently linked and H is a leaving hydrogen atom, and wherein:

1) X—H has an oxidation potential between 0 and about 1.4 V; and
2) the oxidized form of X—H undergoes deprotonation reaction with a base $B^-$, to give the radical $X^\bullet$ and the protonated base B-H.

In this patent application, oxidation potentials are reported as "V" which represents "volts versus a saturated calomel reference electrode".

Another aspect of this invention comprises a photographic element comprising at least one silver halide emulsion layer in which the silver halide is sensitized with a compound of the formula X—H, wherein X is an electron donor moiety to which a base, $B^-$, is covalently linked and H is a leaving hydrogen atom, and wherein:

1) X—H has an oxidation potential between 0 and about 1.4 V;
2) the oxidized form of X—H undergoes deprotonation reaction with a base, $B^-$, to give the radical $X^\bullet$ and the protonated base B-H; and
3) the radical $X^\bullet$ has an oxidation potential $\leqq -0.7$V (that is, equal to or more negative than about −0.7V).

Compounds which meet criteria (1) and (2) but not (3) are capable of donating one electron and are referred to herein as deprotonating one-electron donors. Compounds which meet all three criteria are capable of donating two electrons and are referred to herein as deprotonating two-electron donors.

Another aspect of this invention comprises a photographic element comprising at least one silver halide emulsion layer in which the silver halide is sensitized with a compound of the formula:

$$A\text{-}(L\text{-}X\text{—}H)_k$$

or $$(A\text{-}L)_k\text{-}X\text{—}H$$

wherein A is a silver halide adsorptive group that contains at least one atom of N, S, P, Se, or Te that promotes adsorption to silver halide, and L represents a linking group containing at least one C, N, S or O atom, k is 1 or 2, and X—H is a deprotonating one-electron or two-electron donor group as defined above.

Another aspect of this invention comprises a photographic element comprising at least one silver halide emulsion layer in which the silver halide is sensitized with a compound of the formula:

$$Z\text{-}(L\text{-}X\text{—}H)_k$$

wherein Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes; L represents a linking group containing at least one C, N, S or O atom; and X—H is a deprotonating one-electron or two-electron donor group as defined above.

Another aspect of this invention comprises a photographic element comprising at least one silver halide emulsion layer in which the silver halide is sensitized with a compound of the formula:

$$Q\text{-}X\text{—}H$$

wherein Q represents the atoms necessary to form a chromophore comprising an amidinium-ion, a carboxyl-ion or dipolar-amidic chromophoric system when conjugated with X—H, and X—H is a deprotonating one-electron or two-electron donor group as defined above.

Another aspect of this invention comprises a photographic element comprising at least one silver halide emulsion layer in which the silver halide is sensitized with a compound of the formula:

$$A\text{-}(X\text{—}H)_k$$

or $$(A)_k\text{-}X\text{—}H$$

wherein A is a silver halide adsorptive group as described above that contains at least one atom of N, S, P, Se, or Te that promotes adsorption to silver halide, k is 1 or 2, and X—H is a deprotonating one-electron or two-electron donor group as defined above.

Another aspect of this invention comprises a photographic element comprising at least one silver halide emulsion layer in which the silver halide is sensitized with a compound of the formula:

$$Z\text{-}(X\text{—}H)_k$$

or $$(Z)_k\text{-}X\text{—}H$$

wherein Z is a light absorbing group as described above which includes, for example, cyanine dyes, complex cyanine dyes, merocyanine dyes, complex merocyanine dyes, homopolar cyanine dyes, styryl dyes, oxonol dyes, hemioxonol dyes, and hemicyanine dyes; k is 1 or 2; and X—H is a deprotonating one-electron or two-electron donor group as defined above.

Electron-donating compounds that undergo a fragmentation reaction, i. e., a bond cleavage reaction, subsequent to oxidation have been described in above-mentioned commonly assigned copending U.S. patent applications Ser. Nos. 08/740,536, 08/739,911 and 08/739,921, filed Oct. 30, 1996, the entire disclosures of which are incorporated herein by reference. The fragmentation reaction preferably results in the formation of a reducing radical. In these applications, fragmentation of a variety of bonds in the donor compound was described (e.g. carbon-carbon, carbon-silicon, carbon-boron).

ADVANTAGEOUS EFFECT OF THE INVENTION

This invention provides a silver halide photographic emulsion containing an organic electron donor capable of enhancing both the intrinsic sensitivity and, if a dye is present, the spectral sensitivity of the silver halide emulsion. The activity of these compounds can be easily varied with substituents to control their speed and fog effects in a manner appropriate to the particular silver halide emulsion in which they are used. An important feature of the electron donor compounds used is that after donating an electron they undergo a deprotonation reaction which results in irreversible transformation of the oxidized donor. The utility of deprotonating electron donor compounds has not been previously described.

DETAILED DESCRIPTION OF THE INVENTION

The photographic element of this invention comprises a silver halide emulsion layer which contains a deprotonating electron donor of the formula X—H, in which X is an electron donor moiety to which a base, $B^-$, is covalently linked and H is a leaving hydrogen atom. The deprotonating electron donor X—H enhances the sensitivity of a silver halide emulsion.

The following represents the reactions believed to take place when the compound X—H undergoes oxidation and deprotonation to the base, $B^-$, to produce a radical $X^{\bullet}$, which in a preferred embodiment undergoes further oxidation.

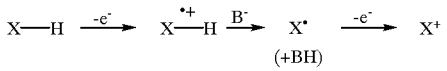

The base, $B^-$, is the conjugate base of an acid, B-H, which preferably has a pKa in the range about 1 to about 8, preferably about 2 to about 7. The deprotonation reactions with conjugate bases for acids with significantly lower pKa values tend to be too slow to be useful. If the pKa of the acid, B-H, is significantly larger than about 8, then the base is likely to be already protonated in the medium, and will therefore not be capable of deprotonating the oxidized molecule $X—H^{\bullet+}$. As mentioned above, the base, $B^-$, is covalently attached to the X—H molecule.

The important characteristics of the X—H molecule are its oxidation potential, the oxidation potential of the radical X•, and the rate of deprotonation of the oxidized molecule $X—H^{\bullet+}$. Here are shown 4 preferred general structures for X—H (I–IV) which are designed to accommodate these required characteristics. For simplicity, and because of multiple possible sites, the attachment of the base, $B^-$, is not specifically indicated in the structures. The sites of attachment of the base are discussed below. In certain instances where there is another abstractable H atom, it is not clear which H atom is in fact abstracted. Specific structures for X—H compounds are provided hereinafter.

(I)

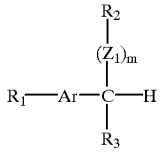

(II)

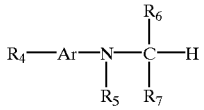

(III)

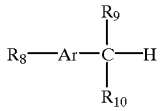

(IV)

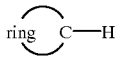

The symbol "R" (that is R without a subscript) is used in all structural formulae in this patent application to represent a hydrogen atom or an unsubstituted or substituted alkyl group. In the structures of this patent application a designation such as —OR(N(R)$_2$) indicates that either —OR or —N(R)$_2$ can be present. Unless otherwise specified the symbol "n" is an integer of 1 to 8.

In structure (I):

m: 0, 1;

$Z_1$: O, S, Se, Te;

Ar: aryl group (e.g., phenyl, naphthyl, phenanthryl, anthryl); or heterocyclic group (e.g., pyridine, indole, benzimidazole, thiazole, benzothiazole, thiadiazole, etc.);

$R_1$: R, carboxyl, amide, sulfonamide, halogen, N(R)$_2$, (OH)$_f$, (OR')$_f$, or (SR)$_f$;

R': alkyl or substituted alkyl;

f: 1–3;

$R_2$: R, Ar';

Ar': aryl group such as phenyl, substituted phenyl, or heterocyclic group (e.g., pyridine, benzothiazole, etc.)

$R_3$: R, Ar';

$R_2$ and $R_3$: together can form 5- to 8-membered ring;

$R_2$ and Ar: can be linked to form 5- to 8-membered ring;

$R_3$ and Ar: can be linked to form 5- to 8-membered ring;

In structure (II):

Ar: aryl group (e.g., phenyl, naphthyl, phenanthryl); or heterocyclic group (e.g., pyridine, benzothiazole, etc.);

$R_4$: a substituent having a Hammett sigma value of −1 to +1, preferably −0.7 to +0.7, e.g., R, OR, SR, halogen, CHO, C(O)R, COOR, CON(R)$_2$, SO$_3$R, SO$_2$N(R)$_2$, SO$_2$R, SOR, C(S)R, etc;

$R_5$: R, Ar'

$R_6$ and $R_7$: R, Ar'

$R_5$ and Ar: can be linked to form 5- to 8-membered ring;

$R_6$ and Ar: can be linked to form 5- to 8-membered ring (in which case, $R_6$ can be a hetero atom);

$R_5$ and $R_6$: can be linked to form 5- to 8-membered ring;

$R_6$ and $R_7$: can be linked to form 5- to 8-membered ring;

Ar': aryl group such as phenyl, substituted phenyl, heterocyclic group;

R: hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

$Z_2$: O, S, Se;

Ar: aryl group (e.g., phenyl, naphthyl, phenanthryl, anthryl); or heterocyclic group (e.g., indole, benzimidazole, etc.)

$R_8$: R, carboxyl, N(R)$_2$, (OR)$_f$, or (SR)$_f$ (f=1–3);

$R_9$ and $R_{10}$: R, Ar';

$R_9$ and Ar: can be linked to form 5- to 8-membered ring;

Ar': aryl group such as phenyl substituted phenyl or heterocyclic group;

R: a hydrogen atom or an unsubstituted or substituted alkyl group.

In structure (IV):

"ring" represents a substituted or unsubstituted 5-, 6-, or 7-membered unsaturated ring, preferrably a heterocyclic ring.

Since X is an electron donor moiety (i.e., an electron rich organic group), the substituents on the aromatic groups (Ar and/or Ar'), for any particular X group should be selected so that X remains electron rich. For example, if the aromatic group is highly electron rich, e.g. anthracene, electron withdrawing substituents can be used, providing the resulting X—H compound has an oxidation potential of 0 to about 1.4 V. Conversely, if the aromatic group is not electron rich, electron donating substituents should be selected.

When reference in this application is made to a substituent "group" this means that the substituent may itself be substituted or unsubstituted (for example "alkyl group" refers to a substituted or unsubstituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 12 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 12 carbon atoms; substituted and unsubstituted aryl, particularly those having from 6 to 20 carbon atoms (for example, phenyl); and substituted or unsubstituted heteroaryl, particularly those having a 5- or 6-membered ring containing 1 to 3 heteroatoms selected from N, O, S or Se (for example, pyridyl, thienyl, furyl, pyrrolyl and their corresponding benzo and naptho analogs); and others known in the art. Alkyl substituents preferably contain 1 to 12 carbon atoms and specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

As indicated above, a base, B−, is covalently linked to X. The base is preferably the conjugate base of an acid of pKa between about 1 and about 8. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

Table I pKa's in Water of the Conjugate Acids of Some Useful Bases

TABLE I pKa's in water of the conjugate acids of some useful bases

| | | | |
|---|---|---|---|
| $CH_3—CO_2^-$ | 4.76 | $CH_3—COS^-$ | 3.33 |
| $C_2H_5—CO_2^-$ | 4.87 | | |
| $(CH_3)_2CH—CO_2^-$ | 4.84 | 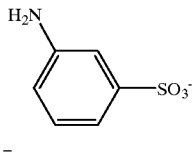 | 3.73 |
| $(CH_3)_3C—CO_2^-$ | 5.03 | 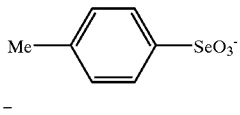 | 4.88 |
| $HO—CH_2—CO_2^-$ | 3.83 | | |
| 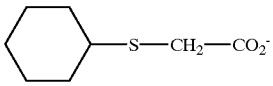 | 3.48 | 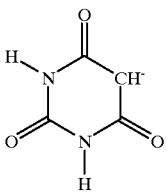 | 4.01 |
| $CH_3—CO—NH—CH_2—CO_2^-$ | 3.67 | | |
| 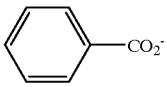 | 4.19 | 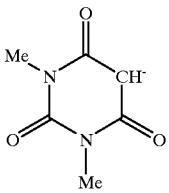 | 4.7 |

TABLE I-continued

| pKa's in water of the conjugate acids of some useful bases | |
|---|---|
| 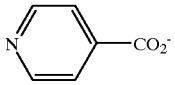 | 4.96 |
| 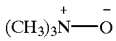 | 4.65 |
| 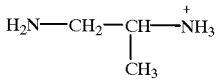 | 6.61 |
| 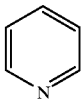 | 5.25 |
| 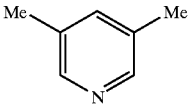 | 6.15 |
| 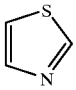 | 2.44 |
| 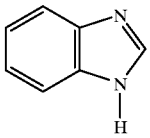 | 5.53 |

Preferably the base is a carboxylate, sulfate and amine oxide.

As mentioned above the base is covalently attached to X—H. The attached base should be appropriately situated to deprotonate X—H by reaction with the proton indicated by the symbol H in the preferred general structures I–IV given above. The base may be directly attached to X, or more preferably the base is attached using a linking group. The linking group is preferably an organic linking group containing at least one C, N, S, or O atom. Preferred examples of the linkage group include, an alkylene group, an arylene group, an alkylene group in which one or more of the carbon atoms is replaced by —O—, —S—, —C═O, —$SO_2$—, —NH, —P═O, and —N═. Each of these linking components can be optionally substituted and can be used alone or in combination. The length of the linkage group can be limited to a single atom or can be much longer, for instance up to 10 atoms in length. Some preferred examples of these linkage groups are:

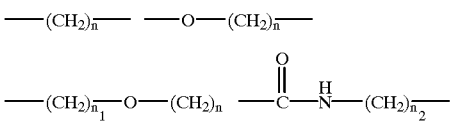

-continued

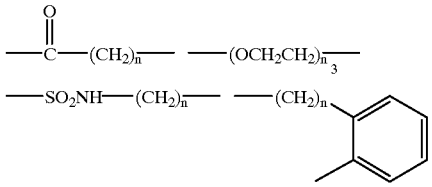

where n=1–8, $(n_1+n_2)$=1–8, and $n_3$=1–3.

The linking group positions the base so that the desired deprotonation can occur. If the base is the carboxylate anion, then the linking group should not be a simple methylene group, since such a compound may undergo a decarboxylation reaction upon 1 electron oxidation, as described in commonly assigned copending U.S. patent applications Ser. Nos. 08/740,536, 08/739,911 and 08/739,921, filed Oct. 30, 1996, the entire disclosures of which are incorporated herein by reference, Specific examples of the attachment of the base to the X—H compound are shown in the illustrative examples of the general structures I–IV given below. In these examples, the attached base is the carboxylate group (—$CO_2^-$). The following examples are illustrative. It is clear that via appropriate substitution chemistry, the attached carboxylate group could be replaced by an other base, for example, those included in Table I. The present invention should not be construed as being limited to these illustrative examples.

The following are illustrative examples of the general structure I:

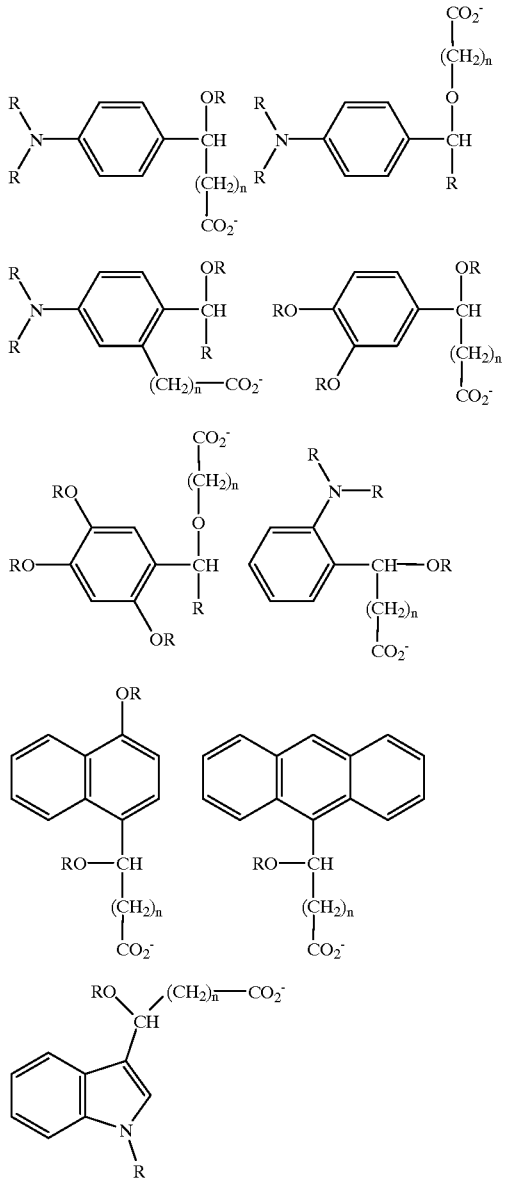

where n=1–8.

The following are illustrative examples of the general structure II:

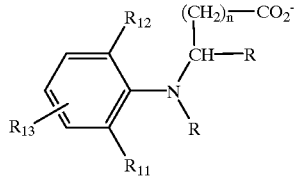

-continued

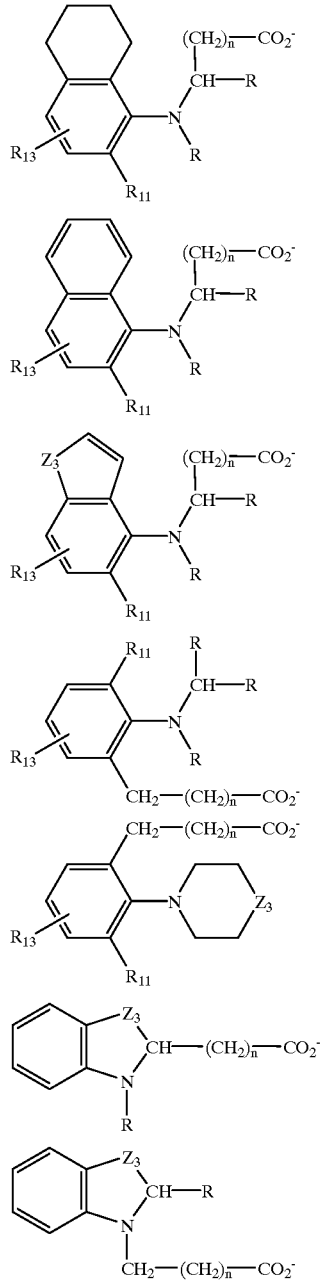

$R_{11}$ through $R_{13}$ are independently chosen from H, alkyl (such as methyl, ethyl, butyl, isopropyl, tert-butyl, cyclohexyl), substituted alkyl, halo, alkoxy, alkylthio, carboxyl, amido, sulfonyl, formyl, acyl, or $R_{11}$ and $R_{13}$ or $R_{12}$ and $R_{13}$ are fused 5- to 8-membered ring.

$Z_3$=S, O, Se, NR, $C(R)_2$

The following are illustrative examples of the general structure III:

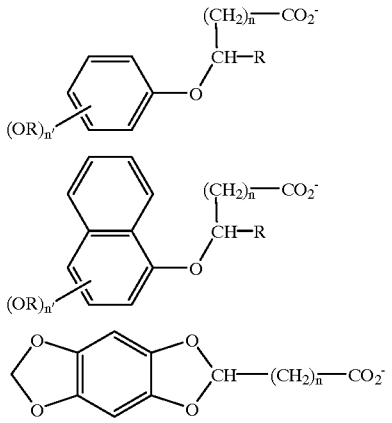

wherein n'=0 to 3.

The following is an illustrative example of the general structure IV:

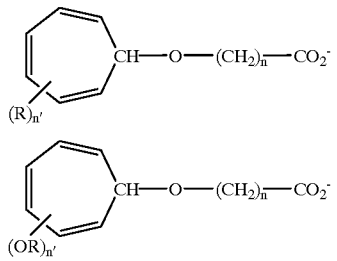

wherein n'=0 to 3.

In the above formulae, counterion(s) required to balance the charge of the X—H moiety are not shown as any counterion can be utilized. Common counterions are sodium, potassium, triethylammonium ($TEA^+$), tetramethylguanidinium ($TMG^+$), diisopropylammonium ($DIPA^+$), and tetrabutylammonium ($TBA^+$).

Illustrative examples of the preferred X—H compounds are of the formula:

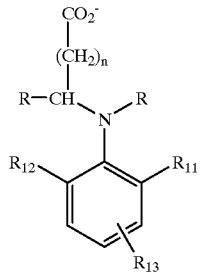

wherein:

one or both of $R_{11}$ and $R_{12}$ is a group that has a steric parameter which is equal to or larger than that of fluorine;

$R_{13}$ is a substituent having a Hammett sigma value of −1 to +1;

$R_{11}$ and $R_{13}$ can form a fused 5- to 8-membered, saturated or unsaturated ring that may contain heteroatoms;

More preferred are compounds according to the above structure wherein:

$R_{11}$ or $R_{12}$ or both $R_{11}$ and $R_{12}$ are independently chosen to be a halogen atom, a substituted or unsubstituted alkyl, an alkoxy group, an alkylthio group, an aryl group, a heterocyclic moiety, a carboxylate group or an acyl group;

$R_{13}$ is a hydrogen atom, a halogen atom, a substituted or unsubstituted alkyl group, a carboxylate group, an amido group, a formyl group, an acyl group, a sulfonate or sulfonamide group, an alkoxy or an alkylthio group.

$R_{11}$ and $R_{12}$ can form a fused 5- to 8-membered, saturated or unsaturated ring that may contain heteroatoms.

Steric parameters are listed in R. W. Taft, *Progress in Physical Organic Chemistry*, vol 12, p 92 to 98 (Wiley & Sons, New York, 1976).

The following are preferred examples of X—H compounds:

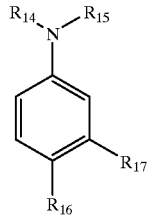

| Compound No. | $R_{14}$ | $R_{15}$ | $R_{16}$ | $R_{17}$ |
|---|---|---|---|---|
| 1 | Bu | $(CH_2)_2$—$CO_2^-$ | H | H |
| 2 | Me | $(CH_2)_3$—$CO_2^-$ | H | H |
| 3 | Me | $(CH_2)_5$—$CO_2^-$ | H | H |
| 4 | $(CH_2)_2$—$CO_2^-$ | $(CH_2)_2$—$CO_2^-$ | H | H |
| 5 | $(CH_2)_3$—$CO_2^-$ | $(CH_2)_3$—$CO_2^-$ | H | H |
| 6 | $(CH_2)_2$—$CO_2^-$ | $(CH_2)_2$—$CO_2^-$ | Me | H |
| 7 | $(CH_2)_3$—$CO_2^-$ | $(CH_2)_3$—$CO_2^-$ | Me | H |
| 8 | $(CH_2)_2$—$CO_2^-$ | $(CH_2)_2$—$CO_2^-$ | OMe | OMe |

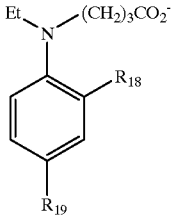

| Compound No. | $R_{18}$ | $R_{19}$ |
|---|---|---|
| 9 | $CH_3$ | H |
| 10 | $C_2H_5$ | H |
| 11 | $CH(CH_3)_2$ | H |
| 12 | $C(CH_3)_3$ | H |
| 13 | $C_6H_5$ | H |
| 14 | $(CH_2)_2OH$ | H |
| 15 | $CH_2$—CN | H |
| 16 | $CH_2$—Ph | H |
| 17 | $(CH_2)_2$—$NMe_2$ | H |
| 18 | CO—Ph | H |
| 19 | $CO_2Et$ | H |
| 20 | O—Ph | H |
| 21 | 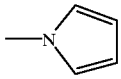 | H |
| 22 | 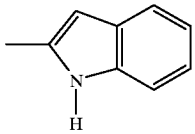 | H |
| 23 | $CH_3$ | $CH_3$ |

-continued

| | | |
|---|---|---|
| 24 | $CH_3$ | Br |
| 25 | Br | $CH_3$ |
| 26 | Cl | H |
| 27 | F | H |

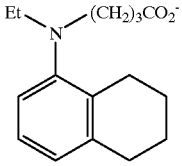

28

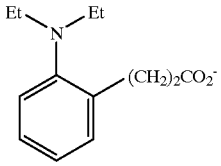

29

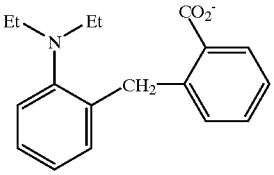

30

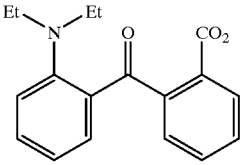

31

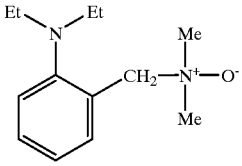

32a

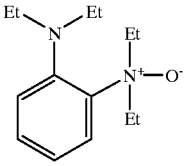

32b

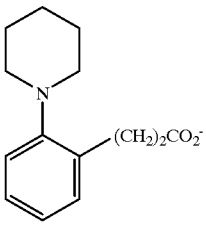

33

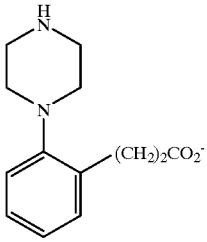

34

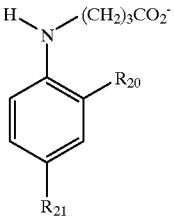

| Compound No. | $R_{20}$ | $R_{21}$ |
|---|---|---|
| 35 | $CH_3$ | H |
| 36 | $C_2H_5$ | H |
| 37 | $CH(CH_3)_2$ | H |
| 38 | $C(CH_3)_3$ | H |
| 39 | $C_6H_5$ | H |
| 40 | $(CH_2)_2OH$ | H |
| 41 | $CH_3$ | $CH_3$ |
| 42 | Br | $CH_3$ |

-continued

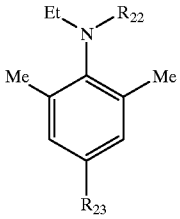

| Compound No. | $R_{22}$ | $R_{23}$ |
|---|---|---|
| 43 | $(CH_2)_2$—$CO_2^-$ | H |
| 44 | $(CH_2)_3$—$CO_2^-$ | H |
| 45 | $(CH_2)_4$—$CO_2^-$ | H |
| 46 | $(CH_2)_5$—$CO_2^-$ | H |
| 47 | $(CH_2)_6$—$CO_2^-$ | H |
| 48 | $(CH_2)_3$—$CO_2^-$ | $CH_3$ |
| 49 | $(CH_2)_3$—$CO_2^-$ | Br |

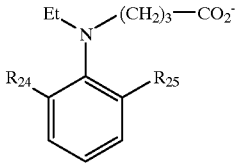

| Compound No. | $R_{24}$ | $R_{25}$ |
|---|---|---|
| 50 | $C_2H_5$ | $CH_3$ |
| 51 | $CH(CH_3)_2$ | $CH_3$ |
| 52 | Cl | $CH_3$ |
| 53 | Cl | Cl |

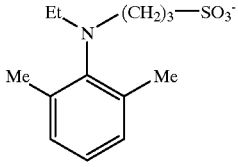

Compound No. 54

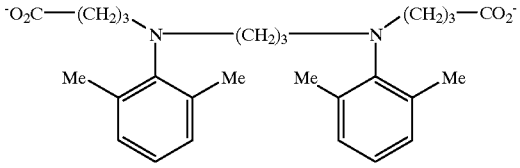

Compound No. 55

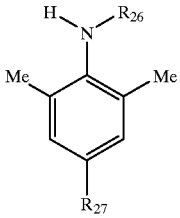

| Compound No. | $R_{26}$ | $R_{27}$ |
|---|---|---|
| 56 | $(CH_2)_2$—$CO_2^-$ | H |
| 57 | $(CH_2)_3$—$CO_2^-$ | H |
| 58 | $(CH_2)_4$—$CO_2^-$ | H |
| 59 | $(CH_2)_5$—$CO_2^-$ | H |
| 60 | $(CH_2)_6$—$CO_2^-$ | H |
| 61 | $(CH_2)_3$—$CO_2^-$ | $CH_3$ |

-continued

| | | |
|---|---|---|
| 62 | $(CH_2)_3—CO_2^-$ | Br |

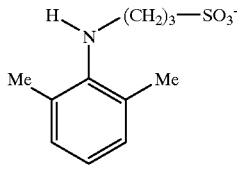

Compound No. 63

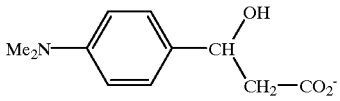

64

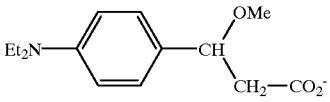

Compound No. 65

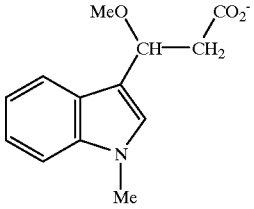

66

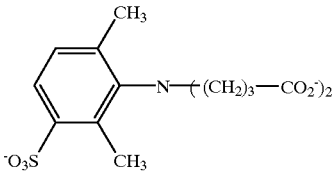

117

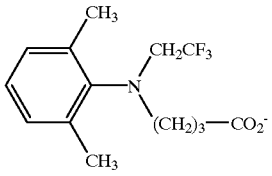

118

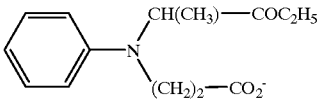

119

-continued

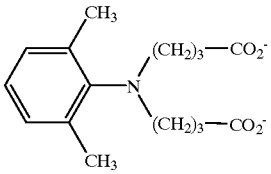

120

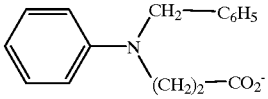

121

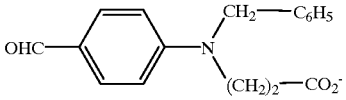

122

The deprotonating electron donors X—H can be deprotonating one-electron donors which meet the first two criteria described above or deprotonating two-electron donors which meet all three criteria described above. The first criterion relates to the oxidation potential of the X—H species ($E_{ox1}$). $E_{ox1}$ is preferably no higher than about 1.4 V and preferably less than about 1.0 V. The oxidation potential is preferably greater than 0, more preferably greater than about 0.3 V. $E_{ox1}$ is preferably in the range of about 0 to about 1.4 V, and more preferably from about 0.3 V to about 1.0 V.

Oxidation potentials are well known and can be found, for example, in "Encyclopedia of Electrochemistry of the Elements", Organic Section, Volumes XI–XV, A. Bard and H. Lund (Editors) Marcel Dekkar Inc., NY (1984). $E_{ox1}$ can be measured by the technique of cyclic voltammetry. In this technique, the electron donor is dissolved in a solution of 80%/20% by volume acetonitrile to water containing 0.1 M lithium perchlorate. Oxygen is removed from the solution by passing nitrogen gas through the solution for 10 minutes prior to measurement. A glassy carbon disk is used for the working electrode, a platinum wire is used for the counter electrode, and a saturated calomel electrode (SCE) is used for the reference electrode. Measurement is conducted at 25° C. using a potential sweep rate of 0.1 V/sec. The oxidation potential vs. SCE is taken as the peak potential of the cyclic voltammetric wave. Oxidation potentials of some example X—H compounds are summarized in Table II.

Table II

Oxidation Potentials of Example X—H Compounds

TABLE II

Oxidation Potentials of Example X-H conpounds

| Compound | $E_{ox1}$ (V vs SCE) |
|---|---|
| 1 | 0.632 |
| 9 | 0.695 |
| 11 | 0.715 |
| 12 | 0.760 |
| 37 | 0.625 |

TABLE II-continued

| Oxidation Potentials of Example X-H conpounds | |
|---|---|
| Compound | $E_{ox1}$ (V vs SCE) |
| 38 | 0.625 |
| 43 | 0.712 |
| 44 | 0.670 |
| 45 | 0.685 |
| 46 | 0.710 |
| 47 | 0.750 |
| 56 | 0.665 |
| 57 | 0.660 |
| 58 | 0.680 |
| 59 | 0.680 |
| 60 | 0.790 |

The second criterion defining the compounds useful in accordance with our invention is the requirement that the oxidized form of X—H, that is the radical cation $X—H^{+\bullet}$, undergoes deprotonation to the attached base, to give the radical $X^{\bullet}$ and the B-H moiety. It is widely known that radical species, and in particular radical cations formed by a one-electron oxidation reaction, may undergo a multitude of reactions, some of which are dependent upon their concentration and on the specific environment wherein they are produced. As described in "Kinetics and Mechanisms of Reactions of Organic Cation Radicals in Solution", Advances in Physical Organic Chemistry, vol 20, 1984, pp 55–180, and "Formation, Properties and Reactions of Cation Radicals in Solution", Advances in Physical Organic Chemistry, vol 13, 1976, pp 156–264, V. Gold Editor, 1984, published by Academic Press, NY, the range of reactions available to such radical species includes: dimerization, deprotonation, nucleophilic substitution, disproportionation, and bond cleavage. With compounds useful in accordance with our invention, the oxidized form of X—H undergoes a deprotonation reaction. In some instances where there is another abstractable H atom in the molecule, for example, compounds 56–64 which have either an NH or an OH group, it is not clear which H atom is in fact abstracted.

The rate constant of the deprotonation reaction, $k_{dp}$, can be measured by conventional laser flash photolysis. The general technique of laser flash photolysis as a method to study properties of transient species is well known (see, for example, "Absorption Spectroscopy of Transient Species" W. Herkstroeter and I. R. Gould in Physical Methods of Chemistry Series, second Edition, Volume 8, page 225, edited by B. Rossiter and R. Baetzold, John Wiley & Sons, New York, 1993). The specific experimental apparatus we used to measure deprotonation rate constants and radical oxidation potentials is described in detail below. The rate constant of deprotonation in compounds useful in accordance with this invention is preferably faster than about 10 per second (i.e., $k_{dp}$ should be 10 $s^{-1}$ or higher, or, in other words, the lifetime of the radical cation $X—H^{+\bullet}$ should be 0.1 sec or less). The deprotonation rate constants can be considerably higher than this, namely in the $10^2$ to $10^{13}$ $s^{-1}$ range. The deprotonation rate constant is preferably about $10^3$ $sec^{-1}$ to about $10^{13}$ $s^{-1}$, more preferably about $10^4$ to about $10^{11}$ $s^{-1}$.

Table III

Rate Constants for Deprotonation of the Radical Cations of Some Example X—H Compounds in $CH_3CN/H_2O$ (4:1)

TABLE III

| Rate Constants for Deprotonation of the Radical Cations of some Example X-H Compounds in $CH_3CN/H_2O$ (4:1) | |
|---|---|
| Compound | $k_{dp}$ ($s^{-1}$) |
| 2 | ca. $1 \times 10^3$ |
| 3 | ca. $1 \times 10^3$ |
| 4 | $<1 \times 10^5$ |
| 5 | $<1 \times 10^5$ |
| 9 | $2 \times 10^5$ |
| 10 | $6 \times 10^5$ |
| 11 | $2 \times 10^6$ |
| 12 | ca. $3 \times 10^7$ |
| 13 | $3 \times 10^5$ |
| 25 | ca. $5 \times 10^4$ |
| 26 | $1.1 \times 10^6$ |
| 27 | $7.9 \times 10^4$ |
| 28 | $2.4 \times 10^5$ |
| 29 | $9 \times 10^4$ |
| 32a | $2.4 \times 10^7$ |
| 43 | $1.8 \times 10^6$ |
| 44 | ca $1 \times 10^8$ |
| 45 | $1.3 \times 10^7$ |
| 46 | $1.4 \times 10^6$ |
| 47 | $2.3 \times 10^5$ |
| 54 | ca. $1 \times 10^5$ |
| 118 | $>3 \times 10^5$ |

In a preferred embodiment of the invention, the X—H compound is a deprotonating two-electron donor and meets a third criterion, that the radical $X^{\bullet}$ resulting from the deprotonation reaction has an oxidation potential, $E_{ox2}$, equal to or more negative than −0.7V, preferably more negative than about −0.9 V. This oxidation potential is preferably in the range of from about −0.7 to about −2 V, more preferably from about −0.8 to about −2 V and most preferably from about −0.9 to about −1.6 V.

The oxidation potential of many radicals have been measured by transient electrochemical and pulse radiolysis techniques as reported by Wayner, D. D.; McPhee, D. J.; Griller, D. in *J. Am. Chem. Soc.* 1988, 110, 132; Rao, P. S,; Hayon, E. *J. Am. Chem. Soc.* 1974, 96, 1287 and Rao, P. S,; Hayon, E. *J. Am. Chem. Soc.* 1974, 96, 1295. The data demonstrate that for carbon centered radicals, the oxidation potentials of tertiary substituted species are less positive (i.e., the radicals are stronger reducing agents) than those of the corresponding secondary radicals, which in turn are more negative than those of the corresponding primary radicals. For example, the oxidation potential of benzyl radical decreases from 0.73V to 0.37 V to 0.16 V upon replacement of one or both hydrogen atoms by methyl groups.

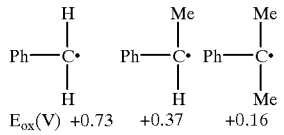

A considerable decrease in the oxidation potential of the radicals is achieved by a hydroxy or alkoxy substituents. For example the oxidation potential of the benzyl radical (+0.73

V) decreases to −0.44 when one of the a hydrogen atoms is replaced by a methoxy group.

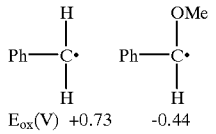

An α-amino substituent decreases the oxidation potential of the radical to values of about −1 V. There are almost no data available for oxidation potentials of heteroatom centered radicals. Based simply on the fact that the electronegativities of atoms such as nitrogen and oxygen are larger than for carbon, it would be expected that radicals centered on nitrogen and oxygen would be harder to oxidize than carbon centered radicals. In addition, stabilization via α-substitution such as described above for carbon radicals would be less beneficial for nitrogen and oxygen radicals simply because of the reduced number of valence sites for these atoms.

The oxidation potential of the transient species X•, can be determined using a laser flash photolysis technique as described in greater detail below. In this technique, the compound X—H is oxidized by an electron transfer reaction initiated by a short laser pulse. The oxidized form of X—H then undergoes the deprotonation reaction to give the radical $X^{\bullet}$. $X^{\bullet}$ is then allowed to interact with various electron acceptor compounds, Ac, of known reduction potential. The sequence of events is illustrated below for the example of X—H compound 2. The ability of $X^{\bullet}$ to reduce a given Ac indicates that the oxidation potential of $X^{\bullet}$ is nearly equal to or more negative than the reduction potential of Ac. The experimental details are set forth more fully below.

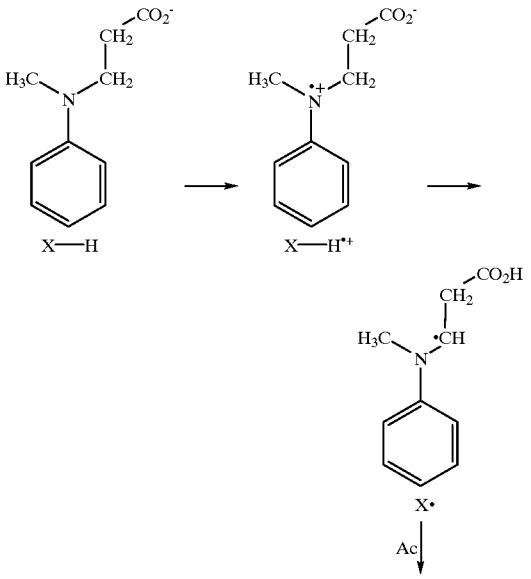

-continued

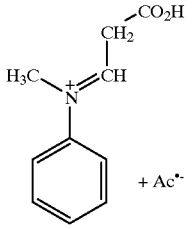

In accordance with our invention we have discovered that compounds which provide a radical X• having an oxidation potential more negative than −0.7 are particularly advantageous for use in sensitizing silver halide emulsions. Oxidation potentials ($E_{ox2}$) for radicals derived from typical compounds useful in accordance with our invention, i.e. having oxidation potentials more negative than −0.7, are given in Table III. Where only limits on potentials could be determined, the following notation is used: <−0.90 V should be read as "more negative than −0.90 V" and >−0.40 V should be read as "less negative than −0.40 V". Some comparative examples of compounds which provide radicals with $E_{ox2}$ less negative than −0.7 V are also included.

Table IV

Oxidation Potentials, $E_{ox2}$, for Radicals Derived From Typical X—H Compounds

TABLE IV

Oxidation Potentials, $E_{ox2}$, for Radicals Derived From Typical X-H Compounds

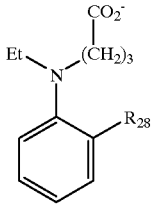

| X-H compound | $R_{28}$ | $E_{ox2}$ |
|---|---|---|
| 10 | $C_2H_5$ | <−0.9 |
| 11 | $CH(CH_3)_2$ | <−0.9 |
| 12 | $C(CH_3)_3$ | <−0.9 |
| 13 | $C_6H_5$ | <−0.9 |
| 26 | Cl | <−0.9 |
| 27 | F | <−0.9 |

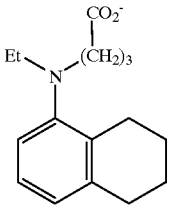

| X-H compound | $E_{ox2}$ |
|---|---|
| 28 | <−0.9 |

TABLE IV-continued
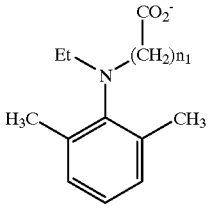
| X-H compound | $n_1$ | $E_{ox2}$ |
|---|---|---|
| 43 | 2 | <−0.9 |
| 45 | 4 | <−0.9 |
| 46 | 5 | <−0.9 |
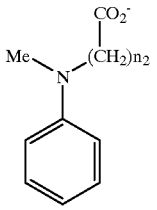
| X-H compound | $n_2$ | $E_{ox2}$ |
|---|---|---|
| 2 | 3 | <−0.9 |
| 3 | 5 | <−0.9 |
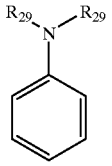
| X-H compound | $R_{29}$ | $E_{ox2}$ |
|---|---|---|
| 6 | $(CH_2)_2CO_2^-$ | <−0.9 |
| 7 | $(CH_2)_3CO_2^-$ | <−0.9 |
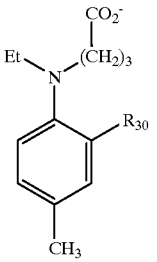
| X-H compound | $R_{30}$ | $E_{ox2}$ |
|---|---|---|
| 25 | Br | <−0.9 |
| 27 | F | <−0.9 |
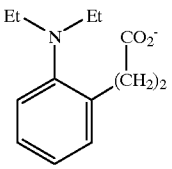
| X-H compound | $E_{ox2}$ |
|---|---|
| 29 | <−0.9 |
TABLE IV-continued
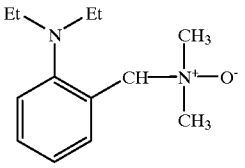
| X-H compound | $E_{ox2}$ |
|---|---|
| 32a | <−0.9 |
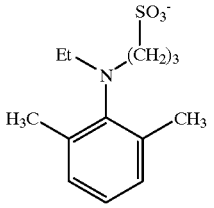
| X-H compound | $E_{ox2}$ |
|---|---|
| 54 | <−0.9 |
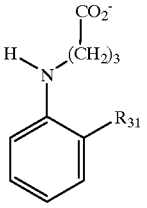
| X-H compound | $R_{31}$ | $E_{ox2}$ |
|---|---|---|
| 37 | $CH(CH_3)_2$ | >−0.45 |
| 38 | $C(CH_3)_3$ | >−0.45 |
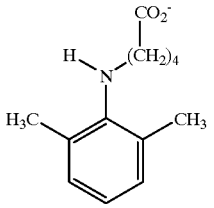
| X-H compound | $E_{ox2}$ |
|---|---|
| 58 | >−0.45 |
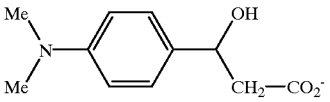
| X-H compound | $E_{ox2}$ |
|---|---|
| 64 | >−0.45 |
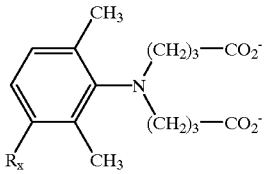
| X-H compound | $R_x$ | $E_{ox2}$ |
|---|---|---|
| 120 | H | <−0.9 |
| 117 | $SO_3^-$ | <−0.9 |

TABLE IV-continued

| X-H compound | $E_{ox2}$ |
|---|---|
| 119 | <−0.9 |

| X-H compound | $E_{ox2}$ |
|---|---|
| 118 | <−0.9 |

| X-H compound | $R_y$ | $E_{ox2}$ |
|---|---|---|
| 121 | H | <−0.9 |
| 122 | CHO | <−0.9 |

In another aspect of this invention, the deprotonating donor compound X—H can be attached to a silver halide adsorbing group, A, via a linking group L. Such an attached donor can be represented by the formula:

$$A\text{-}(L\text{-}X\text{—}H)_k$$

or $$(A\text{-}L)_k\text{-}X\text{—}H$$

In these formulae, the X—H symbol represents a group which has a structure and properties which are identical to those described for the unattached X—H compounds described above. The linking group is described in detail below.

The group A may be a silver-ion ligand moiety or a cationic surfactant moiety. Silver-ion ligands include: i) sulfur acids and their Se and Te analogs, ii) nitrogen acids, iii) thioethers and their Se and Te analogs, iv) phosphines, v) thionamides, selenamides, and telluramides, and vi) carbon acids. The aforementioned acidic compounds should preferably have acid dissociation constants, pKa, greater than about 5 and smaller than about 14. More specifically, the silver-ion ligand moieties which may be used to promote adsorption to silver halide are the following:

i) Sulfur acids, more commonly referred to as mercaptans or thiols, which upon deprotonation can react with silver ion thereby forming a silver mercaptide or complex ion. Thiols with stable C—S bonds that are not sulfide ion precursors have found use as silver halide adsorptive materials as discussed in The Theory of the Photographic Process, fourth Edition, T. H. James, editor, pages 32–34, (Macmillan, 1977). Substituted or unsubstituted alkyl and aryl thiols with the general structure shown below, as well as their Se and Te analogs may be used:

R"—SH and R'"—SH

The group R" is an aliphatic, aromatic, or heterocyclic group, and may be substituted with functional groups comprising halogen, oxygen, sulfur or nitrogen atoms, and R'" is an aliphatic, aromatic, or heterocyclic group substituted with a $SO_2$ functional group. When the group R'" is used the adsorbing group represents a thiosulfonic acid.

Heterocyclic thiols are the more preferred type in this category of adsorbing groups and these may contain O, S, Se, Te, or N as heteroatoms as given in the following general structures:

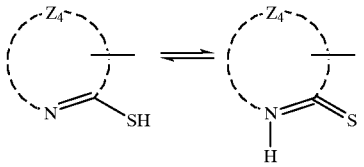

wherein:

$Z_4$ represents the remaining members for completing a preferably 5- or 6-membered ring which may contain one or more additional heteroatoms, such as nitrogen, oxygen, sulfur, selenium or tellurium atom, and is optionally benzo- or naphtho-condensed.

The presence of an —N═ adjacent to, or in conjugation with the thiol group introduces a tautomeric equilibrium between the mercaptan [—N═C—SH] and the thionamide structure [—HN—C═S]. The triazolium thiolates of U.S. Pat. No. 4,378,424 represent related mesoionic compounds that cannot tautomerize but are active $Ag^+$ ligands. Preferred heterocyclic thiol silver ligands for use in this invention, which include those common to silver halide technology, are mercaptotetrazole, mercaptotriazole, mercaptothiadiazole, mercaptoimidazole, mercaptooxadiazole, mercaptothiazole, mercaptobenzimidazole, mercaptobenzothiazole, mercaptobenzoxazole, mercaptopyrimidine, mercaptotriazine, phenylmercaptotetrazole, 1,4,5-trimethyl-1,2,4-triazolium 3-thiolate, and 1-methy-4,5,-diphenyl-1,2,4-triazolium-3-thiolate.

ii) Nitrogen acids which upon deprotonation can serve as silver-ion ligands. A variety of nitrogen acids which are common to silver halide technology may be used, but most preferred are those derived from 5- or 6-membered heterocyclic ring compounds containing one or more of nitrogen, or sulfur, or selenium, or tellurium atoms and having the general formula:

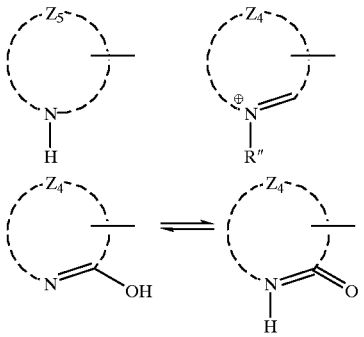

wherein:

$Z_4$ represents the remaining members for completing a preferably 5- or 6-membered ring which may contain one or more additional heteroatoms, such as a nitrogen, oxygen, sulfur, selenium or tellurium atom, and is optionally benzo- or naphtho-condensed, $Z_5$ represents the remaining members for completing a preferably 5- or 6-membered ring which contains at least one additional heteroatom such as nitrogen, oxygen, sulfur, selenium or tellurium and is optionally benzo or naptho-condensed, Preferred are heterocyclic nitrogen acids including azoles, purines, hydroxy azaindenes, and imides, such as those described in U.S. Pat. No. 2,857,274, the disclosure of which is incorporated herein by reference. The most preferred nitrogen acid moieties are: uracil, tetrazole, benzotriazole, benzothiazole, benzoxazole, adenine, rhodanine, and substituted 1,3,3a,7-tetraazaindenes, such as 5-bromo-4-hydroxy-6-methyl-1,3,3a,7-tetraazaindene.

iii) Cyclic and acyclic thioethers and their Se and Te analog. Preferred members of this ligand category are disclosed in U.S. Pat. No. 5,246,827, the disclosure of which is incorporated herein by reference. Structures for preferred thioethers and analogs are given by the general formulae:

$$—(CH_2)_a—S—(CH_2)_b—CH_3$$

$$—(CH_2)_a—Se—(CH_2)_b—CH_3$$

$$—(CH_2)_a—Te—(CH_2)_b—CH_3$$

$$—(CH_2)_a—S—(CH_2)_b—S—(CH_2)_c—CH_3$$

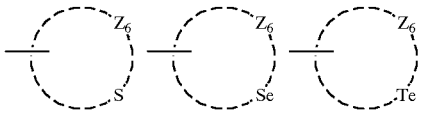

wherein:

a=1–30, b=1–30, c=1–30 with the proviso that a+b+c is ≦ to 30, and $Z_6$ represents the remaining members for completing a 5- to 18-membered ring, or more preferably a 5- to 8-membered ring. The cyclic structures incorporating $Z_6$ may contain more than one S, Se, or Te atom. R" is an aliphatic, aromatic, or heterocyclic group, and may be substituted with functional groups comprising a halogen, oxygen, sulfur or nitrogen atom. Specific examples of this class include: $—CH_2CH_2SCH_2CH_3$, 1,10-dithia-4,7,13,16-tetraoxacyclooctadecane, $—CH_2CH_2TeCH_2CH_3$, $—CH_2CH_2SeCH_2CH_3$, $—CH_2CH_2SCH_2CH_2SCH_2CH_3$, and thiomorpholine.

iv) Phosphines that are active silver halide ligands in silver halide materials may be used. Preferred phosphine compounds are of the formula:

$$(R")_3—P$$

wherein each R" is independently an aliphatic, aromatic, or heterocyclic group, and may be substituted with functional groups comprising halogen, oxygen, sulfur or nitrogen atoms. Particularly preferred are $P(CH_2CH_2CN)_3$, and m-sulfophenyl-dimethylphosphine.

v) Thionamides, thiosemicarbazides, telluroureas, and selenoureas of the general formulae:

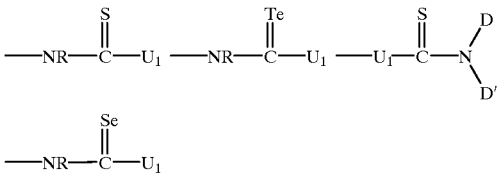

wherein:

$U_1$ represents $—NH_2$, —NHR", $—NR"_2$, —NH—NHR", —SR", OR";

D and D' represent R" or, may be linked together, to form the remaining members of a 5- or 6-membered ring; and Many such thionamide $Ag^+$ ligands are described in U.S. Pat. No. 3,598,598, the disclosure of which is incorporated herein by reference. Preferred examples of thionamides include N,N'-tetraalkylthiourea, N-hydroxyethyl benzthiazoline-2-one, and phenyldimethyldithiocarbamate, and N-substituted thiazoline-2-one.

vi) Carbon acids derived from active methylene compounds that have acid dissociation constants greater than about 5 and less than about 14, such as bromomalonitrile, 1-methyl-3-methyl-1,3,5-trithiane bromide, and acetylenes. Canadian Patent 1,080,532 and U.S. Pat. No. 4,374,279 (both of which are incorporated herein by reference) disclose silver-ion ligands of the carbon acid type for use in silver halide materials. Because the carbon acids have, in general, a lower affinity for silver halide than the other classes of adsorbing groups discussed herein, the carbon acids are less preferred as an adsorbing group. General structures for this class are:

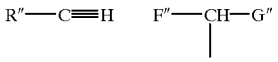

wherein:

F" and G" are independently selected from $—CO_2R"$, —COR", CHO, CN, $SO_2R"$, SOR", $NO_2$, such that the pKa of the CH is between 5 and 14.

Cationic surfactant moieties that may serve as the silver halide adsorptive group include those containing a hydrocarbon chain of at least 4 or more carbon atoms, which may be substituted with functional groups based on halogen, oxygen, sulfur or nitrogen atoms, and which is attached to at least one positively charged ammonium, sulfonium, or phosphonium group. Such cationic surfactants are adsorbed to silver halide grains in emulsions containing an excess of halide ion, mostly by coulombic attraction as reported in J. Colloid Interface Sci., volume 22, 1966, pp. 391. Examples of useful cationic moieties are: dimethyldodecylsulfonium, tetradecyltrimethylammonium, N-dodecylnicotinic acid betaine, and decamethylenepyridinium ion.

Preferred examples of A include an alkyl mercaptan, a cyclic or acyclic thioether group, benzothiazole, tetraazaindene, benzotriazole, tetralkylthiourea, and mercapto-substituted hetero ring compounds especially mercaptotetrazole, mercaptotriazole, mercaptothiadiazole, mercaptoimidazole, mercaptooxadiazole, mercaptothiazole mercaptobenzimidazole, mercaptobenzothiazole, mercaptobenzoxazole, mercaptopyrimidine, mercaptotriazine, phenylmercaptotetrazole, 1,2,4-triazolium thiolate, and related structures.

Most preferred examples of A are: (specific structures for linked A-L-X—H compounds are provided hereinafter):

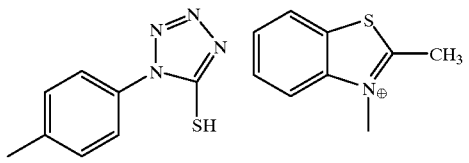

-continued

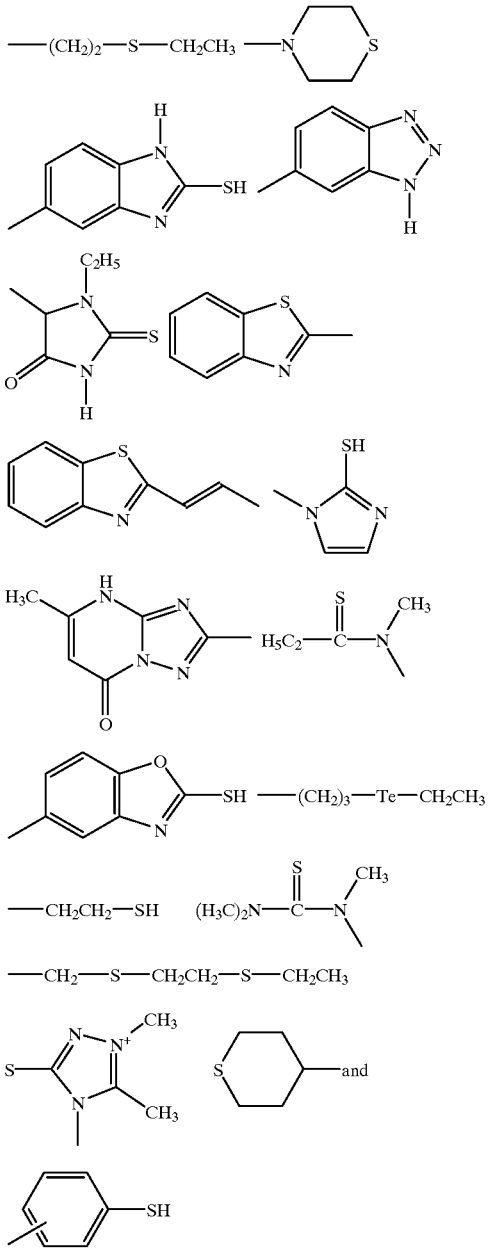

The point of attachment of the linking group L to the silver halide adsorptive group will vary depending on the structure of the adsorptive group, and may be at one (or more) of the heteroatoms, at one (or more) of the aromatic or heterocyclic rings.

The linkage group represented by L which connects the silver halide absorptive group to the deprotonating electron donator moiety X—H by a covalent bond is preferably an organic linking group containing a least one C, N, S, or O atom. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

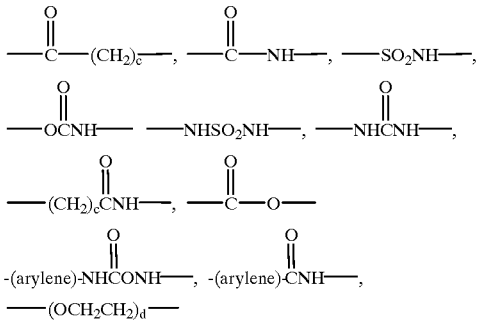

where c=1–30, and d=1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

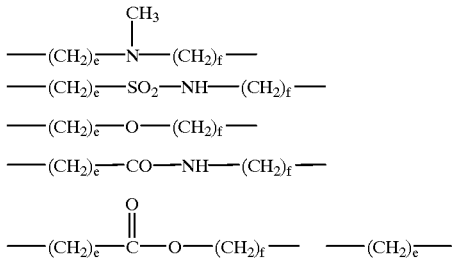

e and f=1–30, with the proviso that e+f≦30.

Shown below are preferred illustrative compounds which have a deprotonating X—H group linked to a silver halide adsorptive group according to the general structures A-(L-X—H)$_k$ and (A-L)$_k$-X—H.

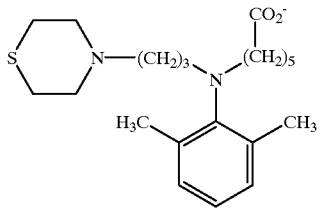

Compound No. 67

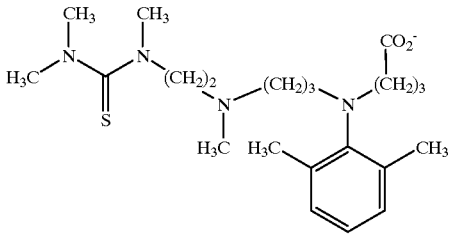

68

-continued

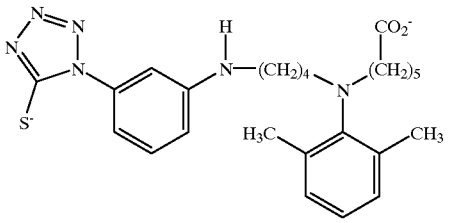

69

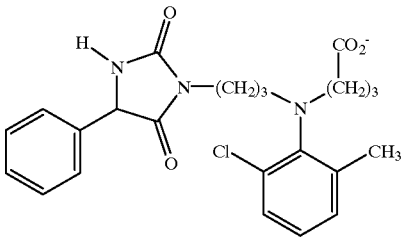

70

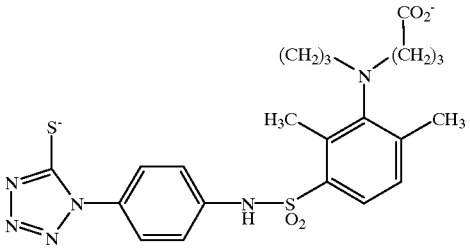

71

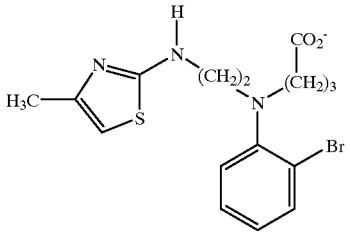

72

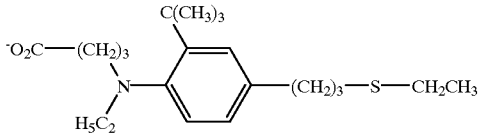

73

-continued

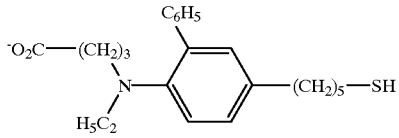

74

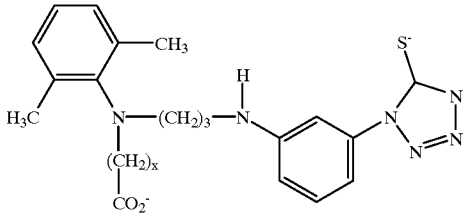

| Compound no. | X |
|---|---|
| 109 | 3 |
| 111 | 4 |
| 113 | 5 |
| 115 | 6 |

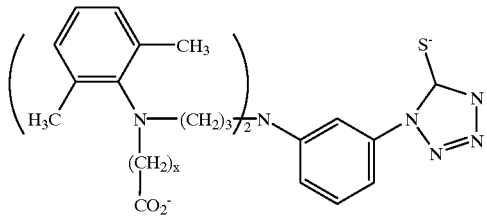

| Compound no. | X |
|---|---|
| 110 | 3 |
| 112 | 4 |
| 114 | 5 |
| 116 | 6 |

In another aspect of the present invention, the deprotonating donor compound X—H can be attached to a light absorbing group, Z. Such an attached donor can be represented by the formula:

$$Z\text{-}(L\text{-}X\text{—}H)_k$$

In this formula, the X—H symbol represents a group which has a structure and properties which are identical to those described for the unattached X—H compounds described above.

In this formula, the L symbol represents a linking group which is described above.

The light absorbing group Z is preferably a spectral sensitizing dye typically used in color sensitization technology including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes. Representative spectral sensitizing dyes are discussed in *Research Disclosure*, Item 36544, September 1994, the disclosure of which, including the disclosure of references cited therein are incorporated herein by reference. These dyes may be synthesized by those skilled in the art according to the procedures described herein or F. M. Hamer, *The Cyanine Dyes and Related Compounds* (Interscience Publishers, New York, 1964). Particularly preferred as a light absorbing group is a cyanine or merocyanine dye represented by the general formulae 75–79 below:

75

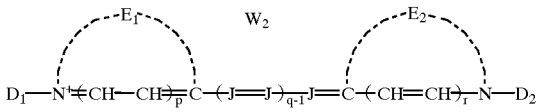

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

76

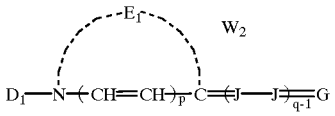

wherein $E_1$, $D_1$, J, p, q and $W_2$ are as defined above for formula 75 and G represents

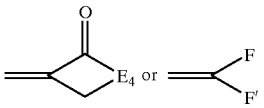

wherein $E_4$ represents the atoms necessary to complete a substituted or unsubstituted heterocyclic nucleus, and F and F' each independently represents a cyano group, an ester group, an acyl group, a carbamoyl group or an alkylsulfonyl group;

77

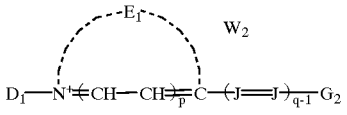

wherein $D_1$, $E_1$, J, p, q and $W_2$ are as defined above for formula 75, and $G_2$ represents a substituted or unsubstituted amino group or a substituted or unsubstituted aryl group;

78

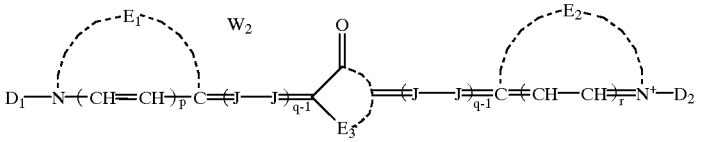

wherein $D_1$, $E_1$, $D_2$, $E_1$, J, p, q, r and $W_2$ are as defined for formula 75 above, and $E_3$ is defined the same as $E_4$ for formula 76 above;

79

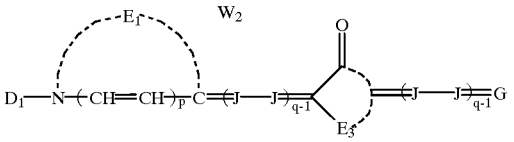

wherein $D_1$, $E_1$, J, G, p, q, r, $W_2$ and $E_3$ are as defined above.

In the above formulas, $E_1$ and $E_2$ each independently represents the atoms necessary to complete a substituted or unsubstituted 5- or 6-membered heterocyclic nucleus. These include a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art.

In one embodiment of the invention, when dyes according to formula 75 are used $E_1$ and $E_2$ each independently represent the atoms necessary to complete a substituted or unsubstituted thiazole nucleus, a substituted or unsubstituted selenazole nucleus, a substituted or unsubstituted imidazole nucleus, or a substituted or unsubstituted oxazole nucleus.

Examples of useful nuclei for $E_1$ and $E_2$ include: a thiazole nucleus, e.g., thiazole, 4-methylthiazole, 4-phenylthiazole, 5-methylthiazole, 5-phenylthiazole, 4,5-dimethyl-thiazole, 4,5-diphenylthiazole, 4-(2-thienyl) thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4-methoxybenzothiazole, 5-methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-5-dihydroxybenzothiazole, naphtho[2,1-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7', 6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole,, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6-hydroxybenzoxazole,, naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4-pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1.2-d] benzotellurazole, 5,6-dimethoxybenzotellurazole, 5-methoxybenzotellurazole, 5-methylbenzotellurazole; a thiazoline nucleus, e.g., thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5-trimethylindole; or a diazole nucleus, e.g., 5-phenyl-1,3,4-oxadiazole, 5-methyl-1,3,4-thiadiazole.

F and F' are each a cyano group, an ester group such as ethoxy carbonyl, methoxycarbonyl, etc., an acyl group, a carbamoyl group, or an alkylsulfonyl group such as ethylsulfonyl, methylsulfonyl, etc. Examples of useful nuclei for $E_4$ include a 2-thio-2,4-oxazolidinedione nucleus (i.e., those of the 2-thio-2,4-(3H,5H)-oxaazolidinone series) (e.g., 3-ethyl-2-thio-2,4 oxazolidinedione, 3-(2-sulfoethyl)-2-thio-2,4 oxazolidinedione, 3-(4-sulfobutyl)-2-thio-2,4 oxazolidinedione, 3-(3-carboxypropyl)-2-thio-2,4 oxazolidinedione, etc.; a thianaphthenone nucleus (e.g., 2-(2H)-thianaphthenone, etc.), a 2-thio-2,5-thiazolidinedione nucleus (i.e., the 2-thio-2,5-(3H,4H)-thiazoledeione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-a-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-a-naphthyl-4-thiazolidinone, etc.); a 2-thiazolin-4-one series (e.g., 2-ethylmercapto-2-thiazolin-4-one, 2-alkylphenyamino-2-thiazolin-4-one, 2-diphenylamino-2-thiazolin-4-one, etc.) a 2-imino-4-oxazolidinone (i.e., pseudohydantoin) series (e.g., 2,4-imidazolidinedione (hydantoin) series (e.g., 2,4-imidazolidinedione, 3-ethyl-2,4-imidazolidinedione, 3-phenyl-2,4-imidazolidinedione, 3-a-naphthyl-2,4-imidazolidinedione, 1,3-diethyl-2,4-imidazolidinedione, 1-ethyl-3-phenyl-2,4-imidazolidinedione, 1-ethyl-2-a-naphthyl-2,4-imidazolidinedione, 1,3-diphenyl-2,4-imidazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(2-carboxyethyl)-2-thio-2,4-imidazolidinedione, 3-phenyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-naphthyl-2-thio-2,4-imidazolidinedione, 1,3-diphenyl-2-thio-2,4-imidazolidinedione, etc.); a 2-imidazolin-5-one nucleus.

$G_2$ represents a substituted or unsubstituted amino group (e.g., primary amino, anilino), or a substituted or unsubstituted aryl group (e.g., phenyl, naphthyl, dialkylaminophenyl, tolyl, chlorophenyl, nitrophenyl).

According to the formulas 75–79, each J represents a substituted or unsubstituted methine group. Examples of substituents for the methine groups include alkyl (preferably of from 1 to 6 carbon atoms, e.g., methyl, ethyl, etc.) and aryl (e.g., phenyl). Additionally, substituents on the methine groups may form bridged linkages.

$W_2$ represents a counterion as necessary to balance the charge of the dye molecule. Such counterions include cations and anions for example sodium, potassium, triethylammonium, tetramethylguanidinium, diisopropylammonium and tetrabutylammonium, chloride, bromide, iodide, para-toluene sulfonate and the like.

$D_1$ and $D_2$ are each independently substituted or unsubstituted aryl groups (preferably of 6 to 15 carbon atoms), or more preferably, substituted or unsubstituted alkyl groups (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., 2-hydroxyethyl, 4-hydroxybutyl, etc., a carboxyalkyl group, e.g., 2-carboxyethyl, 4-carboxybutyl, etc., a sulfoalkyl group, e.g., 2-sulfoethyl, 3-sulfobutyl, 4-sulfobutyl, etc., a sulfatoalkyl group, etc., an acyloxyalkyl group, e.g., 2-acetoxyethyl, 3-acetoxypropyl, 4-butyroxybutyl, etc., an alkoxycarbonlyalkyl group, e.g., 2-methoxycarbonlyethyl, 4-ethoxycarbonylbutyl, etc., or an aralkyl group, e.g., benzyl, phenethyl, etc. The alkyl or aryl group may be substituted by one or more of the substituents on the above-described substituted alkyl groups.

Particularly preferred dyes are:

Dye 1

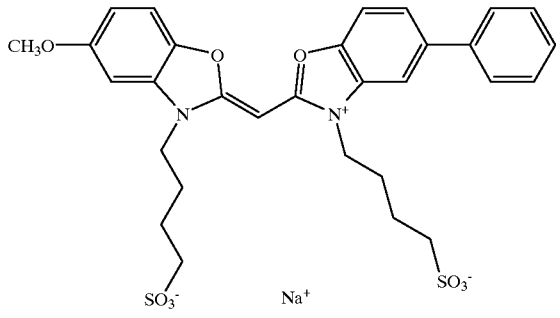

-continued
Dye 2
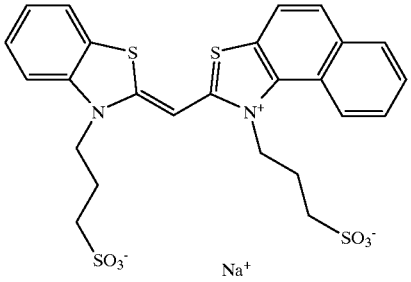
Dye 3
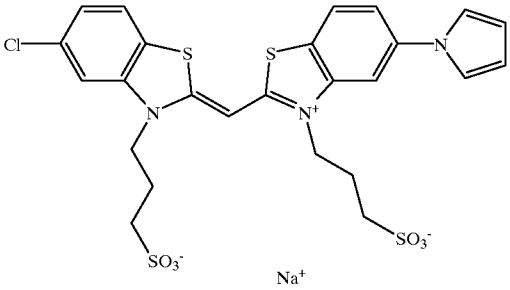
Dye 4
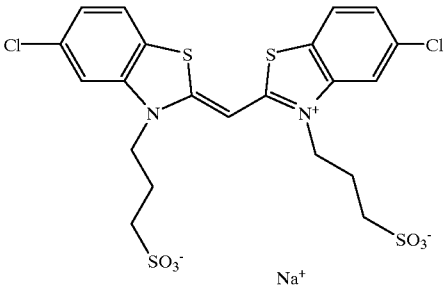
Dye 5
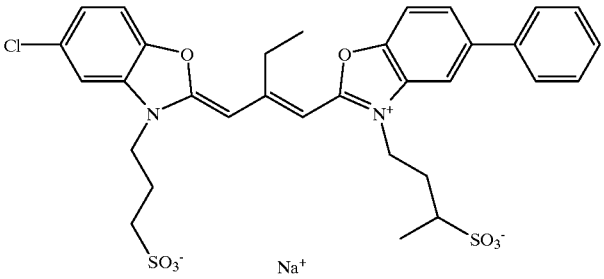
Dye 6
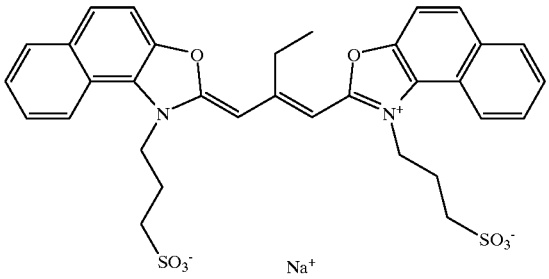

-continued
Dye 7
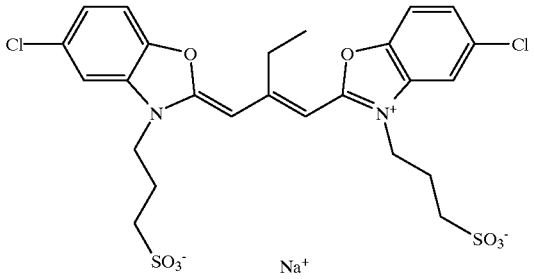
Dye 8
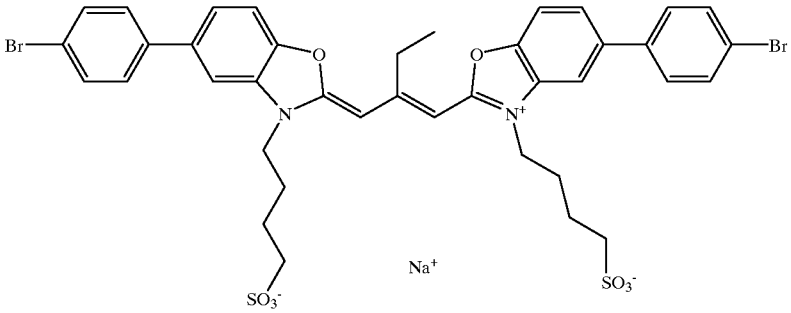
Dye 9
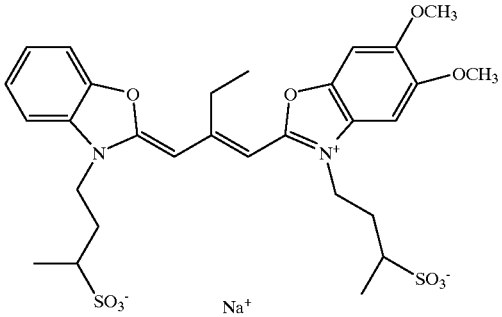
Dye 10
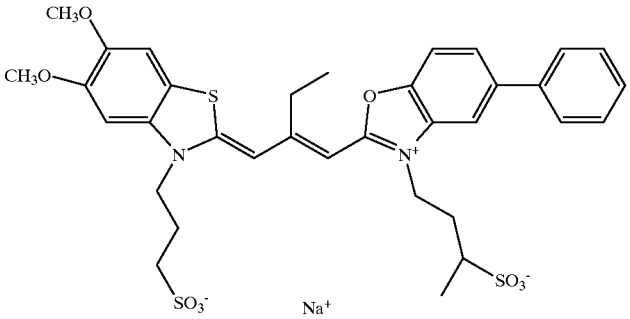
Dye 11
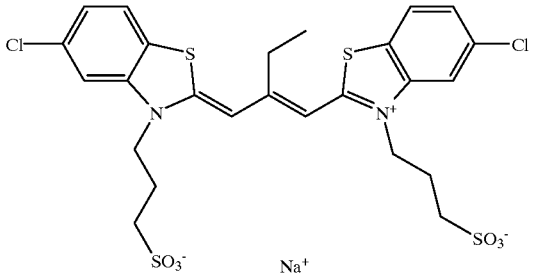

-continued
Dye 12
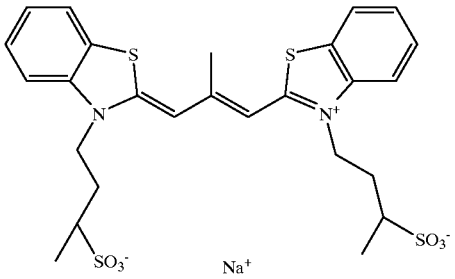
Dye 13
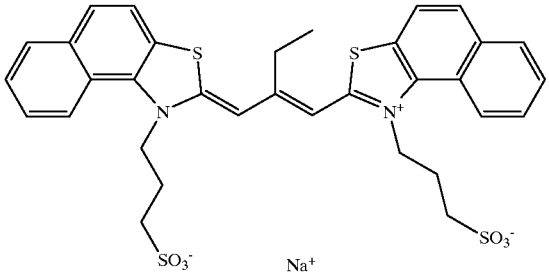
Dye 14
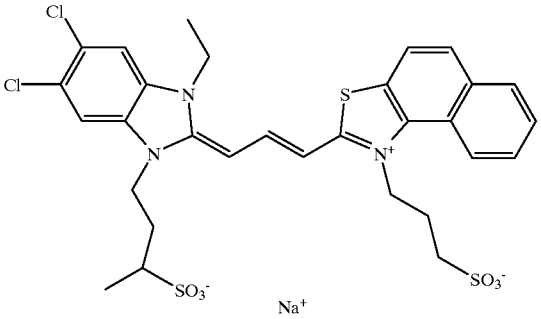
Dye 15
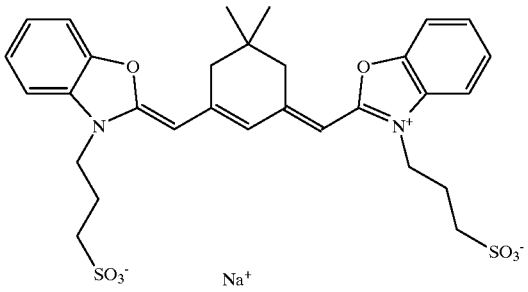
Dye 16
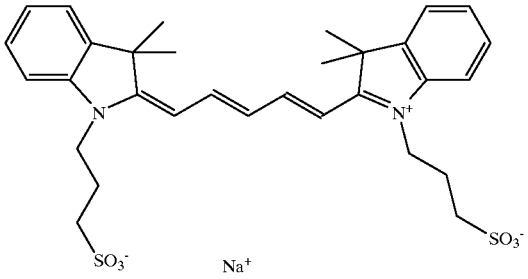

-continued

Dye 17

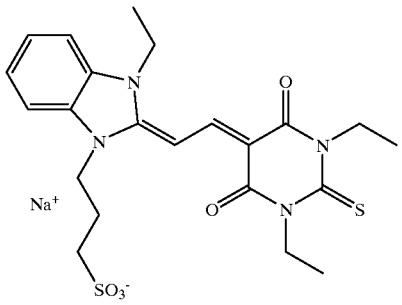

Dye 18

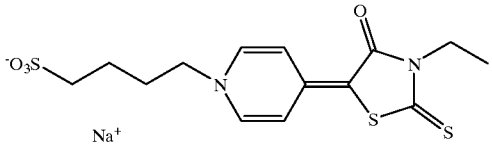

and

Dye 19

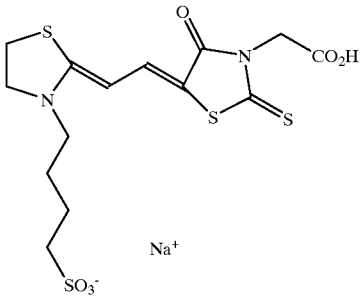

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures. Specific illustrative structures of preferred Z-(L-X—H)$_k$ compounds are provided below, but the present invention should not be construed as being limited thereto.

Compound No.

80

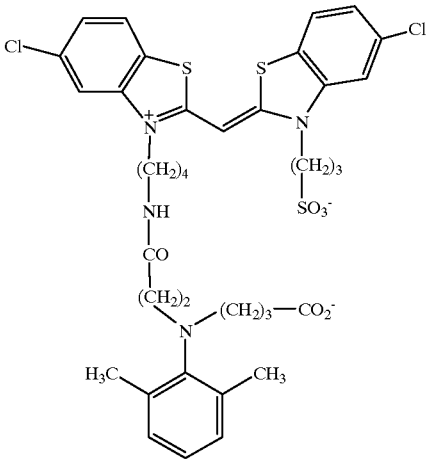

-continued
81
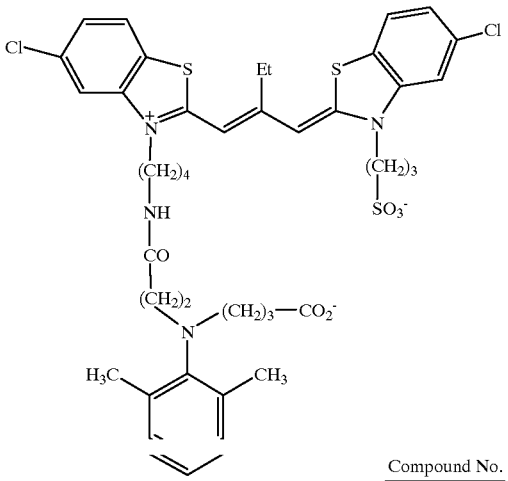
Compound No.
82
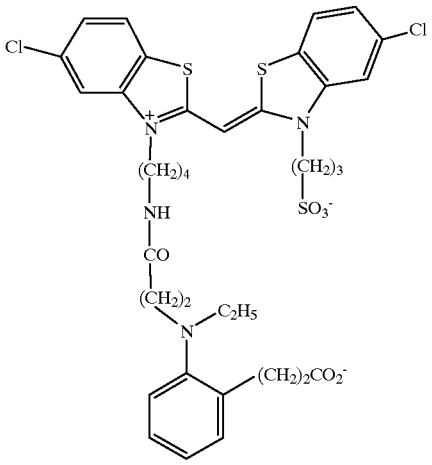
83
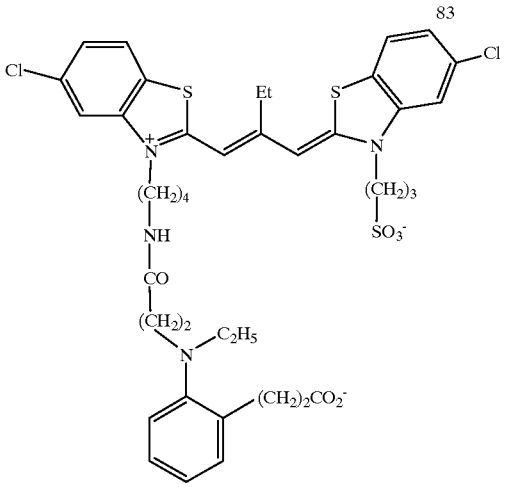
-continued
Compound No.
84
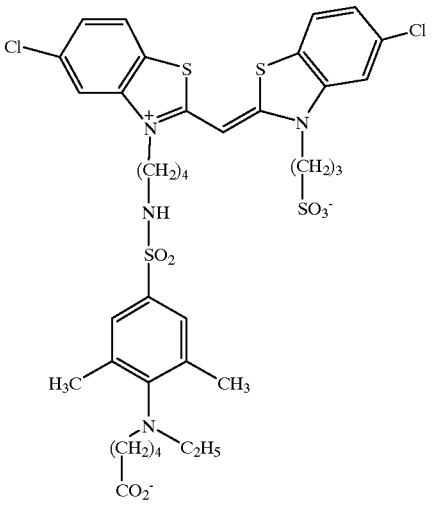
85
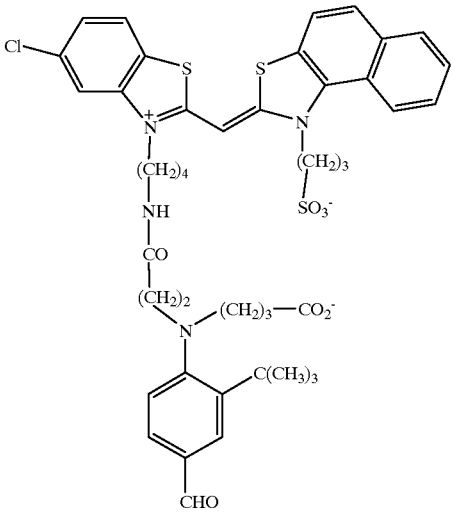
Compound No.
86
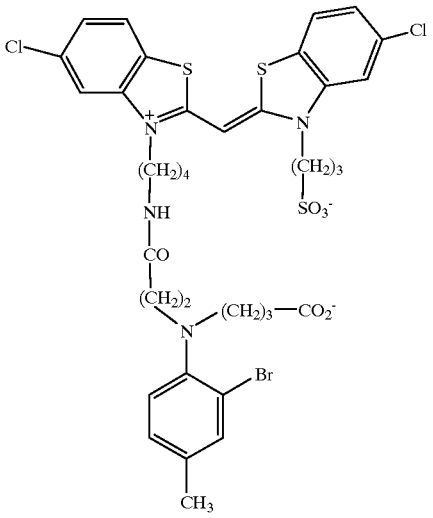

-continued

87

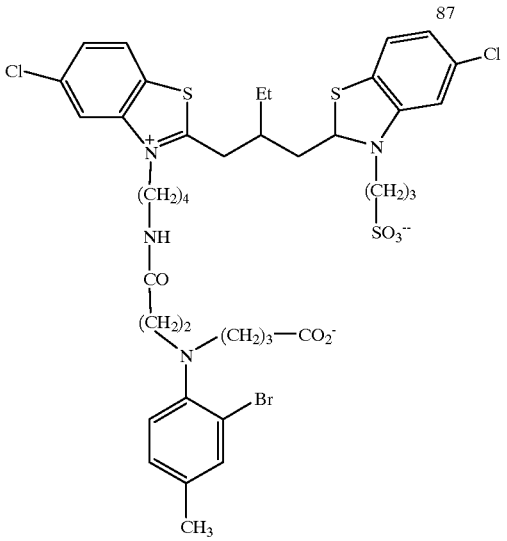

In another aspect of the present invention, the deprotonating donor compound X—H can be part of a molecule such that when the X—H moiety is conjugated with a group, Q, the resulting molecule contains the atoms necessary to form a chromophore consisting of an amidinium-ion, a carboxyl-ion or dipolar-amidic chromophoric system, represented by the formula.

Q-X—H

In this formula, the X—H symbol represents a group which has a structure and properties which are identical to those described for the unattached X—H compounds described above.

When the X—H group is connected in conjugation to the Q group, a chromophore results which consists of an amidinium-ion, a carboxyl-ion or dipolar-amidic chromophoric system that is generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Particularly preferred is Q as represented by the general formulae 88–91 below:

88

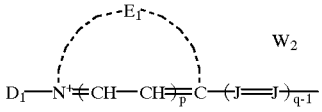

As defined above for the Z group, in this formula:

$E_1$ represents the atoms necessary to form a substituted or unsubstituted hetero ring, each J independently represents a substituted or unsubstituted methine group, q is a positive integer of from 1 to 4, p represents 0 or 1, $D_1$ represents a substituted or unsubstituted alkyl or a substituted or unsubstituted aryl, and, $W_2$ is a counterion as necessary to balance the charge;

89

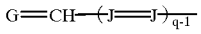

wherein G, J and q are defined above;

90

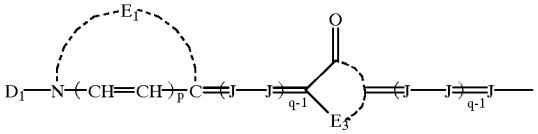

wherein $D_1$, $E_1$, $E_3$, J, p, and q are as defined above;

91

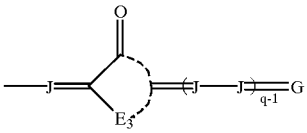

wherein $E_3$, J, G, and q, are as defined as above.

In the above formulae, $E_1$, $E_3$ and G are the same as defined above. Especially desriable nuclei for E1 are benzothiazole nuclei, naphthanothiazole nuclei, benzoxazole nuclei, naphthoxazole nuclei and benzimidazole nuclei. Especially preferred nuclei for $E_3$ are the rhodanine nucleus, 3-alkylrhodanine nucleus the 3-alkyl-2-thioxazolidin-2,4-dione nucleus, the 3-alkyl-2-thiohydantoin nucleus, the 3-alkyl-2-thio-oxazolin-2,4-dione nucleus, the isorhodanine nucleus, the barbituric acid, and the 2-thiobarbituric acid nuclus.

Specific illustrative structures of preferred Q-X—H compounds are provided below, but the present invention should not be construed as being limited thereto.

Compound No. 92

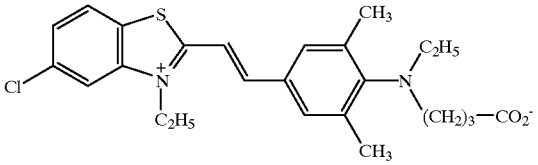

93

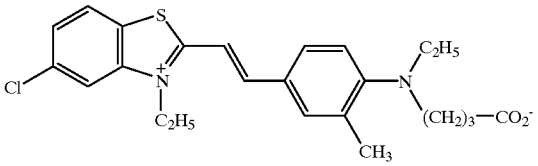

94

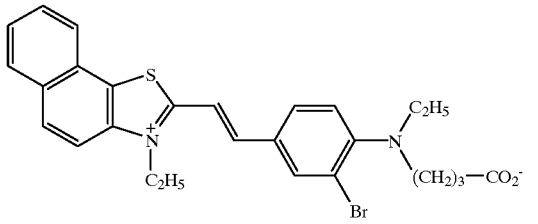

-continued

95

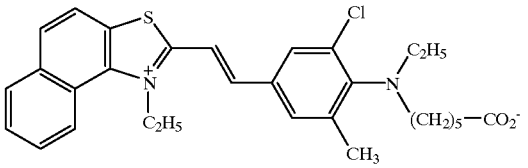

96

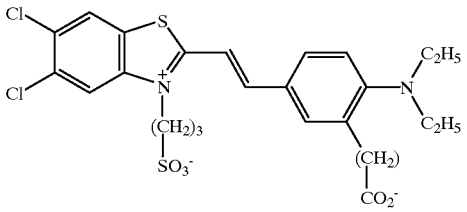

97

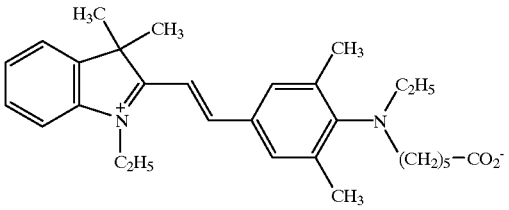

98

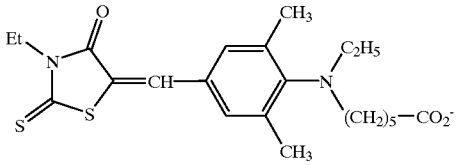

99

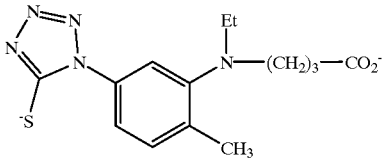

100

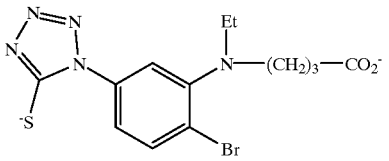

101

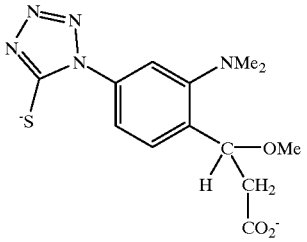

102

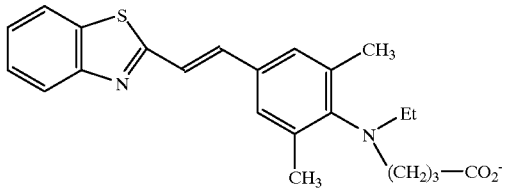

In another aspect of the present invention, the deprotonating donor compound X—H can be part of a molecule wherein the X—H moiety is connected to a group, A, which is a silver halide adsorptive group as described above.

$$A\text{-}(X\text{—}H)_k$$

or $$(A)_k\text{-}X\text{—}H$$

These compounds are distinguished from the A-(L-X—H)$_k$ and (A-L)$_k$-X—H compounds described in detail above in that the X—H moiety is not attached to the A moiety via a linking group, but is directly connected to the A moiety. Detailed descriptions of the A and X—H moiety are given above, with the following expections: (1) when A is a cyclic or an acyclic thioether, or their Se or Te analogues, in the structures set forth above for preferred thioethers and analogs, the parameter "a" should be equal to 0; (2) preferred phosphine compounds are of the formula $(R'')_2$—P. The X—H moiety can be either a one-electron or a two-electron donor as described above.

The connection of the X—H and A moieties may be at one (or more) of the heteroatoms, at one )or more) of the aromatic or heterocyclic rings on the X portion of the X—H. Specific examples which illustrate the way in which the two mioeties are connected are given below. The structures shown below are examples only and the present invention should not be construed as being limited thereto.

In another aspect of the present invention, the deprotonating donor compound X—H can be part of a molecule wherein the X—H moiety is connected to a group, Z, where Z is a light absorbing group as described above which includes, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

$$Z\text{-}(X\text{—}H)_k$$

or $$(Z)_k\text{-}X\text{—}H$$

These compounds are distinguished from the Z-(L-X—H)$_k$ and (Z-L)$_k$-X—H compounds described in detail above in that the X—H moiety is not attached to the Z moiety via a linking group, but is directly connected to the Z moiety. Detailed descriptions of the Z and X—H moiety are given above. The X—H moiety can be either a one-electron or a two-electron donor as described above. The connection of the X—H and A moieties may be at one (or more) of the heteroatoms, at one )or more) of the aromatic or heterocyclic rings on the X portion of the X—H. Specific examples which illustrate the way in which the two mioeties are connected are given below. The structures shown below are examples only and the present invention should not be construed as being limited thereto.

Compound No.

103

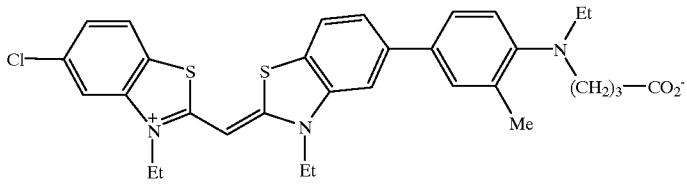

104

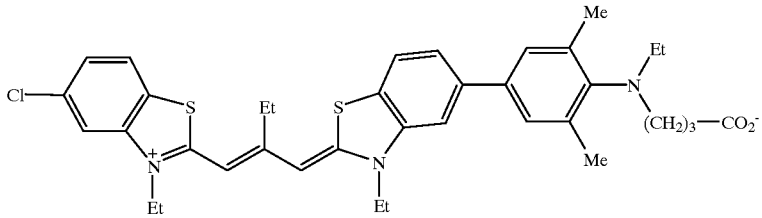

105

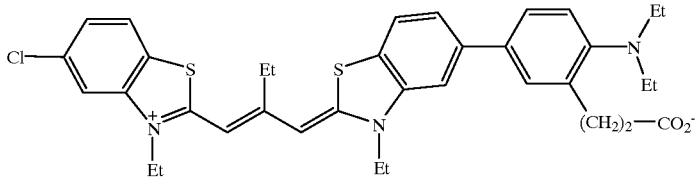

The deprotonating electron donors useful in this invention are vastly different from the silver halide adsorptive (one)-electron donating compounds described in U.S. Pat. No. 4,607,006. The electron donating moieties described therein, for example phenothiazine, phenoxazine, carbazole, dibenzophenothiazine, ferrocene, tris(2,2'-bipyridyl) ruthenium, or a triarylamine are well known for forming extremely stable, i.e., non-deprotonating, radical cations as noted in the following references: J. Heterocyclic Chem., vol. 12, 1975, pp 397–399, J. Org. Chem., vol 42, 1977, pp 983–988, "The Encyclopedia of Electrochemistry of the Elements", Vol XIII, pp 25–33, A. J. Bard Editor, published by Marcel Dekker Inc., Advances in Physical Organic Chemistry, vol 20. pp 55–180, V. Gold Editor, 1984, published by Academic Press, NY. Also, the electron donating adsorptive compounds of U.S. Pat. No. 4,607,006 donate only one electron per molecule upon oxidation. In a preferred embodiment of the present invention, the deprotonating electron donors are capable of donating two electrons.

The deprotonating electron donors of the present invention also differ from other known photographically active compounds such as R-typing agents, nucleators, and stabilizers. Known R-typing agents, such as Sn complexes, thiourea dioxide, borohydride, ascorbic acid, and amine boranes are very strong reducing agents. These agents typically undergo multi-electron oxidations but have oxidation potentials more negative than 0 V vs SCE. For example the oxidation potential for $SnCl_2$ is reported in CRC Handbook of Chemistry and Physics, 55th edition, CRC Press Inc., Cleveland Ohio 1975, pp D122 to be ~−0.10 V and that for borohydride is reported in J. Electrochem. Soc., 1992, vol. 139, pp 2212–2217 to be −0.48 V vs SCE. These redox characteristics allow for an uncontrolled reduction of silver halide when added to silver halide emulsions, and thus the obtained sensitivity improvements are very often accompanied by undesirable levels of fog. Conventional nucleator compounds such as hydrazines and hydrazides differ from the deprotonating electron donors described herein in that nucleators are usually added to photographic emulsions in an inactive form. Nucleators are transformed into photographaically active compounds only when activated in a strongly basic solution, such as a developer solution, wherein the nucleator compound undergoes a deprotonation or hydrolysis reaction to afford a strong reducing agent. In contrast, the X—H compounds of this invention do not deprotonate or undergo hydrolysis to give strong reducing agents under such basic conditions.

Amines with carboxylic acid groups have previously been added to photographic emulsions, but have completely different functions or structures to the deprotonating electron donors of the present invention. The use of certain amino carboxylic acids to improve stability and sensitivity of photographic emuslions has been described in U.S. Pat. No. 4,314,024. Only aliphatic amino carboxylic acids were described, however, which distinguishes these species from the deprotonating electron donors of the present invention which are mainly aromatic amine derivatives. The use of amino acids to prevent desensitization by chelating adventitious metals has been described in U.S. Pat. No. 4,514,492. The use of dihydropyridines to reduce desensitization is described in U.S. Pat. No. 5,192,654. These compounds showed no sensitization effect in the absence of added dyes, which is exactly opposite to the behavior observed for the present deprotonating donor compounds. The use of dihydropyridines as nucleating agents has also been described in Japanese Patent Nos. 06208195 A2, 010521426 A2 and 63034535. An aminophenol substituted with a carboxylic group has been used as an anti-foggant Japan Patent No. 62011850 A2. No change in the intrinsic photographic sensitivity was observed with this compound. The use of carboxylate substituted anilino dyes which act as filter dyes and which do not influence the intrinsic sensitivity of the emulsion has been described in U.S. Pat. No. 4925782, Japanese Patent No. 03103846 A2, Japanese Patent No.

01042646 A2. Carboxylate substituted anilino dyes have been used as filter dyes in direct reversal films U.S. Pat. No. 4,756,995, and in Japanese Patent No. 59154439 A2.

The emulsion layer of the photographic element of the invention can comprise any one or more of the light sensitive layers of the photographic element. The photographic elements made in accordance with the present invention can be black and white elements, single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, (that is, blue sensitive furthest from the support) and the reverse order on a reflective support being typical.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed.

In the following discussion of suitable materials for use in elements of this invention, reference will be made to *Research Disclosure*, September 1994, Number 365, Item 36544, which will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. The foregoing references and all other references cited in this application, are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); development inhibitors and their precursors (U.S. Pat. No. 5,460,932; U.S. Pat. No. 5,478,711); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579, 816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds which may be useful in the elements of the invention are disclosed in Japanese Published Applications 83-09,959; 83-62,586; 90-072,629; 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements may be silver iodobromide, silver bromide, silver chloride, silver chlorobromide, silver chloroiodobromide, and the like.

The type of silver halide grains preferably include polymorphic, cubic, and octahedral. The grain size of the silver halide may have any distribution known to be useful in photographic compositions, and may be either polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers ($\mu$m). The tabular grains can be of any thickness compatible with achieving an aim average aspect ratio and/or average tabularity of the tabular grain emulsion. Preferably the tabular grains satisfying projected area requirements are those having thicknesses of <0.3 $\mu$m, thin (<0.2 $\mu$m) tabular grains being specifically preferred and ultra-thin (<0.07 $\mu$m) tabular grains being contemplated for maximum tabular grain performance enhancements. When the native blue absorption of iodohalide tabular grains is relied upon for blue speed, thicker tabular grains, typically up to 0.5 $\mu$m in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure*, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in Research Discolosure Item 36736 published November 1994, here incorporated by reference.

The SET dopants are effective at any location within the grains. Generally better results are obtained when the SET dopant is incorporated in the exterior 50 percent of the grain, based on silver. An optimum grain region for SET incorporation is that formed by silver ranging from 50 to 85 percent of total silver forming the grains. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

SET dopants are known to be effective to reduce reciprocity failure. In particular the use of iridium hexacoordination complexes or $Ir^{+4}$ complexes as SET dopants is advantageous.

Iridium dopants that are ineffective to provide shallow electron traps (non-SET dopants) can also be incorporated into the grains of the silver halide grain emulsions to reduce reciprocity failure. To be effective for reciprocity improvement the Ir can be present at any location within the grain structure. A preferred location within the grain structure for Ir dopants to produce reciprocity improvement is in the region of the grains formed after the first 60 percent and before the final 1 percent (most preferably before the final 3 percent) of total silver forming the grains has been precipitated. The dopant can be introduced all at once or run into the reaction vessel over a period of time while grain precipitation is continuing. Generally reciprocity improving non-SET Ir dopants are contemplated to be incorporated at their lowest effective concentrations.

The contrast of the photographic element can be further increased by doping the grains with a hexacoordination complex containing a nitrosyl or thionitrosyl ligand (NZ dopants) as disclosed in McDugle et al U.S. Pat. No. 4,933,272, the disclosure of which is here incorporated by reference.

The contrast increasing dopants can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various SET, non-SET Ir and NZ dopants have been set out above, it is recognized that specific optimum concentration ranges within these general ranges can be identified for specific applications by routine testing. It is specifically contemplated to employ the SET, non-SET Ir and NZ dopants singly or in combination. For example, grains containing a combination of an SET dopant and a non-SET Ir dopant are specifically contemplated. Similarly SET and NZ dopants can be employed in combination. Also NZ and Ir dopants that are not SET dopants can be employed in combination. Finally, the combination of a non-SET Ir dopant with a SET dopant and an NZ dopant. For this latter three-way combination of dopants it is generally most convenient in terms of precipitation to incorporate the NZ dopant first, followed by the SET dopant, with the non-SET Ir dopant incorporated last.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The silver halide to be used in the invention may be advantageously subjected to chemical sensitization. Compounds and techniques useful for chemical sensitization of silver halide are known in the art and described in *Research Disclosure I* and the references cited therein. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I*, or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride,
4-amino-3-methyl-N,N-diethyl aniline hydrochloride,
4-amino-3-methyl-N-ethyl-N-(β-(methanesulfonamido) ethylaniline sesquisulfate hydrate,
4-amino-3-methyl-N-ethyl-N-(β-hydroxyethyl)aniline sulfate,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure*, Vol. 116, December, 1973, Item 11660, and Bissonette *Research Disclosure*, Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The deprotonating electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The deprotonating electron donor may be used as the sole sensitizer in the emulsion. However, in preferred embodiments of the invention a sensitizing dye is also added to the emulsion. The compounds can be added before, during or after the addition of the sensitizing dye.

The amount of electron donor which is employed in this invention may range from as little as $1\times10^{-8}$ mole per mole of silver in the emulsion to as much as about 0.1 mole per mole of silver, preferably from about $5\times10^{-7}$ to about 0.05 mole per mole of silver. Where the oxidation potential, $E_{ox1}$, of a two-electron donating X—H, or the X—H part of a two-electron donating compound, is relatively low it is more active, and relatively less agent need be employed. Conversely, when the oxidation potential of a two-electron donating X—H, or the X—H part of a two-electron donating compound is relatively high, a larger amount thereof, per mole of silver, is employed. For deprotonating one-electron donor compounds, larger amounts per mole of silver are usually employed For deprotonating one or two electron donor compounds linked to or containing an adsorbable moiety, the maximum amount of compound employed in this invention is lower, about 0.01 mole or less per mole of silver in an emulsion layer, preferably 0.001 mole per mole of silver or less. For deprotonating one or two electron donor compounds linked to or containing a sensitizing dye, the maximum amount of compound employed in this invention is also lower, about $2\times10^{-3}$ mole or less per mole of silver in an emulsion layer, preferably $2\times10^{-4}$ mole per mole of silver or less.

Spectral sensitizing dyes can be used together with the deprotonating electron donor of this invention. Preferred sensitizing dyes that can be used are cyanine, merocyanine, styryl, hemicyanine, or complex cyanine dyes. Illustrative examples of such sensitizing dyes are the same as those given for the Z groups described above.. Where the deprotonating one or two electron donor compound is linked to or contains a sensitizing dye, the molar ratio of conventional spectral sensitizing dye to the deprotonating electron donor compound of the present invention, is typically from about 99.99:0.01 to about 50:50. The optimum ratio can be determined through an ordinary emulsion test.

Various compounds may be added to the photographic material of the present invention for the purpose of lowering the fogging of the material during manufacture, storage, or processing. Typical antifoggants are discussed in Section VI of Research Disclosure I, for example tetraazaindenes, mercaptotetrazoles, polyhydroxybenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

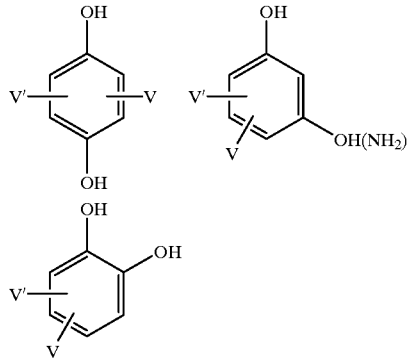

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, —$CH_2CH_2COOH$, —$CH_3$, —$CH_2CH_3$, —$C(CH_3)_3$, —$OCH_3$, —CHO, —$SO_3K$, —$SO_3Na$, —$SO_3H$, —$SCH_3$, or -phenyl.

Especially preferred hydroxybenzene compounds follow:

HB1

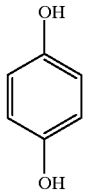

-continued

HB2

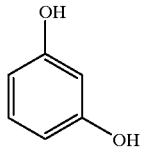

HB3

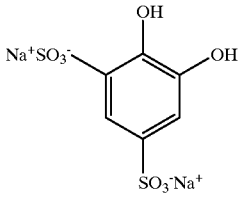

HB4

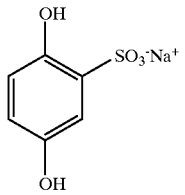

HB5

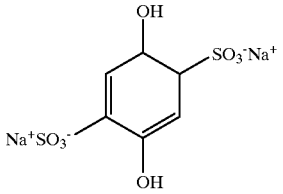

HB6

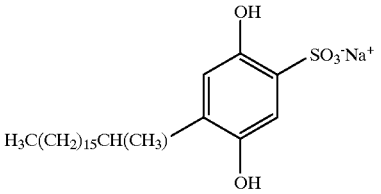

HB7

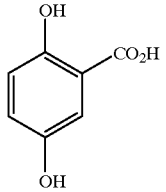

HB8

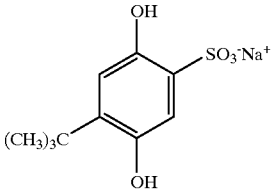

HB9

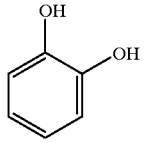

-continued

HB10

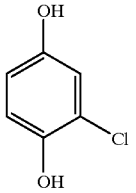

HB11

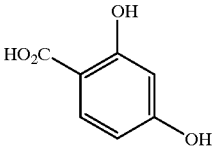

HB12

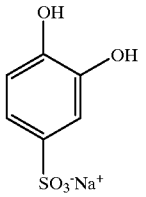

HB13

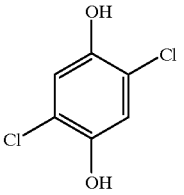

HB14

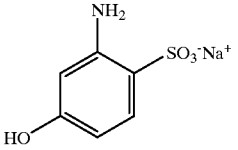

HB15

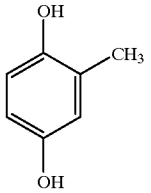

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times10^{-3}$ to $2\times10^{-2}$ mol, per mol of silver halide.

Laser Flash Photolysis Method (a) Oxidation Potential of Radical $X^{\bullet}$

The laser flash photolysis measurements were performed using a nanosecond pulsed excimer (Questek model 2620, 308 nm, ca. 20 ns, ca. 100 mJ) pumped dye laser (Lambda Physik model FL 3002). The laser dye was DPS (commercially available from Exciton Co.) in p-dioxane (410 nm, ca. 20 ns, ca. 10 mJ). The analyzing light source was a pulsed 150W xenon arc lamp (Osram XBO 150/W). The arc lamp power supply was a PRA model 302 and the pulser was a PRA model M-306. The pulser increased the light output by ca. 100 fold, for a time period of ca. 2–3 ms. The analyzing light was focussed through a small aperture (ca. 1.5 mm) in a cell holder designed to hold 1 $cm^2$ cuvettes.

The laser and analyzing beams irradiated the cell from opposite directions and crossed at a narrow angle (ca. 15°). After leaving the cell, the analyzing light was collimated and focussed onto the slit (1 mm, 4 nm bandpass) of an ISA H-20 monochromator. The light was detected using 5 dynodes of a Hamamatsu model R446 photomultiplier. The output of the photomultiplier tube was terminated into 50 ohm, and captured using a Tektronix DSA-602 digital oscilloscope. The entire experiment is controlled from a personal computer.

The experiments were performed either in acetonitrile, or a mixture of 80% acetonitrile and 20% water. The first singlet excited state of a cyanoanthracene (A), which acted as the electron acceptor, was produced using the nanosecond laser pulse at 410 nm. Quenching of this excited state by electron transfer from the relatively high oxidation potential donor biphenyl (B), resulted in efficient formation of separated, "free", radical ions in solution, $A^{\bullet-}+B^{\bullet+}$. Secondary electron transfer then occurred between $B^{\bullet+}$ and the lower oxidation potential electron donor X—H, to generate $X—H^{\bullet+}$ in high yield. For the investigations of the oxidation potentials of the radicals $X^{\bullet}$, typically the cyanoanthrancene concentration was ca. $2\times10^{-5}$ M to $10^{-4}$ M, the biphenyl concentration was ca. 0.1 M. The concentration of the X—H donor was ca. $10^{-3}$ M. The rates of the electron transfer reactions are determined by the concentrations of the substrates. The concentrations used ensured that the $A^{\bullet-}$ and the $X—H^{\bullet+}$ were generated within 100 ns of the laser pulse. The radical ions could be observed directly by means of their visible absorption spectra. The kinetics of the photogenerated radical ions were monitored by observation of the changes in optical density at the appropriate wavelengths.

The reduction potential ($E_{red}$) of 9,10-dicyanoanthracene (DCA) is −0.91 V. In a typical experiment, DCA is excited and the initial photoinduced electron transfer from the biphenyl to the DCA forms a $DCA^{\bullet-}$, which is observed at its characteristic absorption maximum ($\lambda_{obs}$=705 nm), within ca. 20 ns of the laser pulse. Rapid secondary electron transfer occurs from X—H to the biphenyl radical cation to generate $X—H^{\bullet+}$, which deprotonates to give $X^{\bullet}$. A growth in absorption is then observed at 705 nm with a time constant of ca. 1 microsecond, due to reduction of a second DCA by the $X^{\bullet}$. The absorption signal with the microsecond growth time is equal to the size of the absorption signal formed within 20 ns. If reduction of two DCA was observed in such an experiment, this indicates that the oxidation potential of the $X^{\bullet}$ is more negative than −0.9 V.

If the oxidation potential of $X^{\bullet}$ is not sufficiently negative to reduce DCA, an estimate of its oxidation potential was obtained by using other cyanoanthracenes as acceptors. Experiments were performed in an identical manner to that described above except that 2,9,10-tricyanoanthracene (TriCA, $E_{red}$ −0.67 V, $\lambda_{obs}$=710 nm) or tetracyanoanthracene (TCA, $E_{red}$ −0.44 V, $\lambda_{obs}$=715 nm) were used as the electron acceptors. The oxidation potential of the $X^{\bullet}$ was taken to be more negative than −0.7 if reduction of two TriCA was observed, and more negative than −0.5 V if reduction of two TCA was observed. Occasionally the size of the signal from the second reduced acceptor was smaller than that of the first. This was taken to indicate that electron transfer from the $X^{\bullet}$ to the acceptor was barely exothermic, i.e. the oxidation potential of the radical was essentially the same as the reduction potential of the acceptor.

To estimate the oxidation potentials of $X^{\bullet}$ with values less negative than −0.5 V, i.e. not low enough to reduce even tetracyanoanthracene, a slightly different approach was used. In the presence of low concentrations of an additional acceptor, A2, that has a less negative reduction potential than the primary acceptor, A (DCA, for example), secondary electron transfer from $A^{\bullet-}$ to A2 will take place. If the reduction potential of A2 is also less negative than the oxidation potential of the $X^{\bullet}$, then A2 will also be reduced by the radical, and the magnitude of the $A2^{\bullet-}$ absorption signal will be doubled. In this case, both the first and the second electron transfer reactions are diffusion controlled and occur at the same rate. Consequently, the second reduction cannot be time resolved from the first. Therefore, to determine whether two electron reduction actually takes place, the $A2^{\bullet-}$ signal size must be compared with an analogous system for which it is known that reduction of only a single A2 occurs. For example, a reactive $X—H^{\bullet+}$ which might give a reducing $X^{\bullet}$ can be compared with a nonreactive $X—H^{\bullet+}$. Useful secondary electron acceptors (A2) that have been used are chlorobenzoquinone ($E_{red}$ −0.34 V, $\lambda_{obs}$=450 nm), 2,5-dichlorobenzoquinone ($E_{red}$ −0.18 V, $\lambda_{obs}$=455 nm) and 2,3,5,6-tetrachlorobenzoquinone ($E_{red}$ 0.00 V, $\lambda_{obs}$=460 nm).

(b) Deprotonation Rate Constant Determination

The laser flash photolysis technique was also used to determine deprotonation rate constants for examples of the oxidized donors X—H. The radical cations of the X—H donors absorb in the visible region of the spectrum. Spectra of related compounds can be found in "Electron Absorption Spectra of Radical Ions" by T. Shida, Elsevier, New York, 1988. These absorptions were used to determine the kinetics of the deprotonation reactions of the radical cations of the X—H. Excitation of 9,10-dicyanoanthracene (DCA) in the presence of biphenyl and the X—H donor, as described above, results in the formation of the $DCA^{\bullet-}$ and the $X—H^{\bullet+}$. By using a concentration of X—H of ca. $10^{-2}$ M, the $X—H^{\bullet+}$ can be formed within ca. 20 ns of the laser pulse. With the monitoring wavelength set within an absorption band of the $X—H^{\bullet+}$, a decay in absorbance as a function of time is observed due to the deprotonation reaction. The monitoring wavelengths used were somewhat different for the different donors, but were mostly around 470–530 nm. In general the $DCA^{\bullet-}$ also absorbed at the monitoring wavelengths, however, the signal due to the radical anion was generally much weaker than that due to the radical cation, and on the timescale of the experiment the $A^{\bullet-}$ did not decay, and so did not contribute to the observed kinetics. As the $X—H^{\bullet+}$ decayed, the radical $X^{\bullet}$ was formed, which in most cases reacted with the cyanoanthracene to form a second $A^{\bullet-}$. To make sure that this "grow-in" of absorbance due to $A^{\bullet-}$ did not interfere with the time-resolved decay measurements, the concentration of the cyanoanthracene was maintained below ca. $2\times10^{-5}$ M. At this concentration the second reduction reaction occurred on a much slower timescale than the $X—H^{\bullet+}$ decay. Alternatively, when the decay rate of the $X—H^{\bullet+}$ was less than $10^6$ $s^{-1}$, the solutions were purged with oxygen. Under these conditions the $DCA^{\bullet-}$ reacted with the oxygen to form $O_2^{\bullet-}$ within 100 ns, so that its absorbance did not interfere with that of the $X—H^{\bullet+}$ on the timescale of its decay.

The experiments measuring the deprotonation rate constants were performed in acetonitrile with the addition of 20% water, so that all of the salts could be easily solubilized. Most experiments were performed at room temperature. In some cases the deprotonation rate was either too fast or too slow to be easily determined at room temperature. When this happened, the deprotonation rate constants were measured as a function of temperature, and the rate constant at room temperature determined by extrapolation.

Synthesis of Representative X—H Compounds

The following examples illustrate the synthesis of typical deprotonating electron donor compounds. Other compounds can also be synthesized by analogy using appropriately selected known starting materials.

1. Preparation of Intermediate I1.

I1

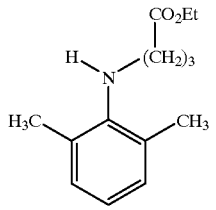

2,6-Dimethylaniline (60.6 g, 0.5 mol), ethyl 4-bromobutyrate (97.5 g, 0.5 mol), triethylamine (50.5 g, 0.5 mol) and toluene (100 mL) were stirred at reflux for 16 h. The resulting salt was removed by filtration, and the filtrate concentrated in vacuo at 90 C. to an oil (112 g). The desired secondary aniline I1 was isolated by vacuum distillation (52.3 g, b.p. 120–132 C. at 0.1 to 0.2 mm Hg).

$^1$H NMR (300 MHz, $CD_3Cl$): 1.25 (t, 3H), 1.90 (m, 2H), 2.30 (s, 6H), 2.40 (t, 2H), 3.00 (bt, 2H+NH), 4.15 (2H, q) 6.80 (1H, t), 6.95 (d, 2H).

$^{13}$C NMR (75 MHz, $CD_3Cl$): 14.15, 18.42, 26.26, 31.87, 47.63, 60.27, 121.85, 128.72, 129.43, 145.86, 173.27.

2. Preparation of Compound 57.

I1 (4.7 g, 0.02 mol), sodium hydroxide (0.8 g, 0.02 mol), ethanol (20 mL) and water (20 mL) were stirred at reflux for 60 h. The mixture was concentrated in vacuo at 90 C. to a white paste. Acetonitrile (50 mL) was added to give the product 37 as a white solid. The solid was collected, washed with acetonitrile and dried in vacuo at 80 C. (4.35 g).

$^1$H NMR (300 MHz, $D_2O$): 1.85 (2H, m,), 2.30 (s, t, 8H), 2.95 (t, 2H), 4.80 (HOD), 6.95 (t, 1H), 7.05 (d, 2H).

$^{13}$C NMR (75 MHz, $D_2O$): 11.97, 20.88, 29.56, 42.34, 117.28, 123.31, 124.60, 139.14, 177.06.

3. Preparation of Intermediate I2.

I2

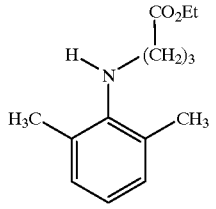

I1 (7.06 g, 0.03 mol), ethyl triflate (5.35 g, 0.03 mol), ethyldiisopropylamine (3.88 g, 0.03 mol) and butyronitrile (20 mL) were stirred at reflux for 16 h. The mixture was concentrated in vacuo at 90 C. Ligroin was added and the resulting salt was removed by filtration and discarded. The filtrate was concentrated in vacuo at 90 C. to give an oil (7.22 g). The pure tertiary aniline ester 12 (6.0 g) was isolated via flash chromatography ($SiO_2$, 9 ligroin: 1 EtOAc).

$^1$H NMR (300 MHz, $CDCl_3$): 1.00 (t, 3H), 1.23 (t, 3H), 1.74 (quintet, 2H), 2.30 (s, t, 8H), 3.05 (m, 4H), 4.10 (q, 2H), 6.95 (m, 3H).

$^{13}$C NMR (75 MHz, $CDCl_3$): 14.18, 14.57, 19.51, 25.13, 32.15, 47.82, 53.09, 60.15, 124.92, 128.76, 137.92, 147.69, 173.59.

4. Preparation of Compound 44.

I2 (5.26 g, 0.02 mol), sodium hydroxide (0.8 g, 0.02 mol), ethanol (20 mL) and water (20 mL) were stirred at reflux for 16 h. The mixture was concentrated in vacuo at 90 C. to give a gummy solid. Acetonitrile was added to produce a crystalline solid which was collected and dried in vacuo at 80 C. (4.25 g).

$^1$H NMR (300 MHz, $D_2O$): 0.90 (t, 3H), 1.65 (quintet, 2H), 2.20 (t, 2H), 2.28 (s, 6H), 3.30 (m, 4H), 6.90 (m, 3H).

$^{13}$C NMR (75 MHz, $D_2O$): 8.21, 13.59, 20.28, 29.94, 41.80, 47.86, 119.39, 123.15, 132.41, 141.60, 177.43.

5. Preparation of Intermediate I3.

I3

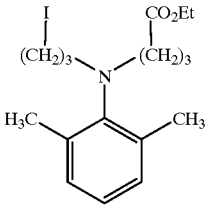

A mixture of I1 (4.65 g, 0.02 mol), 1,3-diiodopropane (11.83 g, 0.04 mol) ethyldiisopropylamine (2.58 g, 0.02 mol) and acetonitrile (25 mL) were stirred at reflux for 16 h. The mixture was concentrated in vacuo at 95 C. to give an oil (18.35 g). Ligroin (100 mL) was added to the oil to precipitate a salt. The salt was removed by filtration and the filtrated concentrated in vacuo at 95 C. to give an oil (11.05 g). The pure iodopropylaniline derivative I3 (2.4 g) was isolated by flash chromatography ($SiO_2$, 9 ligroin: 1 EtOAc).

$^1$H NMR (300 MHz, $CDCl_3$): 1.25 (t, 3H), 1.75 (quintet, 2H), 1.95 (quintet, 2H), 2.28 (t, 2H), 2.30 (s, 6H), 3.05 (m, 2H), 3.15 (m, 4H), 4.10 (q, 2H), 7.00 (m, 3H).

$^{13}$C NMR (75 MHz, $CDCl_3$): 4.17, 14.22, 19.56, 24.89, 32.04, 33.30, 53.99, 54.60, 60.25, 125.30, 129.04, 137.55, 147.37, 173.36.

6. Preparation of Intermediate I4.

I4

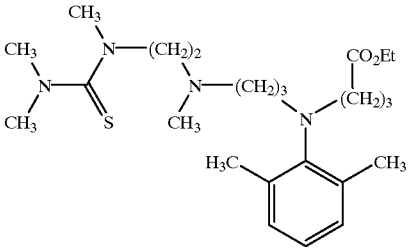

I3 (2.4 g, 0.006 mol), N,N-dimethyl-N'-methyl-N'-(2-N"-methylaminoethyl)thiourea (1.05 g, 0.006 mol, ethyldiisopropylamine (0.78 g, 0.006 mol) and dichloromethane (20 mL) were stirred at reflux for 16 h. The solvent was removed in vacuo at 50 C. The resulting oil was partitioned between water (pH 10) and ethyl ether. The crude compound was recovered from the ether extract. The pure compound (0.19 g) was obtained via flash chromatography (SiO2, 9 dichloromethane, 1 methanol).

$^1$H NMR (300 MHz, $CDCl_3$): 1.25 (t, 3H), 1.65 (m, 2H), 1.80 (m, 2H), 2.30 (m, 11H), 2.45 (t, 2H), 2.70 (t, 2H), 3.00 (m, 13H), 3.75 (t, 2H), 4.10 (q 2H), 6.95 (m 3H).

$^{13}$C NMR (75 MHz): 14.16, 19.57, 24.81, 26.89, 32.01, 41.34, 41.93, 43.13, 51.98, 52.06, 53.59, 54.62, 55.81, 60.15, 125.05, 128.90, 137.51, 147.62, 173.40, 193.84.

7. Preparation of Compound 68.

I4 (0.19 g, 0.42 mmol), sodium hydroxide (0.017 g, 0.42 nmol), ethanol (10 mL) and water (10 mL) were refluxed for 16 h. The solvents were removed in vacuo at 90 C. The residue was extracted with ethyl ether. The ether extract consisted mainly of the starting ester (50 mg). The ether insoluble portion (100 mg), soluble in methanol, contained the desired sodium salt/free acid.

$^{1}$H NMR (300 MHz, $CD_3Cl$): 1.60 (m, 2H), 2.0 (m, 2H), 2.20 (m, 11H), 2.35 (m, 2H), 2.60 (m, 2H), 3.0 (m, 13H), 3.70 (m, 2H), 5.0 (m 1H), 6.90 (m, 3H).

$^{13}$C NMR (75 MHz, $CDCl_3$): 19.84, 26.53, 27.37, 36.03, 41.42, 42.16, 43.25, 51.88, 52.24, 54.60, 54.69, 55.91, 124.88, 128.89, 137.52, 148.18, 182.35, 193.70

8. Preparation of Intermediate I5.

I5

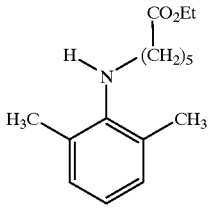

A mixture of 2,6-dimethylaniline (24.24 g, 0.2 mol), ethyl 6-bromohexanoic acid (44.62, 0.2 mol), triethylamine (20.2 g, 0.2 mol) and toluene (100 mL) were refluxed for 16 h. The resulting salt was filtered and discarded. The filtrate was concentrated in vacuo at 90 C to an oil. The oil was dissolved in ethyl ether and washed with 30% NaCl (100 mL), fresh water (100 mL) and dried with magnesium sulfate. The ether extract was concentrated under vacuum at 90 C to give an amber oil (42.3 g). The pure aniline ester I5 (23.8 g) was obtained via vacuum distillation (139–165 C at 0.04 mm Hg).

$^{1}$H NMR (300 MHz, $CDCl_3$): 1.25 (t, 3H), 1.40 (m, 2H), 1.60 (m, 4H), 2.25 (s, 6H), 2.30 (t, 2H), 2.95 (t, 2H +1H), 4.10 (q, 2H), 6.80 (t, 1H), 6.95 (d, 2H).

$^{13}$C NMR (75 MHz, $CDCl_3$): 14.13, 18.39, 24.76, 26.62, 30.79, 34.14, 48.32, 60.06, 121.52, 128.67, 129.05, 146.19, 173.42.

9. Preparation of Intermediate I6.

I6

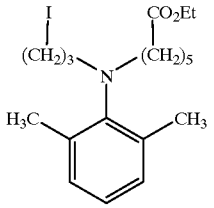

A mixture of I5 (12.14 g, 0.046 mol), 1,3-diiodopropane (27.22 g, 0.092 mol), diisopropylethylamine (5.95 g, 0.046 mol) and acetonitrile (50 mL) were stirred at reflux for 16. The mixture was concentrated in vacuo at 95 C to an oil. The oil was partitioned between ethyl ether and water (to pH 7) and the ether layer was dried with magnesium sulfate and concentrated to an oil (23.6 g). Three flash chromatography purifications (SiO2, 9 ligroin, 1 ethyl acetate) gave a fraction (2.2 g) that was rich in the desired 3-iodopropy aniline ester I6.

10. Preparation of Compound 59.

I5 (5.26 g, 0.02 mol), sodium hydroxide (0.02 mol), ethanol (20 mL) and water (20 mL) were stirred at reflux for 16 h. The mixture was concentrated in vacuo at 90 C to give an oily solid. Acetonitrile was added, and the crystalline solid was collected and dried in vacuo at 80 C (4.8 g).

$^{1}$H NMR (300 MHz, $D_2O$): 1.30 (m, 2H), 1.50 (m, 4H), 2.30 (m, 8H), 2.80 (t, 2H), 4.80 (s, 1H), 6.80 (m, 1H), 6.90 (d, 2H).

$^{3}$C NMR (75 MHz, $D_2O$): 22.10, 30.10, 30.92, 33.83, 41.97, 52.71, 127.11, 133.26, 134.34, 149.35, 187.88.

11. Preparation of I7.

I7

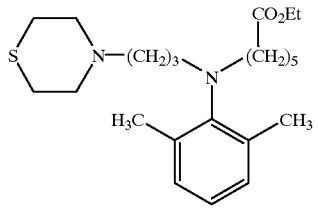

I6 (2.12 g, 5 mmol), thiomorpholine (0.52 g, 5 mmol), triethylamine (1.01 g, 10 mmol) and tetrahydrofuran (20 mL) were stirred at 25 C for 16 h. The mixture was concentrated in vacuo at 25 C, combined with ethyl ether (20 mL) and washed with 30% NaCl (2×5 mL). The ether layer was dried with magnesium sulfate and concentrated in vacuo at 50 C to an oil (1.7 g). The pure thiomorpholino aniline ethyl ester I7 (350 mg) was obtained via flash chromatography.

$^{1}$H NMR (300 MHz, $CDCl_3$): 1.25 (t, 3H), 1.30 (m, 2H), 1.45 (m, 2H), 1.60 (m, 4H), 2.25 (m, 10H), 2.65 (s, 8H), 3.30 (q, 4H), 4.10 (q, 2H), 6.95 (m, 3H).

$^{13}$C NMR (75 MHz, $CDCl_3$): 14.26, 19.63, 24.97, 26.65, 26.99, 28.02, 29.32, 34.40, 52.19, 54.23, 55.10, 57.28, 60.16, 124.89, 128.84, 137.73, 148.08, 173.66.

12. Preparation of Compound 67.

A mixture of I7 (300 mg, 0.74 mmol), sodium hydroxide (30 mg, 0.74 mmol), ethanol (10 mL) and water (10 mL) were stirred at reflux for 16 h. The mixture was concentrated in vacuo at 90 C. The resulting mass (300 mg) was triturated with acetonitrile (3×20 mL), the solvent decanted and the remaining solid dried in vacuo at 90 C to give 210 mg.

$^{1}$H NMR (300 MHz, $D_2O$): 1.20 (bs, 2H), 1.40 (bs, 2H), 1.50 (bs, 4H), 2.10 (bs, 2H), 2.25 (bs, 8H), 2.50 (bs, 8H), 2.95 (bs, 4H), 4.75 (HOD), 6.90 (bs, 3H).

$^{13}$C NMR (75 MHz, $D_2O$): 22.36, 28.27, 28.95, 29.29, 29.52, 29.84, 30.00, 31.91, 40.68, 54.63, 56.95, 57.07, 59.63, 127.69, 131.73, 140.16, 150.87, 185.82.

13. Preparation of I8.

I8

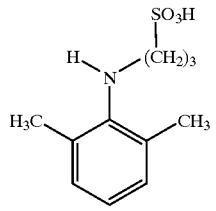

A mixture of 2,6-dimethylaniline (6.06 g, 0.05 mol), 1,3-propane sultone (6.10 g, 0.05 mol) and acetonitrile (10 mL) were stirred at reflux for 16 h. The resulting white solid was collected, washed with acetonitrile and dried in vacuo at 80 C. Yield: 9.6 g.

$^1$H NMR (300 MHz, $D_2O$ as K salt): 1.95 (quintet, 2H), 2.30 (s, 6H), 2.90 (t, 2H), 3.05 (t, 2H), 6.90 (t, 1H), 7.05 (d, 2H).

$^{13}$C NMR (75 MHz, $D_2O$ as K salt): 20.17, 27.48, 49.02, 51.21, 125.12, 131.36, 132.32, 147.08.

14. Preparation of Intermediate I9.

I9

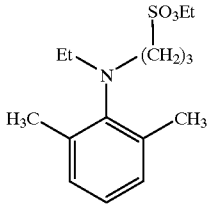

I8 (2.43 g, 0.01 mol), triethylamine (2.02 g, 0.02 mol) and acetonitrile (20 mL) were combined to obtain solution. Ethyl triflate ( 2.02 g, 0.02 mol) was added and the mixture refluxed for 16 h. The resulting salt was removed by filtration and discarded. The filtrate was concentrated in vacuo to an oil (7 g). The pure ethyl sulfonate tertiary aniline I9 (1.1 g) was obtained via flash chromatography (SiO2, 1 ligroin, 1 EtOAc).

$^1$H NMR (300 MHz, $CDCl_3$): 1.00 (t, 3H), 1.35 (t, 3H), 1.95 (m, 2H), 2.30 (s, 6H), 3.10 (m, 6H), 4.20 (q, 2H), 7.00 (m, 3 H).

$^{13}$C NMR (75 MHz, $CDCl_3$): 14.80, 16.20, 19.50, 23.82, 47.99, 48.62, 51.86, 65.79, 125.10, 129.00, 137.54, 146.00.

15. Preparation of Compound 54.

I9 (1 g, 3.3 mmol), sodium hydroxide (0.14 g, 3.5 mmol), ethanol (10 mL) and water (10 mL) were stirred at reflux for 16 h. The solution was filtered to remove a slight haze, and the filtrate concentrated in vacuo at 90 C to yield the solid sodium sulfonate (0.8 g).

$^1$H NMR (300 MHz, $D_2O$): 0.90 (t, 3H), 1.80 (m, 2H), 2.20 (s, 6H), 2.85 (t, 2H), 3.05 (m, 4H), 7.0 (m, 3H).

$^{13}$C NMR (75 MHz, $D_20$): 19.00, 22.20, 29.95, 52.78, 54.86, 57.70, 130.10, 134.20, 143.30, 152.77.

16. Preparation of Intermediate I10.

I10

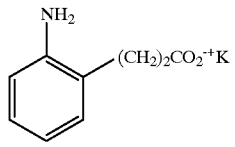

2-Nitrocinnamic acid (predominantly trans, 20.85 g, 0.11 mol) in water (125 mL) was converted to its potassium salt. The solution was hydrogenated (50 psi initially) in the presence of 10% Pd/carbon (2 g). The mixture was filtered to remove the catalyst and the filtrate concentrated in vacuo at 90 C to give a solid. The solid was stirred with acetonitrile, filtered and dried in vacuo at 90 C. Yield of white powder, 23 g.

$^1$H NMR (300 Mhz, $D_2O$): 2.45 (t, 2H), 2.80 (t, 2H), 6.85 (m, 2H), 7.15 (m, 2H).

$^{13}$C NMR (75 Mhz, $D_2O$): 30.00, 40.00, 119.64, 122.58, 130.00, 130.80, 132.06, 146.10, 184.39.

17. Preparation of I11.

I11

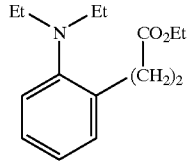

I10 (10 g, 0.05 mol), ethyl iodide (31.2 g, 0.20 mol), ethyldiisopropylamine (25.8 g, 0.20 mol) and DMF (50 mL) were stirred at 25 C for 60 h. The resulting salt was removed by filtration and discarded. The filtrate was concentrated in vacuo at 90 C to give a solid. The solid was partitioned between water (100 mL, pH 10) and ethyl ether (100 mL). The water layer was extracted with additional ether (2×100 mL). The combined extracts were dried with magnesium sulfate and concentrated in vacuo to give an oil (11 g). The pure ethyl 3-(2-N,N-diethylaminophenyl)propionate I11 was obtained via flash chromatography (7 g).

$^1$H NMR (300 MHz, $CDCl_3$): 1.00 (t, 6H), 1.25 (t, 3H), 2.65 (m, 2H), 2.95 (q, 4H), 3.05 (m, 2H), 4.15 (q, 2H), 7.00 (m, 1H), 7.15 (m, 3H).

$^{13}$C NMR (75 MHz, $CDCl_3$): 12.78, 14.27, 26.50, 35.00, 48.50, 59.98, 123.07, 124.10, 126.75, 129.62, 138.00, 150.00, 173.50.

18. Preparation of Compound 29.

I11 (7 g, 28 mmol), sodium hydroxide (1.12 g, 28 mmol), ethanol (20 mL) and water (10 mL) were stirred at reflux for 16. The solution was concentrated in vacuo at 90 C. Acetonitrile was added to the resulting solid. The solid was collected and dried in vacuo at 90 C. Yield, 6 g.

$^1$H NMR (300 MHz, $D_2O$): 1.90 (t, 6H), 2.45 (t, 2H), 2.95 (m, 6H), 7.20 (m, 1H), 7.30 (m, 3H).

$^{13}$C NMR (75 MHz, $D_2O$): 16.50, 32.42, 43.77, 54.86, 128.50, 130.00, 132.00, 134.50, 144.66, 152.88, 187.66.

19. Preparation of intermediates I12.

Amino-phenylmercaptotetrazole (50.0 g, 0.258 mol) was stirred with triethylamine (38.2 mL, 0.274 mol) in 450 mL of dry acetonitrile at rt. After initial dissolution a white precipitate formed. Diethylcarbamyl chloride (35 mL, 0.274 mol) was dissolved in 50 mL of acetonitrile and added dropwise. The solution was then heated at reflux for 3 h. The solution was chilled in an ice bath and the precipitated triethylammonium chloride removed by filtration. The solution was concentrated at reduced pressure to yield an orange oil. This oil was filtered through a 250 g plug of silica gel using 2L of methylene chloride. The filtrate was concentrated at reduced pressure and 50 mL of methanol was added. The methanol solution was cooled to 0° C. and a white solid formed. The solid was collected, washed with ether, and dried to yield 40.3 g of the blocked 3-aminophenyltetrazole intermediate I12.

intermediate I12

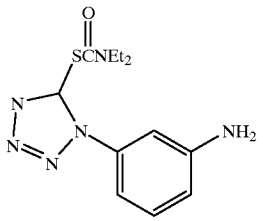

20. Preparation of intermediates I13 and I14.

A mixture of the intermediate I12 (3.35 g, 11.5 mmol), intermediate I3 (4.63 g, 11.5 mmol), potassium bicarbonate (1.15 g, 11.5 mmol) and acetonitrile (20 mL) was stirred at reflux for 40 h. The mixture was filtered and the filtrate concentrated in vacuo at 60 C. The concentrate was stirred with ligroin to give an insoluble oil. The supernatant ligroin was discarded and the insoluble oil dissolved in 1:1 ethyl acetate/ligroin to precipitate more salts. The salts were removed by filtration and the filtrate concentrated in vacuo at 60° C. to give an oil (7.5 g). The oil was subjected to flash chromatography (silica gel/1 ethyl acetate: 1 ligroin) to give intermediate I13 (monoalkylated monoester) (3.4 g, 52%) and intermediate I14 dialkylated diester (1.0 g).

intermediate I13

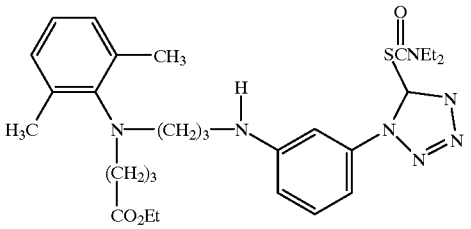

$^1$H NMR (300 MHz, CDCl3): 1.05–1.30 (m, 9H), 1.70–1.85 (m, 4H), 2.25–2.30 (m, 8H), 3.00–3.20 (m, 6H), 3.30 (bq, 4H), 3.95 (bs, 1H), 4.10 (m, 2H), 6.65 (m, 2H), 6.80 (m, 1H), 6.90–7.00 (m, 3H), 7.25 (t, 1H).

$^{13}$C NMR (75 MHz, CDCl3): 12.90, 13.85, 14.20, 19.61, 24.75, 29.27, 31.98, 41.93, 43.09, 43.29, 51.70, 53.82, 60.28, 108.75, 113.16, 114.43, 125.29, 129.05, 129.74, 135.00, 137.59, 147.02, 147.43, 149.18, 159.25, 173.44.

intermediate I14

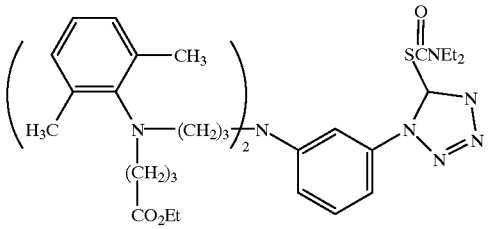

$^1$H NMR (300 MHz, $CDCl_3$): 1.05–1.30 (m, 12 H), 1.65 (m, 4H), 1.75 (m, 4H), 2.35 (m, 16H), 2.95–3.15 (m, 12H), 3.30 (q, 4H), 4.10 (q, 4H), 6.48 (m, 1H), 6.55 (m, 1H), 6.70 (m, 1H), 6.95 (m, 6H), 7.18 (t, 1H).

$^{13}$C NMR (75MHz, CDCl3): 12.91, 13.84, 14.20, 19.64, 24.55, 26.69, 32.03, 43.13, 43.21, 49.00, 51.22, 53.87, 60.25, 108.28, 111.64, 113.15, 125.21, 129.07, 129.72, 135.06, 137.45, 147.06, 147.16, 148.60, 159.30, 173.35.

21. Preparation of compound 111

A mixture of intermediate I13 (1.21 g, 2.13 mmol), sodium hydroxide (0.17 g, 4.26 mmol), ethanol (4 mL) and water (8 mL) was stirred at reflux for 48 h, then at 25 C for 96 h. The reaction mixture was filtered to remove a small quantity of insolubles and the filtrate concentrated in vacuo at 80° C. The concentrate was dissolved in methanol and filtered again to remove a small quantity of insolubles. The methanol filtrate was subjected to flash chromatography (silica gel/methanol). The product containing fraction was concentrated in vacuo to give compound 111 sodium salt (1.0 g).

$^1$H NMR (300 MHz, D20): 1.70 (bm, 4H), 2.19 (bt, 2H), 2.33 (bs, 6H), 3.08 (bt, 2H), 3.20 (bs, 1H), 3.30 (bt, 2H), 3.40 (bt, 2H), 4.75 (HOD), 6.65 (bd, 1H), 6.77 (bd, 1H), 6.87 (bd, 1H), 7.05 (bs, 3H), 7.30 (bt, 1H).

Mass Spectrum: ES+ (441+), ES− (439−) were the most intense ions observed.

22. Preparation of compound 112.

A mixture of the intermediate I14 (0.85 g, 1 mmol), sodium hydroxide (0.12 g, 3 mmol), ethanol (4 mL) and water (8 mL) was stirred at reflux for 60 h. The reaction mixture was concentrated in vacuo to an oil. The oil was partitioned between ethyl ether and water. The ether layer was discarded and the water layer concentrated in vacuo at 50° C. The concentrate was stirred with acetonitrile to give a gummy solid. The acetonitrile was decanted and the remaining gummy solid dissolved in methanol. The methanol was removed in vacuo to give compound 112 dicarboxylate salt (0.57 g).

$^1$H NMR (300 MHz, $D_2O$): 1.42 (bm, 4H), 1.63 (bm, 4H), 2.12 (bt, 4H), 2.16 (s, 12H), 2.90 (bm, 12H), 6.40 (bd, 1H), 6.55 (bs, 1H), 6.67 (bd, 1H), 6.90 (bm, 6H), 7.13 (bt, 1H).

$^{13}$C NMR (75 MHz, $D_2O$): 24.46, 30.61, 31.12, 40.74, 54.04, 55.57, 59.17, 114.09, 117.10, 118.11, 130.38, 134.27, 135.06, 142.88, 143.05, 152.23, 153.67, 170.82, 188.47.

The following examples illustrate the beneficial use of deprotonating electron donors in silver halide emulsions.

EXAMPLE 1

An AgBrI tabular silver halide emulsion (Emulsion T-1) was prepared containing 4.05% total I distributed such that the central portion of the emulsion grains contained 1.5% I and the perimeter area contained substantially higher I as described by Chang et. al., U.S. Pat. No. 5,314,793. The emulsion grains had an average thickness of 0.112 $\mu$m and average circular diameter of 1.25 $\mu$m. Emulsion T-1 was precipitated using deionized gelatin. The emulsion was sulfur sensitized by adding 1,3-dicarboxymethyl-1,3-dimethyl-2-thiourea at 40° C.; the temperature was then raised to 60° C. at a rate of 5° C./3 min and the emulsions held for 20 min before cooling to 40° C. The amount of the sulfur sensitizing compound used was $8.5\times10^{-6}$ mole/mole Ag. The chemically sensitized emulsion was then used to prepare the experimental coating variations indicated in Example Table I.

The deprotonating electron donating (DPED) sensitizer compounds were dissolved in water and added to the emulsion at the relative concentrations indicated in Example Table I. At the time of DPED sensitizer addition, the emulsion melts had a VAg of 85–90 mV and a pH of 6.0. Additional water, gelatin, and surfactant were then added to the emulsion melts to give a final emulsion melt that contained 216 grams of gel per mole of silver. These emulsion melts were coated onto an acetate film base at 1.61 g/m$^2$ of Ag with gelatin at 3.22 g/m$^2$. The coatings were prepared with a protective overcoat which contained gelatin at 1.08 g/m$^2$, coating surfactants, and a bisvinylsulfonylmethyl ether as a gelatin hardening agent.

For photographic evaluation, each of the coating strips was exposed for 0.1 sec to a 365 nm emission line of a Hg lamp filtered through a Kodak Wratten filter number 18A and a step wedge ranging in density from 0 to 4 density units in 0.2 density steps. The exposed film strips were developed for 6 min in Kodak Rapid X-ray Developer (KRX). $S_{365}$, relative sensitivity at 365 nm, was evaluated at a density of 0.15 units above fog.

The data in Example Table I compare the photographic sensitivities for an undyed emulsion containing the deprotonating electron donating sensitizer compounds 4, 5, 6, and 7. For this exposure, relative sensitivity was set equal to 100 for the control emulsion coating with no deprotonating electron donating sensitizer agent added (test no. 1). Improved sensitivity for the 365 nm exposure was shown for the examples which contained the deprotonating electron donating sensitizing agents and the sensitivity improvement increased as the compound concentration was increased. The data in Example Table I show that sensitivity increases up to a factor of 1.8 relative to the control could be obtained with these inventive compounds. These sensitivity increases were obtained without any increases in fog in this undyed, sulfur sensitized emulsion.

EXAMPLE TABLE I

Speed and fog results for DPED compounds on Emulsion T-1

| Test No. | Compound | Amount of DPED Compound added ($10^{-3}$ mol/mol Ag) | Photographic Sensitivity $S_{365}$ | Fog | Remarks |
|---|---|---|---|---|---|
| 1 | none | 0.00 | 100 | 0.045 | control |
| 2 | 6 | 1.4 | 98 | 0.045 | invention |
| 3 | 6 | 4.4 | 114 | 0.045 | invention |
| 4 | 6 | 44 | 182 | 0.045 | invention |
| 5 | 4 | 1.4 | 94 | 0.045 | invention |
| 6 | 4 | 4.4 | 100 | 0.045 | invention |
| 7 | 4 | 44 | 141 | 0.045 | invention |
| 8 | 7 | 1.4 | 122 | 0.045 | invention |
| 9 | 7 | 4.4 | 143 | 0.045 | invention |
| 10 | 7 | 44 | 184 | 0.045 | invention |
| 11 | 5 | 1.4 | 104 | 0.045 | invention |
| 12 | 5 | 4.4 | 117 | 0.045 | invention |
| 13 | 5 | 44 | 158 | 0.045 | invention |

EXAMPLE 2

The sulfur sensitized AgBrI tabular emulsion T-1 described in Example I was used to prepare the experimental coating variations listed in Example Table II. In this table, various deprotonating two-electron donors having a covalently attached base capable of abstracting the leaving hydrogen atom are compared to structurally related compounds that do not contain such a base. The inventive and comparison compounds were added to the emulsion, and coatings prepared and tested as described in Example 1.

The compounds 4 and 6 in Example Table II are X—H compounds having one electron oxidation potentials $E_{ox1}$ that are less positive than 1.4 V. Upon oxidation, these compounds undergo a reaction in which a proton on one of the two aliphatic carbons adjacent to the aniline nitrogen reacts with a covalently attached carboxylate base to give the radical $X^{\bullet}$ and the protonated base, and the radical $X^{\bullet}$ has an oxidation potential equal to or more negative than −0.7 V. For the 365 nm exposure, the data of Example Table II illustrates that these deprotonating two-electron donor compounds 4 and 6 gave large sensitivity increases, of a factor of greater than 1.5. These sensitivity gains could be obtained with no increase in fog levels. In contrast, the comparison compound COMP 1, in which the covalently attached carboxylate base is situated in a position where it cannot abstract a proton from the carbon atoms adjacent to the aniline nitrogen, gave very little or no sensitivity increase. Likewise, the related compound COMP-2, which has no covalently attached base, also gave only very small sensitivity increases.

EXAMPLE TABLE II

Results for Inventive and Comparison Compounds on Emulsion T-1

| Test No. | Compound | Amount of Compound added ($10^{-3}$ mol/mol Ag) | Photographic Sensitivity $S_{365}$ | Fog | Remarks |
|---|---|---|---|---|---|
| 1 | none | 0.00 | 100 | 0.05 | control |
| 2 | COMP 1 | 14 | 110 | 0.05 | comparison |
| 3 | COMP 1 | 44 | 95 | 0.05 | comparison |
| 4 | COMP 2 | 14 | 105 | 0.05 | comparison |
| 5 | COMP 2 | 44 | 105 | 0.05 | comparison |
| 6 | 6 | 44 | 155 | 0.05 | invention |
| 7 | 4 | 44 | 151 | 0.05 | invention |

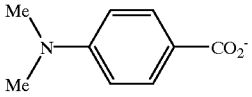

COMP1

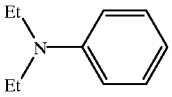

COMP 2

EXAMPLE 3

The sulfur sensitized AgBrI tabular emulsion T-1 as described in Example 1 was used to prepare coatings containing the deprotonating electron-donating sensitizing agent compound 7 without sensitizing dye and in combination with blue spectral sensitizing dye D-I, green spectral sensitizing dye D-II, or red spectral sensitizing dye D-III, as listed in Example Table III. The sensitizing dyes were added to the emulsion at 40° C., followed by the deprotonating electron donating compound and the coatings were prepared as described in Example 1.

$S_{365}$, relative sensitivity at 365 nm, was evaluated as described in Example 1. Relative sensitivity for this exposure was set equal to 100 for the control emulsion coating with no dye and no deprotonating electron donating sensitizer agent added (test no. 1). Additional testing was carried out to determine the response of the coatings described in Example Table III to a spectral exposure. Each of the coating strips was exposed for 0.1 sec on a wedge spectrographic instrument that covers the wavelength range from 400 to 750 nm. The instrument contains a tungsten light source and a step tablet ranging in density from 0 to 3 density units in 0.3 density steps. After developing exposed strips for 6 min in Kodak Rapid X-ray Developer (KRX), speed was read at 10 nm wavelength intervals at a density of 0.3 above fog. Correction for the instrument's variation in spectral irradiance with wavelength was done with a computer and a plot of log sensitivity vs. wavelength was generated. The relative sensitivity $S_{\lambda}$ at the wavelength of maximum spectral sensitivity is reported in Example Table III. For this exposure, for each dye used, the relative sensitivity was set equal to 100 for the control coating with no deprotonating two-electron donor compound added.

The data in Example Table III compare the photographic sensitivities for combinations of the deprotonating electron donating sensitizer compound 7 with the undyed or the blue, green or red dyed emulsion T-1. For the undyed or blue dyed emulsion, the addition of compound 7 increased the photographic sensitivity of the emulsion at 365 nm by a factor of approximately 1.5. The addition of green or red sensitizing dyes D-II or D-III caused some sensitivity decrease for the 365 nm exposure relative to the undyed control (tests nos. 5 and 7) due to desensitization. Addition of compound 7 to these dyed coatings gave some improvement in this desensitization (test nos. 6 and 8). For the spectral sensitivity as measured with the WR2B exposure, addition of compound 7 to the blue sensitized emulsion gave a factor of 1.4 increase in spectral sensitivity. For the green or red sensitized emulsion, the increase in spectral sensitivity on addition of compound 7 was smaller, about a factor of 1.1. The data in Example Table III show that this deprotonating electron donating compound is able to give sensitivity increases in both dyed and undyed emulsions and that the sensitivity increases are observed for exposures in the region of intrinsic silver halide absorption as well as in the region of dye absorption. All of these sensitivity increases were achieved with essentially no increase in fog.

EXAMPLE TABLE III

Speed and Fog Results for DPED Compound 7 with Undyed and Dyed Emulsion T-1

| Test No. | Compound | Amount of Compound added ($10^{-3}$ mol/mol Ag) | Sens Dye | Amount of Sens. Dye ($10^{-3}$ mol/mol Ag) | Photographic Sensitivity $S_{365}$ | $S_{\lambda max}$ | Fog | Remarks |
|---|---|---|---|---|---|---|---|---|
| 1 | none | 0 | none | 0.00 | 100 | — | 0.04 | comparison |
| 2 | 7 | 4.4 | none | 0.00 | 155 | — | 0.04 | invention |
| 3 | none | 0 | D-I | 0.91 | 117 | 100 | 0.04 | comparision |
| 4 | 7 | 4.4 | D-I | 0.91 | 166 | 135 | 0.05 | invention |
| 5 | none | 0 | D-II | 0.86 | 78 | 100 | 0.07 | comparison |
| 6 | 7 | 4.4 | D-II | 0.86 | 85 | 112 | 0.07 | invention |
| 7 | none | 0 | D-III | 0.86 | 62 | 100 | 0.09 | comparison |
| 8 | 7 | 4.4 | D-III | 0.86 | 69 | 105 | 0.09 | invention |

D-I

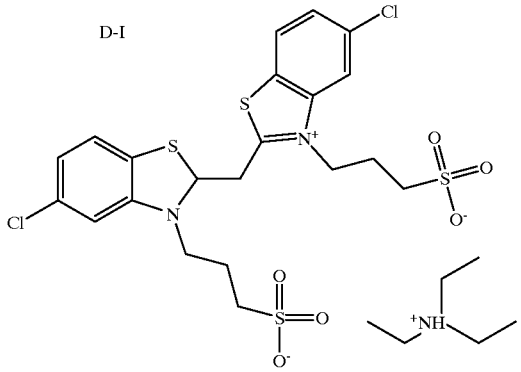

D-II

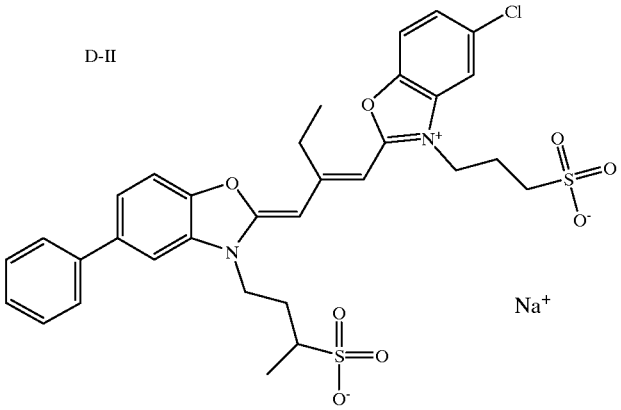

EXAMPLE TABLE III-continued

Speed and Fog Results for DPED Compound 7 with Undyed and Dyed Emulsion T-1

| Test No. | Compound | Amount of Compound added ($10^{-3}$ mol/mol Ag) | Sens Dye | Amount of Sens. Dye ($10^{-3}$ mol/mol Ag) | Photographic Sensitivity $S_{365}$ | $S_{\lambda max}$ | Fog | Remarks |
|---|---|---|---|---|---|---|---|---|

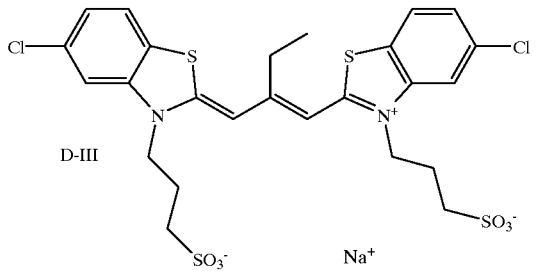

D-III

EXAMPLE 4

An AgBrI tabular silver halide emulsion (Emulsion T-2) was prepared containing 4.05% total I distributed such that the central portion of the emulsion grains contained 1.5% I and the perimeter area contained substantially higher I as described by Chang et. al., U.S. Pat. No. 5,314,793. The emulsion grains had an average thickness of 0.103 $\mu$m and average circular diameter of 1.25 $\mu$m. Emulsion T-2 was precipitated using deionized gelatin. The emulsion was sulfur sensitized by adding 1,3-dicarboxymethyl-1,3-dimethyl-2-thiourea at 40° C.; the temperature was then raised to 60° C. at a rate of 5° C./3 min and the emulsions held for 20 min before cooling to 40° C. The amount of the sulfur sensitizing compound used was $8.5\times10^{-6}$ mole/mole Ag. This sulfur sensitized emulsion T-2 was then used to prepare coatings containing various deprotonating electron-donating sensitizing agents in combination with blue spectral sensitizing dye D-I or green spectral sensitizing dye D-II as listed in Example Table IV. The sensitizing dyes were added to the emulsion at 40° C., followed by the deprotonating electron donating compounds and the coatings were prepared as described in Example 1.

$S_{365}$, relative sensitivity at 365 nm, was evaluated as described in Example 1. For each dye, relative sensitivity for this exposure was set equal to 100 for the control emulsion coating with no deprotonating electron donating sensitizer agent added (test nos. 1 and 8).

The data in Example Table IV compare the sensitivity increases obtained when compounds 1, 4 or 43 are added to the blue or green dyed emulsion T-2. Compounds 1 and 4 are deprotonating electron donating sensitizers of general structure II with propionate groups attached to the aniline nitrogen and no substituents ortho to the aniline nitrogen. Compound 43 is a deprotonating electron donating sensitizer with a propionate group attached to the aniline nitrogen and with methyl groups in both positions ortho to the aniline nitrogen. The data in Example Table IV shows that all three compounds give good speed increases for the blue dyed emulsion, up to a factor of 1.6 to 1.7 increase in $S_{365}$ at optimum concentration. For the green dyed emulsion, increases in speed with compounds 1 and 4 are very small but a factor of 1.3 increase in $S_{365}$ is obtained with compound 43. This result illustrates the particularly advantageous effect of ortho substitution on the phenyl ring of the aniline moiety in providing deprotonating electron donating sensitizers of general structure II that are useful with both blue and green dyed emulsions.

EXAMPLE TABLE IV

Speed and Fog Results for Various Deprotonating Electron Donor Compounds with Emulsion T-2

| Test No. | Compound | Amount of Compound added ($10^{-3}$ mol/mol Ag) | Type of Sens. Dye | Amount of Sens. Dye ($10^{-3}$ mol/mol Ag) | Photographic Sensitivity $S_{365}$ | Fog | Remarks |
|---|---|---|---|---|---|---|---|
| 1 | none | 0 | D-I | 0.91 | 100 | 0.05 | comparison |
| 2 | 1 | 4.4 | D-I | 0.91 | 174 | 0.05 | invention |
| 3 | 1 | 44 | D-I | 0.91 | 166 | 0.05 | invention |
| 4 | 4 | 4.4 | D-I | 0.91 | 126 | 0.05 | invention |
| 5 | 4 | 44 | D-I | 0.91 | 155 | 0.05 | invention |
| 6 | 43 | 4.4 | D-I | 0.91 | 158 | 0.05 | invention |
| 7 | 43 | 44 | D-I | 0.91 | 174 | 0.05 | invention |
| 8 | none | 0 | D-II | 0.86 | 100 | 0.07 | comparison |
| 9 | 1 | 4.4 | D-II | 0.86 | 98 | 0.07 | invention |
| 10 | 1 | 44 | D-II | 0.86 | 105 | 0.07 | invention |

EXAMPLE TABLE IV-continued

Speed and Fog Results for Various Deprotonating Electron Donor Compounds with Emulsion T-2

| Test No. | Compound | Amount of Compound added ($10^{-3}$ mol/mol Ag) | Type of Sens. Dye | Amount of Sens. Dye ($10^{-3}$ mol/mol Ag) | Photographic Sensitivity $S_{365}$ | Fog | Remarks |
|---|---|---|---|---|---|---|---|
| 11 | 4 | 4.4 | D-II | 0.86 | 100 | 0.07 | invention |
| 12 | 4 | 44 | D-II | 0.86 | 98 | 0.07 | invention |
| 13 | 43 | 4.4 | D-II | 0.86 | 129 | 0.07 | invention |
| 14 | 43 | 44 | D-II | 0.86 | 122 | 0.09 | invention |

EXAMPLE 5

The sulfur sensitized AgBrI tabular emulsion T-2 as described in Example 4 was used to prepare coatings containing various deprotonating electron-donating sensitizing agents in combination with blue spectral sensitizing dye D-I or green spectral sensitizing dye D-II, as listed in Example Table V. The sensitizing dyes were added to the emulsion at 40° C., followed by the deprotonating electron donating compounds and the coatings were prepared as described in Example 1.

$S_{365}$, relative sensitivity at 365 nm, was evaluated as described in Example 1. For each dye, relative sensitivity for this exposure was set equal to 100 for the control emulsion coating with no deprotonating electron donating sensitizer agent added (test nos. 1 and 12).

The data in Example Table V compare the sensitivity increases obtained when compounds 43, 44, 45, 46, or 47 are added to the blue or green dyed emulsion T-2. This series of deprotonating electron donating compounds X—H are all tertiary anilines with ortho dimethyl substituents on the phenyl ring of the aniline moiety. The only structural difference in the series is the length of the methylene chain between the aniline nitrogen and the carboxylate base, which varies from 2 methylene carbons in Compound 43 to 6 methylene carbons in Compound 47. Consequently, this series of compounds all have oxidation potentials $E_{ox1}$ which are closely similar. However, the chain length variation causes large differences in the rate of the deprotonation reaction undergone by the oxidized form of X—H. The rate of this reaction decreases as chain length increases beyond 3 methylene carbons. The data in Example Table V show that, within this closely related structural series, the compounds with the fastest deprotonation rates are more active than the compounds with the slowest deprotonation rates in the sense that the more active compounds gave more speed at lower concentrations than the less active compounds. This can be seen by comparing, for example, the data for compound 44 with the data for compound 47. For the blue dyed emulsion, compound 44 gave a factor of 1.7 increase in sensitivity at a concentration of $4.4\times10^{-3}$ mole/mole Ag while compound 47 gave only a factor of 1.3 increase (test no. 4 vs. test no. 10). For the green dyed emulsion, compound 44 gave a factor of 1.6 increase in sensitivity at a concentration of $4.4\times10^{-3}$ mole/mole Ag while compound 47 gave a factor of only 1.1 increase at this concentration (test no. 15 vs. test no. 21). Nevertheless, Example Table V also shows that all the compounds in this series can give useful speed increases with the blue and the green dyed emulsion and that concentrations can be found where these speed increases occur with little or no fog increase.

EXAMPLE TABLE V

Speed and Fog Results for Tertiary Aniline DPED Compounds with Emulsion T-2

| Test No. | Compound | $E_{ox1}$ (V) | $k_{dp}$ ($s^{-1}$) | $E_{ox2}$ (V) | Amount of Comp'd added ($10^{-3}$ mol/mol Ag | Sens. Dye | Amount of Sens. Dye ($10^{-3}$ mol/mol Ag) | Photographic Sensitivity $S_{365}$ | Fog | Remarks |
|---|---|---|---|---|---|---|---|---|---|---|
| 1 | none | — | — | — | 0 | D-I | 0.91 | 100 | 0.04 | comparison |
| 2 | 43 | 0.71 | $1.8\times10^{6}$ | <−0.9 | 4.4 | D-I | 0.91 | 145 | 0.05 | invention |
| 3 | 43 | " | " | " | 44 | D-I | 0.91 | 174 | 0.08 | invention |
| 4 | 44 | 0.67 | $\sim1\times10^{8}$ | <−0.9 | 4.4 | D-I | 0.91 | 166 | 0.05 | invention |
| 5 | 44 | " | " | " | 44 | D-I | 0.91 | 176 | 0.09 | invention |
| 6 | 45 | 0.69 | $1.3\times10^{7}$ | <−0.9 | 4.4 | D-I | 0.91 | 151 | 0.05 | invention |
| 7 | 45 | " | " | " | 44 | D-I | 0.91 | 174 | 0.09 | invention |
| 8 | 46 | 0.71 | $1.4\times10^{6}$ | <−0.9 | 4.4 | D-I | 0.91 | 138 | 0.05 | invention |
| 9 | 46 | " | " | " | 44 | D-I | 0.91 | 166 | 0.08 | invention |
| 10 | 47 | 0.75 | $2.3\times10^{5}$ | <−0.9 | 4.4 | D-I | 0.91 | 126 | 0.03 | invention |
| 11 | 47 | " | " | " | 44 | D-I | 0.91 | 151 | 0.06 | invention |
| 12 | none | — | — | — | 0 | D-II | 0.86 | 100 | 0.06 | comparison |
| 13 | 43 | 0.71 | $1.8\times10^{6}$ | <−0.9 | 4.4 | D-II | 0.86 | 117 | 0.08 | invention |
| 14 | 43 | " | " | " | 44 | D-II | 0.86 | 135 | 0.10 | invention |
| 15 | 44 | 0.67 | $\sim1\times10^{8}$ | <−0.9 | 4.4 | D-II | 0.86 | 157 | 0.09 | invention |
| 16 | 44 | " | " | " | 44 | D-II | 0.86 | 176 | 0.21 | invention |
| 17 | 45 | 0.69 | $1.3\times10^{7}$ | <−0.9 | 4.4 | D-II | 0.86 | 132 | 0.06 | invention |

EXAMPLE TABLE V-continued

Speed and Fog Results for Tertiary Aniline DPED Compounds with Emulsion T-2

| Test No. | Compound | $E_{ox1}$ (V) | $k_{dp}$ ($s^{-1}$) | $E_{ox2}$ (V) | Amount of Comp'd added ($10^{-3}$ mol/mol Ag) | Sens. Dye | Amount of Sens. Dye ($10^{-3}$ mol/mol Ag) | Photographic Sensitivity $S_{365}$ | Fog | Remarks |
|---|---|---|---|---|---|---|---|---|---|---|
| 18 | 45 | " | " | " | 44 | D-II | 0.86 | 148 | 0.13 | invention |
| 19 | 46 | 0.71 | $1.4 \times 10^6$ | <−0.9 | 4.4 | D-II | 0.86 | 112 | 0.06 | invention |
| 20 | 46 | " | " | " | 44 | D-II | 0.86 | 117 | 0.09 | invention |
| 21 | 47 | 0.75 | $2.3 \times 10^5$ | <−0.9 | 4.4 | D-II | 0.86 | 107 | 0.05 | invention |
| 22 | 47 | " | " | " | 44 | D-II | 0.86 | 105 | 0.07 | invention |

EXAMPLE 6

The sulfur sensitized AgBrI tabular emulsion T-2 as described in Example 4 was used to prepare coatings containing various deprotonating electron-donating sensitizing agents in combination with blue spectral sensitizing dye D-I or green spectral sensitizing dye D-I, as listed in Example Table VI. The sensitizing dyes were added to the emulsion at 40° C., followed by the deprotonating electron donating compounds and the coatings were prepared as described in Example 1.

$S_{365}$, relative sensitivity at 365 nm, was evaluated as described in Example 1. For each dye, relative sensitivity for this exposure was set equal to 100 for the control emulsion coating with no deprotonating electron donating sensitizer agent added (test nos. 1 and 10).

The data in Example Table VI compare the sensitivity increases obtained when compounds 57, 58, 59, or 60 are added to the blue or green dyed emulsion T-2. This series of deprotonating electron donating compounds X—H are all secondary anilines with ortho dimethyl substituents on the phenyl ring of the aniline moiety. The only structural difference in the series is the length of the methylene chain between the aniline nitrogen and the carboxylate base, which varies from 3 methylene carbons in compound 57 to 6 methylene carbons in compound 60. The data in Example Table VI show that the activity of the compounds decreases as this methylene chain length increases. This can be seen by comparing, for example, the data for compound 57 with the data for compound 60. For the blue dyed emulsion, compound 57 gave a factor of 1.8 increase in sensitivity at a concentration of $44\times10^{-3}$ mole/mole Ag while compound 60 gave only a factor of 1.2 increase (test no. 3 vs. test no. 9). For the green dyed emulsion, compound 57 gave a factor of 1.1 increase in sensitivity at a concentration of $44\times10^{-3}$ mole/mole Ag while compound 60 gave no increase in sensitivity at this concentration. In general, the data in Example Table VI show that all of the compounds in the series gave useful speed increases in this blue dyed tabular grain emulsion with little or no increase in fog. The data also show that the more active members of the series can give useful speed increases in the green dyed tabular emulsion as well.

EXAMPLE TABLE VI

Speed and Fog Results for Secondary Aniline DPED Compounds with Emulsion T-2

| Test No. | Compound | Amount of Compound added ($10^{-3}$ mol/mol Ag) | Sens. Dye | Amount of Sensitizing Dye ($10^{-3}$ mol/mol Ag) | Photographic Sensitivity $S_{365}$ | Fog | Remarks |
|---|---|---|---|---|---|---|---|
| 1 | none | 0 | D-I | 0.91 | 100 | 0.04 | comparison |
| 2 | 57 | 4.4 | D-I | 0.91 | 166 | 0.04 | invention |
| 3 | 57 | 44 | D-I | 0.91 | 176 | 0.09 | invention |
| 4 | 58 | 4.4 | D-I | 0.91 | 162 | 0.04 | invention |
| 5 | 58 | 44 | D-I | 0.91 | 170 | 0.09 | invention |
| 6 | 59 | 4.4 | D-I | 0.91 | 123 | 0.03 | invention |
| 7 | 59 | 44 | D-I | 0.91 | 145 | 0.06 | invention |
| 8 | 60 | 4.4 | D-I | 0.91 | 100 | 0.03 | invention |
| 9 | 60 | 44 | D-I | 0.91 | 123 | 0.04 | invention |
| 10 | none | 0 | D-II | 0.86 | 100 | 0.06 | compaiison |
| 11 | 57 | 44 | D-II | 0.86 | 107 | 0.06 | invention |
| 12 | 58 | 44 | D-II | 0.86 | 89 | 0.05 | invention |
| 13 | 59 | 44 | D-II | 0.86 | 83 | 0.05 | invention |
| 14 | 60 | 44 | D-II | 0.86 | 83 | 0.05 | invention |

EXAMPLE 7

The sulfur sensitized AgBrI tabular emulsion T-2 as described in Example 4 was used to prepare coatings containing various deprotonating electron-donating sensitizing agent in combination with blue spectral sensitizing dye D-I or green spectral sensitizing dye D-II, as listed in Example Table VII. The sensitizing dyes were added to the emulsion at 40° C., followed by the deprotonating electron donating compounds and the coatings were prepared as described in Example 1.

$S_{365}$, relative sensitivity at 365 nm, was evaluated as described in Example 1. For each dye, relative sensitivity for this exposure was set equal to 100 for the control emulsion coating with no deprotonating electron donating sensitizer agent added (test nos. 1 and 14).

The data in Example Table VI compare the sensitivity increases obtained when compounds 9, 10, 11, 12, 37, or 38 are added to the blue or green dyed emulsion T-2. Compounds 9, 10, 11, and 12 in this series of deprotonating electron donating compounds X—H are all tertiary anilines with a 3 carbon methylene chain between the aniline nitrogen and the carboxylate base. The only structural difference in the series is the identity of the ortho substituent on the phenyl ring of the aniline moiety, which varies from methyl to tertiary butyl through the series. This variation causes some increase in the oxidation potential $E_{ox1}$ of the X—H compound as the number of carbons in the ortho substituent increases. Nevertheless, all these compounds give radicals $X^{\bullet}$ with oxidation potentials $E_{ox2}$ that are more negative than −0.9 V. The data in Example Table VII show that all of these tertiary aniline compounds gave useful speed increases with the blue and green dyed emulsions and that these speed increases can be obtained with little or no increase in fog on this sulfur sensitized tabular emulsion. Compounds 37 and 38 are deprotonating electron donating compounds X—H that are the secondary aniline analogs of compounds 11 and 12 respectively. These compounds give radicals $X^{\bullet}$ with oxidation potentials $E_{ox2}$ that are less negative than 0.45 V. The data in Example Table VII shows that these secondary aniline compounds give useful speed increases in the blue dyed emulsion with no increase in fog. In the green dyed emulsion, small speed increases can also be obtained with these secondary aniline compounds, but the concentration of the compound used needs to be carefully chosen.

EXAMPLE TABLE VII

Speed and Fog Results for Various Tertiary and Secondary Aniline DPED Compounds with Emulsion T-2

| Test No. | Compd | $E_{ox1}$ (V) | $E_{ox2}$ (V) | Amount of Compound added ($10^{-3}$ mol/mol Ag | Sens. Dye | Amount of Sens. Dye ($10^{-3}$ mol/mol Ag | Photographic Sensitivity $S_{365}$ | Fog | Remarks |
|---|---|---|---|---|---|---|---|---|---|
| 1 | none | — | — | 0 | D-I | 0.91 | 100 | 0.04 | comparison |
| 2 | 9 | 0.695 | <−0.9 | 4.4 | D-I | 0.91 | 162 | 0.05 | invention |
| 3 | 9 | " | " | 44 | D-I | 0.91 | 191 | 0.08 | invention |
| 4 | 10 | 0.70 | <−0.9 | 4.4 | D-I | 0.91 | 166 | 0.05 | invention |
| 5 | 10 | " | " | 44 | D-I | 0.91 | 182 | 0.10 | invention |
| 6 | 11 | 0.715 | <−0.9 | 4.4 | D-I | 0.91 | 129 | 0.04 | invention |
| 7 | 11 | " | " | 44 | D-I | 0.91 | 170 | 0.04 | invention |
| 8 | 12 | 0.760 | <−0.9 | 4.4 | D-I | 0.91 | 132 | 0.05 | invention |
| 9 | 12 | " | " | 44 | D-I | 0.91 | 164 | 0.O5 | invention |
| 10 | 37 | 0.625 | >−0.45 | 4.4 | D-I | 0.91 | 126 | 0.04 | invention |
| 11 | 37 | " | " | 44 | D-I | 0.91 | 135 | 0.04 | invention |
| 12 | 38 | 0.625 | >−0.45 | 4.4 | D-I | 0.91 | 117 | 0.04 | invention |
| 13 | 38 | " | " | 44 | D-I | 0.91 | 138 | 0.04 | invention |
| 14 | none | — | — | 0 | D-II | 0.86 | 100 | 0.08 | comparison |
| 15 | 9 | 0.695 | <−0.9 | 4.4 | D-II | 0.86 | 122 | 0.08 | invention |
| 16 | 9 | " | " | 44 | D-II | 0.86 | 123 | 0.08 | invention |
| 17 | 10 | 0.70 | <−0.9 | 4.4 | D-II | 0.86 | 110 | 0.08 | invention |
| 18 | 10 | " | " | 44 | D-II | 0.86 | 115 | 0.08 | invention |
| 19 | 11 | 0.715 | <−0.9 | 4.4 | D-II | 0.86 | 132 | 0.07 | invention |
| 20 | 11 | " | " | 44 | D-II | 0.86 | 132 | 0.07 | invention |
| 21 | 12 | 0.760 | <−0.9 | 4.4 | D-II | 0.86 | 117 | 0.07 | invention |
| 22 | 12 | " | " | 44 | D-II | 0.86 | 124 | 0.09 | invention |
| 23 | 37 | 0.625 | >−0.45 | 44 | D-II | 0.86 | 55 | 0.06 | invention |
| 24 | 38 | 0.625 | >−0.45 | 4.4 | D-II | 0.86 | 120 | 0.07 | invention |
| 25 | 38 | " | " | 44 | D-II | 0.86 | 87 | 0.06 | invention |

EXAMPLE 8

The sulfur sensitized AgBrI tabular emulsion T-2 as described in Example 4 was used to prepare coatings containing various deprotonating electron-donating sensitizing agents in combination with blue spectral sensitizing dye D-I, green spectral sensitizing dye D-II, or red sensitizing dye D-III as listed in Example Table VIII. The sensitizing dyes were added to the emulsion at 40° C., followed by the deprotonating electron donating compounds and the coatings were prepared as described in Example 1.

$S_{365}$, relative sensitivity at 365 nm, was evaluated as described in Example 1. For each dye, relative sensitivity for this exposure was set equal to 100 for the control emulsion coating with no deprotonating electron donating sensitizer agent added (test nos. 1, 6 and 11). Additional testing was carried out to determine the response of the coatings described in Example Table VIII to a spectral exposure as described in Example 3. The relative sensitivity $S_{\lambda}$ at the wavelength of maximum spectral sensitivity for each coating is reported in Example Table VIII. For this exposure, for each dye used, the relative sensitivity was set equal to 100 for the control coating with no deprotonating two-electron donor compound added.

The data in Example Table VIII compare the sensitivity increases obtained when compounds 9, 12, 44, or 46 are added to the blue, green or red dyed emulsion T-2. Compounds 9 and 12 are active and less active tertiary aniline deprotonating electron donor compounds from the series in Example VII. These compounds have a single ortho substituent on the phenyl ring of the aniline moiety. Compounds 44 and 46 are active and less active tertiary aniline deprotonating electron donor compounds from the series in Example V. These compounds have methyl substituents on both ortho positions of the phenyl ring of the aniline moiety. The data in Example Table VIII show that there is an activity advantage for the ortho dimethyl substituted compounds: the active ortho dimethyl substituted compound 44 gave more speed at lower concentration than the active ortho methyl substituted compound 9. (Compare tests 4 vs. 2, 9 vs. 7, and 14 vs. 12.) Similarly, the less active ortho dimethyl substituted compound 46 gave more speed at lower concentration than the less active ortho t-butyl substituted compound 12. (Compare tests 5 vs. 3, 10 vs. 8, and 15 vs. 13). However, Example Table VIII also shows that all the four of these compounds can give useful speed increases with the blue, green, and red dyed emulsions. These speed increases were observed for exposures in the region of intrinsic silver halide absorption as well as in the region of dye absorption and can be obtained with little or no fog increase.

EXAMPLE TABLE VIII

Speed and Fog Results for DPED Compounds with Blue, Green and Red Sensitizing Dyes on Emulsion T-2

| Test No. | Comp'd | Amount of Compound added ($10^{-3}$ mol/mol Ag) | Sens. Dye | Amount of Sens. Dye ($10^{-3}$ mol/mol Ag) | Photographic Sensitiviyt $S_{365}$ | $S_{\lambda max}$ | Fog | Remarks |
|---|---|---|---|---|---|---|---|---|
| 1 | none | 0 | D-I | 0.91 | 100 | 100 | 0.04 | comparison |
| 2 | 9 | 44 | D-I | 0.91 | 182 | 170 | 0.08 | invention |
| 3 | 12 | 44 | D-I | 0.91 | 148 | 141 | 0.05 | invention |
| 4 | 44 | 4.4 | D-I | 0.91 | 186 | 170 | 0.05 | invention |
| 5 | 46 | 4.4 | D-I | 0.91 | 151 | 148 | 0.05 | invention |
| 6 | none | 0 | D-II | 0.86 | 100 | 100 | 0.06 | comparison |
| 7 | 9 | 44 | D-II | 0.86 | 112 | 112 | 0.06 | invention |
| 8 | 12 | 44 | D-II | 0.86 | 107 | 107 | 0.07 | invention |
| 9 | 44 | 4.4 | D-II | 0.86 | 151 | 148 | 0.08 | invention |
| 10 | 46 | 4.4 | D-II | 0.86 | 115 | 117 | 0.07 | invention |
| 11 | none | 0 | D-III | 0.86 | 100 | 100 | 0.09 | comparison |
| 12 | 9 | 44 | D-III | 0.86 | 110 | 102 | 0.10 | invention |
| 13 | 12 | 44 | D-III | 0.86 | 112 | 102 | 0.09 | invention |
| 14 | 44 | 4.4 | D-III | 0.86 | 151 | 141 | 0.12 | invention |
| 15 | 46 | 4.4 | D-III | 0.86 | 115 | 112 | 0.10 | invention |

EXAMPLE 9

The sulfur sensitized AgBrI tabular emulsion T-2 as described in Example 4 was used to prepare coatings containing various deprotonating electron-donating sensitizing agents in combination with blue spectral sensitizing dye D-I, or green spectral sensitizing dye D-II as listed in Example Table IX. The sensitizing dyes were added to the emulsion at 40° C., followed by the deprotonating electron donating compounds and the coatings were prepared as described in Example 1.

$S_{365}$, relative sensitivity at 365 nm, was evaluated as described in Example 1. For each dye, relative sensitivity for this exposure was set equal to 100 for the control emulsion coating with no deprotonating electron donating sensitizer agent added (test nos. 1 and 6).

The data in Example Table IX compare the sensitivity increases obtained when compounds 13, 25, or 28 are added to the blue or green dyed emulsion T-2. Compounds 13 and 25 are tertiary aniline deprotonating electron donor compounds having a single ortho substituent on the phenyl ring of the aniline moiety. In contrast to the compound series examined in Example 7, this ortho substituent is not an alkyl group but rather a phenyl ring (in Compound 13) or a bromo substituent (in Compound 25). Compound 28 is a tertiary aniline deprotonating electron donor compound having a saturated fused ring structure attached to ortho and meta positions on the phenyl ring of the aniline moiety. The data in Example Table IX show that all three of these compounds gave useful speed increases with the blue and green dyed emulsions with little or no increase in fog. In this behavior, the compounds are similar to the analogous compounds from Example 7 with a single alkyl substituent in the ortho position of the aniline moiety.

EXAMPLE TABLE IX

Speed and Fog Results for Various DPED Compounds with Emulsion T-2

| Test No. | Compound | Amount of Compound added ($10^{-3}$ mol/mol Ag) | Sens. Dye | Amount of Sens. Dye ($10^{-3}$ mol/mol Ag) | Photographic Sensitivity $S_{365}$ | Fog | Remarks |
|---|---|---|---|---|---|---|---|
| 1 | none | 0 | D-I | 0.91 | 100 | 0.04 | comparison |
| 2 | 13 | 4.4 | D-I | 0.91 | 174 | 0.05 | invention |
| 3 | 13 | 44 | D-I | 0.91 | 182 | 0.15 | invention |
| 4 | 25 | 4.4 | D-I | 0.91 | 166 | 0.04 | invention |
| 5 | 25 | 44 | D-I | 0.91 | 182 | 0.07 | invention |
| 6 | 28 | 4.4 | D-I | 0.91 | 175 | 0.05 | invention |
| 7 | 28 | 44 | D-I | 0.91 | 191 | 0.08 | invention |
| 8 | none | 0 | D-II | 0.86 | 100 | 0.06 | comparison |
| 9 | 13 | 4.4 | D-II | 0.86 | 117 | 0.07 | invention |
| 10 | 13 | 44 | D-II | 0.86 | 112 | 0.11 | invention |
| 11 | 25 | 4.4 | D-II | 0.86 | 129 | 0.08 | invention |
| 12 | 25 | 44 | D-II | 0.86 | 132 | 0.08 | invention |
| 13 | 28 | 4.4 | D-II | 0.86 | 118 | 0.07 | invention |
| 14 | 28 | 44 | D-II | 0.86 | 110 | 0.08 | invention |

EXAMPLE 10

The sulfur sensitized AgBrI tabular emulsion T-2 as described in Example 4 was used to prepare coatings containing the deprotonating electron-donating sensitizing agent Compound 64 in combination with the blue spectral sensitizing dye D-I as listed in Example Table X. The sensitizing dye was added to the emulsion at 40° C., followed by the deprotonating electron donating compound and the coatings were prepared as described in Example 1.

$S_{365}$, relative sensitivity at 365 nm, was evaluated as described in Example 1. Relative sensitivity for this exposure was set equal to 100 for the control dyed emulsion coating with no deprotonating electron donating sensitizer agent added (test no. 1).

The data in Example Table X show the sensitivity increase that can be obtained when compound 64 is added to the blue dyed emulsion T-2. Compound 64 is a deprotonating electron donor compound of general structure I. At the lower concentration studied ($4.4\times10^{-3}$ mole/mole Ag), a factor of 1.3 sensitivity increase is obtained with only a very small increase in fog. At the higher concentration examined ($44\times10^{-3}$ mole/mole Ag), a moderate increase in fog and a slight loss of sensitivity is observed. The data illustrate the importance of choosing the appropriate concentration for obtaining an advantageous speed effect with this compound.

EXAMPLE TABLE X

Speed and Fog Results for Compound 64 with Emulsion T-2

| Test No. | Compound | Amount of Compound added ($10^{-3}$ mol/mol Ag) | Sens. Dye | Amount of Sens. Dye ($10^{-3}$ mol/mol Ag) | Photographic Sensitivity $S_{365}$ | Fog | Remarks |
|---|---|---|---|---|---|---|---|
| 1 | none | 0 | D-I | 0.91 | 100 | 0.04 | comparison |
| 2 | 64 | 4.4 | D-I | 0.91 | 129 | 0.07 | invention |
| 3 | 64 | 44 | D-I | 0.91 | 91 | 0.21 | invention |

EXAMPLE 11

The sulfur sensitized AgBrI tabular emulsion T-2 as described in Example 4 was used to prepare coatings containing various deprotonating electron-donating sensitizing agents in combination with blue spectral sensitizing dye D-I, or green spectral sensitizing dye D-II as listed in Example Table XI. The sensitizing dyes were added to the emulsion at 40° C., followed by the deprotonating electron donating compounds and the coatings were prepared as described in Example 1.

$S_{365}$, relative sensitivity at 365 nm, was evaluated as described in Example 1. For each dye, relative sensitivity for this exposure was set equal to 100 for the control emulsion coating with no deprotonating electron donating sensitizer agent added (test nos. 1 and 8).

The data in Example Table XI compare the sensitivity increases obtained when compounds 29 and 54 are added to the blue or green dyed emulsion T-2. Compound 29 is a tertiary aniline deprotonating electron donor compound having the carboxylate base attached via a methylene chain to an ortho position on the phenyl ring of the aniline moiety rather than attached to the aniline nitrogen via a methylene chain. In this position, the carboxylate base is still capable of abstracting a proton from one of the ethyl groups attached to the aniline nitrogen. The data in Example Table XI show that compound 29 gave good speed increases with both the blue and the green dyed emulsions, indicating that the carboxylate base in this position gives a photographically useful deprotonating electron donating compound. Compound 54 is an ortho substituted tertiary aniline deprotonating electron donor compound having a sulfonate moiety instead of a carboxylate group. The data in Example Table XI show that compound 54 gives good speed increases with the blue and green dyed emulsions with little or no increase in fog.

EXAMPLE TABLE XI

Speed and fog results on Emulsion T-2 for DPED compounds with variations in attached base characteristics

| Test No. | Compound | Amount of Compound added ($10^{-3}$ mol/mol Ag) | Sens. Dye | Amount of Sens. Dye ($10^{-3}$ mol/mol Ag) | Photographic Sensitivity $S_{365}$ | Fog | Remarks |
|---|---|---|---|---|---|---|---|
| 1 | none | 0 | D-I | 0.91 | 100 | 0.04 | comparison |
| 2 | 29 | 4.4 | D-I | 0.91 | 191 | 0.04 | invention |
| 3 | 29 | 44 | D-I | 0.91 | 195 | 0.07 | invention |
| 4 | 54 | 4.4 | D-I | 0.91 | 132 | 0.04 | invention |
| 5 | 54 | 44 | D-I | 0.91 | 155 | 0.07 | invention |
| 6 | none | 0 | D-I | 0.86 | 100 | 0.06 | comparison |
| 7 | 29 | 4.4 | D-II | 0.86 | 105 | 0.06 | invention |
| 8 | 29 | 44 | D-II | 0.86 | 120 | 0.07 | invention |
| 9 | 54 | 4.4 | D-II | 0.86 | 100 | 0.06 | invention |
| 10 | 54 | 44 | D-II | 0.86 | 107 | 0.07 | invention |

EXAMPLE 12

The sulfur sensitized AgBrI tabular emulsion T-2 as described in Example 4 was used to prepare coatings containing various deprotonating electron-donating sensitizing agents in combination with the blue spectral sensitizing dye D-I as listed in Example Table XII. The sensitizing dye was added to the emulsion at 40° C., followed by the deprotonating electron donating compounds and the coatings were prepared as described in Example 1.

$S_{365}$, relative sensitivity at 365 nm, was evaluated as described in Example 1. Relative sensitivity for this exposure was set equal to 100 for the control dyed emulsion coating with no deprotonating electron donating sensitizer agent added (test no. 1).

The data in Example Table XII compare the sensitivity increases obtained when compounds 48, 49, 23, 61, 62, or 41 are added to the blue emulsion T-2. These compounds are tertiary and secondary aniline deprotonating electron donor compounds with both ortho and para substituents on the phenyl ring of the aniline moiety. The data in Example Table XII shows that all these compounds give large sensitivity increases in this blue dyed emulsion. However, the tertiary aniline compounds 48 and 49 and their corresponding secondary aniline compounds 61 and 62, which all have ortho dimethyl substituents on the phenyl ring of the aniline moiety, generally give a better overall combination of speed with low fog than the tertiary aniline compound 23 and its corresponding secondary aniline compound 41, which have only a single ortho methyl substituent on the phenyl ring of the aniline moiety.

EXAMPLE TABLE XII

Speed and Fog Results on Emulsion T-2 for Various DPED Compounds having ortho and para Substituents

| Test No. | Compound | Amount of Compound added ($10^{-3}$ mol/mol Ag) | Sens. Dye | Amount of Sens. Dye ($10^{-3}$ mol/mol Ag) | Photographic Sensitivity $S_{365}$ | Fog | Remarks |
|---|---|---|---|---|---|---|---|
| 1 | none | 0 | D-I | 0.91 | 100 | 0.04 | comparison |
| 2 | 48 | 4.4 | D-I | 0.91 | 182 | 0.05 | invention |
| 3 | 48 | 44 | D-I | 0.91 | 219 | 0.07 | invention |
| 4 | 49 | 4.4 | D-I | 0.91 | 182 | 0.04 | invention |
| 5 | 49 | 44 | D-I | 0.91 | 209 | 0.08 | invention |
| 6 | 23 | 4.4 | D-I | 0.91 | 191 | 0.05 | invention |
| 7 | 23 | 44 | D-I | 0.91 | 178 | 0.20 | invention |
| 8 | 61 | 44 | D-I | 0.91 | 200 | 0.05 | invention |
| 9 | 62 | 44 | D-I | 0.91 | 204 | 0.15 | invention |
| 10 | 41 | 44 | D-I | 0.91 | 155 | 0.10 | invention |

EXAMPLE 13

The AgBrI tabular silver halide emulsion T-2 as described in Example 4 was optimally chemically and spectrally sensitized by adding NaSCN, $1.07\times10^{-3}$ mole/mole Ag of the blue sensitizing dye D-I, $Na_3Au(S_2O_3)_2.2H_2O$, $Na_2S_2O_3.5H_2O$, and a benzothiazolium finish modifier and then subjecting the emulsion to a heat cycle to 65° C. The antifoggant and stabilizer tetraazaindene at a concentration of 1.75 gm/mole Ag was added to the emulsion melt after the chemical sensitization procedure. For some experimental variations, the hydroxybenzene compound, 2,4-disulfocatechcol (HB3) at a concentration $13\times10^{-3}$ mole/mole Ag was also added. Various deprotonating electron donating sensitizing agents as listed in Example Table XIII were added to the emulsion after the additions of HB3 and tetraazaindene. Coatings were then prepared as described in Example 1.

$S_{365}$, relative sensitivity at 365 nm, was evaluated as described in Example 1, except that the exposure time used was 0.01 s. Relative sensitivity for this exposure was set equal to 100 for the control dyed emulsion coating with no deprotonating electron donating sensitizer agent added (test no. 1).

Additional testing was carried out to determine the response of the coatings to a spectral exposure. The dyed coating strips were exposed for 0.01 sec to a 3000 K color temperature tungsten lamp filtered to give an effective color temperature of 5500K and further filtered through a Kodak Wratten filter number 2B and a step wedge ranging in density from 0 to 4 density units in 0.2 density steps. This filter passes only light of wavelengths longer than 400 nm, thus giving light absorbed mainly by the sensitizing dye. The exposed film strips were developed for 6 min in Kodak Rapid X-ray Developer (KRX). $S_{WR2B}$, relative sensitivity for this Kodak Wratten filter 2B exposure, was evaluated at a density of 0.15 units above fog. The relative sensitivity for this spectral exposure was set equal to 100 for the control dyed coating with no deprotonating electron donating compound added (test no. 1).

The data in Example Table XIII compare the sensitivity increases obtained when compounds 43, 44, 46, 56, 57, and 59 were added to the fully sensitized, blue-dyed emulsion T-2. Compound 43, 44, and 46 are tertiary aniline deprotonating electron donor compounds with ortho dimethyl substituents on the phenyl ring of the aniline moiety. Compounds 56, 57, and 59 are the secondary anilines corresponding to these compounds. The only structural difference in the series is the length of the methylene chain between the aniline nitrogen and the carboxylate base, which varies from 2 methylene carbons in compounds 43 and 56 to 5 methylene carbons in compounds 46 and 59. The data in Example Table XIII show that all of these compounds gave good speed increases with only very small fog increases on this optimally sensitized, blue-dyed tabular emulsion. The data also show that addition of HB3 to the coatings containing these deprotonating electron donating compounds is able to eliminate any small fog increases while maintaining the speed increases obtained with the compounds.

EXAMPLE TABLE XIII

Speed and Fog Results for DPED Compounds with fully sensitized, blue-dyed emulsion T-2, black and white format

| Test No. | Compound | Amount of Compound added ($10^{-3}$ mol/mol Ag) | Amount of HB-3 added ($10^{-3}$ mol/mol Ag) | Photographic Sensitivity $S_{365}$ | $S_{WR2B}$ | Fog | Remarks |
|---|---|---|---|---|---|---|---|
| 1 | none | 0.00 | none | 100 | 100 | 0.05 | comparison |
| 2 | none | 0.00 | 13 | 115 | 115 | 0.06 | comparison |
| 3 | 43 | 4.4 | none | 145 | 145 | 0.08 | invention |
| 4 | 43 | 4.4 | 13 | 138 | 138 | 0.06 | invention |
| 5 | 43 | 44 | none | 170 | 174 | 0.13 | invention |
| 6 | 44 | 4.4 | none | 145 | 151 | 0.09 | invention |
| 7 | 44 | 4.4 | 13 | 145 | 145 | 0.06 | invention |
| 8 | 44 | 44 | none | 174 | 182 | 0.14 | invention |
| 9 | 46 | 4.4 | none | 126 | 126 | 0.08 | invention |
| 10 | 46 | 4.4 | 13 | 129 | 123 | 0.06 | invention |
| 11 | 46 | 44 | none | 148 | 141 | 0.10 | invention |
| 12 | 56 | 4.4 | none | 123 | 120 | 0.06 | invention |
| 13 | 56 | 44 | none | 141 | 141 | 0.07 | invention |
| 14 | 57 | 4.4 | none | 132 | 135 | 0.07 | invention |
| 15 | 57 | 44 | none | 170 | 170 | 0.09 | invenfion |
| 16 | 59 | 4.4 | none | 117 | — | 0.06 | invention |
| 17 | 59 | 44 | none | 135 | 135 | 0.06 | invention |

EXAMPLE 14

A monodisperse AgBrI tabular silver halide emulsion T-3 containing 3.6% total I was prepared according to the procedures described in Fenton et al. U.S. Pat. No. 5,476,760 in a manner such that the central portion of the emulsion grains contained essentially no I and the I was concentrated around the grain perimeter but was higher at the edges than at the corners. The emulsion grains had an average thickness of 0.12 $\mu$m and an average circular diameter of 2.7 $\mu$m. This emulsion T-3 was optimally chemically and spectrally sensitized by adding NaSCN, $0.77\times10^{-3}$ mole/mole Ag of the green sensitizing dye D-II, $0.17\times10^{-3}$ mole/mole Ag of the green sensitizing dye D-IV, $Na_3Au(S_2O_3)_2.2H_2O$, $Na_2S_2O_3.5H_2O$, and a benzothiazolium finish modifier and then subjecting the emulsion to a heat cycle to 65° C. The antifoggant and stabilizer tetraazaindene at a concentration of 1.00 gm/mole Ag was added to the emulsion melt after the chemical sensitization procedure. For some experimental variations, the hydroxybenzene compound, 2,4-disulfocatechcol (HB3) at a concentration of $13\times10^{-3}$ mole/mole Ag was also added. Various deprotonating electron donating sensitizing agents as listed in Example Table XIV were added to the emulsion after the additions of HB3 and tetraazaindene. Coatings were then prepared as described in Example 1.

speed increases are accompanied by significant fog increases. The data show that addition of HB3 to the coatings containing these deprotonating electron donating compounds is able to minimize these fog increases while maintaining the speed increases obtained with the compounds.

EXAMPLE TABLE XIV

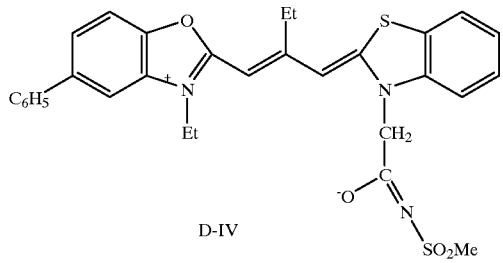

D-IV

Speed and Fog Results for DPED Compounds with fully sensitized, green-dyed emulsion T-3, black and white format

| Test No. | Compound | Amount of Compound added ($10^{-3}$ mol/mol Ag) | Amount of HB-3 added ($10^{-3}$ mol/mol Ag) | Photographic Sensitivity $S_{365}$ | $S_{WR2B}$ | Fog | Remarks |
|---|---|---|---|---|---|---|---|
| 1 | none | 0.00 | none | 100 | 100 | 0.08 | comparison |
| 2 | none | 0.00 | 13 | 105 | 107 | 0.08 | comparison |
| 3 | 43 | 4.4 | none | 110 | 129 | 0.38 | invention |
| 4 | 43 | 4.4 | 13 | 114 | 122 | 0.09 | invention |
| 5 | 43 | 14 | none | 132 | 129 | 0.43 | invention |
| 6 | 43 | 44 | 13 | 120 | 132 | 0.12 | invention |
| 7 | 44 | 4.4 | none | — | — | 1.09 | invention |
| 8 | 44 | 4.4 | 13 | 132 | 135 | 0.35 | invention |
| 9 | 44 | 14 | none | — | — | 0.95 | invention |
| 10 | 45 | 4.4 | 13 | 123 | 126 | 0.13 | invention |
| 11 | 45 | 44 | 13 | 126 | 138 | 0.21 | invention |
| 12 | 46 | 4.4 | none | 105 | 115 | 0.40 | invention |
| 13 | 46 | 4.4 | 13 | 115 | 116 | 0.09 | invention |
| 14 | 46 | 14 | none | 120 | 126 | 0.33 | invention |
| 15 | 46 | 44 | 13 | 117 | 120 | 0.12 | invention |

$S_{365}$, relative sensitivity at 365 nm, was evaluated as described in Example 1, except that the exposure time used was 0.01 s. Relative sensitivity for this exposure was set equal to 100 for the control dyed emulsion coating with no deprotonating electron donating sensitizer agent added (test no. 1). Additional testing was carried out to determine the response of the coatings to a spectral exposure, as described in Example XIII. The relative sensitivity $S_{WR2B}$ for this spectral exposure was set equal to 100 for the control dyed coating with no deprotonating electron donating compound added (test no. 1).

The data in Example Table XIV compare the sensitivity increases obtained when compounds 43, 44, 45, and 46 were added to the fully sensitized, green-dyed emulsion T-3. These compounds are tertiary aniline deprotonating electron donor compounds with ortho dimethyl substituents on the phenyl ring of the aniline moiety. The only structural difference in the series is the length of the methylene chain between the aniline nitrogen and the carboxylate base, which varies from 2 methylene carbons in compound 43 to 5 methylene carbons in compound 46. The data in Example Table XIV show that all of these compounds gave reasonable speed increases on this optimally sensitized, green-dyed tabular emulsion. However, in the absence of HB3, these

EXAMPLE 15

The sulfur sensitized AgBrI tabular emulsion T-2 as described in Example 4 was used to prepare coatings containing various deprotonating electron-donating sensitizing agents in combination with blue spectral sensitizing dye D-I, or green spectral sensitizing dye D-II as listed in Example Table XV. The sensitizing dyes were added to the emulsion at 40° C., followed by the deprotonating electron donating compounds and the coatings were prepared as described in Example 1. For some experimental variations, the hydroxybenzene compound, 2,4-disulfocatechcol (HB3) at a concentration of $13\times10^{-3}$ mole/mole Ag was also added before the addition of the DPED compounds.

$S_{365}$, relative sensitivity at 365 nm, was evaluated as described in Example 1. For each dye, relative sensitivity for this exposure was set equal to 100 for the control emulsion coating with no deprotonating electron donating sensitizer agent and no disulfocatechol added (test nos. 1 and 7).

The data in Example Table XV compare the sensitivity increases obtained when compounds 44 or 68 were added to the sulfur sensitized, dyed emulsion T-2. Compound 68 is an example of a deprotonating electron donating compound attached via a linking group to an adsorbable group (a thiourea in this case). Compound 44 is the analog of Compound 68 with no adsorbable group attached. The data in Example Table XV show that Compound 68 is able to give good speed increases at much lower concentration than Compound 44 in both the blue and green dyed emulsions. These speed increases are obtained with little or no fog increase. The data also show that the addition of HB3 is able to minimize any small fog increases that are present without any adverse effect on the speed increases obtained.

EXAMPLE TABLE XV

Speed and Fog Results for Adsorbable DPED Compound 68 on Emulsion T-2

| Test No. | Comp'd | Amount of Compound added ($10^{-3}$ mol/molAg) | Sens. Dye | Amount of Sens. Dye ($10^{-3}$ mol/molAg) | Amount of HB-3 added ($10^{3}$ mol/molAg) | Photographic Sensitivity $S_{365}$ | Photographic Sensitivity Fog | Remarks |
|---|---|---|---|---|---|---|---|---|
| 1 | none | 0.00 | D-I | 0.91 | none | 100 | 0.05 | comparison |
| 2 | none | 0.00 | D-I | 0.91 | 13 | 107 | 0.05 | comparison |
| 3 | 44 | 4.4 | D-I | 0.91 | none | 200 | 0.07 | invention |
| 4 | 68 | 0.014 | D-I | 0.91 | none | 178 | 0.06 | invention |
| 5 | 68 | 0.14 | D-I | 0.91 | none | 224 | 0.13 | invention |
| 6 | 68 | 0.14 | D-I | 0.91 | 13 | 224 | 0.07 | invention |
| 7 | none | 0.00 | D-II | 0.86 | none | 100 | 0.08 | comparison |
| 8 | none | 0.00 | D-II | 0.86 | 13 | 112 | 0.08 | comparison |
| 9 | 44 | 4.4 | D-II | 0.86 | none | 158 | 0.09 | invention |
| 10 | 68 | 0.0014 | D-II | 0.86 | none | 112 | 0.08 | invention |
| 11 | 68 | 0.014 | D-II | 0.86 | none | 141 | 0.08 | invention |
| 12 | 68 | 0.014 | D-II | 0.86 | 13 | 138 | 0.08 | invention |

EXAMPLE 16

The optimally sensitized blue-dyed emulsion T-2 as described in Example 13 and the optimally sensitized green-dyed emulsion T-3 as described in Example 14 were used to prepare color format coatings containing the adsorbable DPED Compound 68, as detailed in Example Table XVI. The mild hydroxybenzene compound, 2,4-disulfocatechcol (HB3) at a concentration of $13\times10^{-3}$ mole/mole Ag and the antifoggant and stabilizer tetraazaindene at a concentration of 1.75 gm/mole Ag (emulsion T-2) or 1.00 gm/mole Ag (emulsion T-3) were added to the emulsion melt before the addition of Compound 68 to the melts at 40° C.

The melts were prepared for coating by adding additional water, deionized gelatin, and coating surfactants. Coatings were prepared by combining the emulsion melts with a melt containing deionized gelatin and an aqueous dispersion of the cyan-forming color coupler CC-1 and coating the resulting mixture on acetate support. The final coatings contained Ag at 0.81 g/m$^2$, coupler at 1.61 g/m$^2$, and gelatin at 3.22 g/m$^2$. The coatings were overcoated with a protective layer containing gelatin at 1.08 g/m$^2$, coating surfactants, and a bisvinylsulfonylmethyl ether as a gelatin hardening agent. The coating strips obtained were then tested using the 365 nm exposure and the Kodak Wratten 2B exposure described in Example 13. For each exposure, relative sensitivity was set equal to 100 for the control emulsion coating with no deprotonating electron donating sensitizer agent added (test no. 1).

The data in Example Table XVI show the sensitivity increases obtained when Compound 68 was added to the fully sensitized blue-dyed emulsion T-2 or the fully sensitized green-dyed emulsion T-3. Speed increases were largest for the blue-dyed emulsion T-2 but for both emulsions, concentrations of Compound 68 can be found that give useful speed increases with only small fog increases. The table also shows that the optimum concentration of Compound 46 was lower in the optimally sensitized green-dyed emulsion T-3 than in the optimally sensitized blue-dyed emulsion T-2.

EXAMPLE TABLE XVI

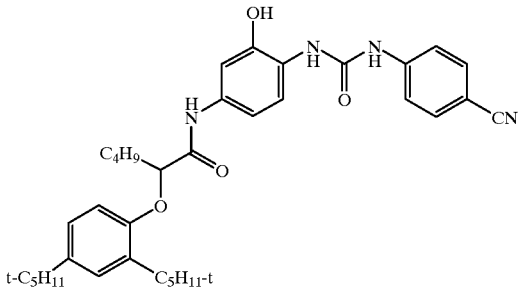

CC-1

Speed and Fog Results for DPED Compound 68 on Fully Sensitized Emulsions T-2 and T-3, Color Format

| Test No. | Emulsion | Sens. Dye | Amount of Compound 68 ($10^{-3}$ mol/mol Ag) | Photographic Sensitivity $S_{365}$ | $S_{WR2B}$ | Fog | Remarks |
|---|---|---|---|---|---|---|---|
| 1 | T-2 | D-I | none | 100 | 100 | 0.08 | comparison |
| 2 | T-2 | D-I | 0.014 | 135 | 126 | 0.11 | invention |
| 3 | T-2 | D-I | 0.045 | 151 | 151 | 0.13 | invention |
| 4 | T-2 | D-I | 0.14 | 166 | 182 | 0.21 | invention |
| 5 | T-3 | D-II + D-IV | none | 100 | 100 | 0.09 | comparison |
| 6 | T-3 | D-II + D-IV | 0.00045 | 102 | 102 | 0.09 | invention |
| 7 | T-3 | D-II + D-IV | 0.0014 | 105 | 105 | 0.12 | invention |
| 8 | T-3 | D-II + D-IV | 0.0045 | 112 | 117 | 0.26 | invention |

EXAMPLE 17

The sulfur sensitized AgBrI tabular emulsion T-2 as described in Example 4 was used to prepare coatings containing various deprotonating electron-donating sensitizing agents in combination with blue spectral sensitizing dye D-I, or green spectral sensitizing dye D-II as listed in Example Table XVII. The sensitizing dyes were added to the emulsion at 40° C., followed by the deprotonating electron donating compounds and the coatings were prepared as described in Example 1. For some experimental variations, the hydroxybenzene compound, 2,4-disulfocatechcol (HB3) at a concentration of $13\times10^{-3}$ mole/mole Ag was also added before the addition of the DPED compounds.

$S_{365}$, relative sensitivity at 365 nm, was evaluated as described in Example 1. In addition, $S_{WR2B}$, relative sensitivity for a spectral exposure was evaluated as described in example 13, except that the exposure time used was 0.1 s. For each dye and each exposure type, relative sensitivity for the exposure was set equal to 100 for the control emulsion coating with no deprotonating electron donating sensitizer agent and no disulfocatechol added (test nos. 1 and 8).

The data in Example Table XVII compare the sensitivity increases obtained when compounds 46 or 67 were added to the sulfur sensitized, dyed emulsion T-2. Compound 67 is an example of a deprotonating electron donating compound attached via a linking group to an adsorbable group (a thiomorpholino moiety in this case). Compound 46 is the analog of Compound 67 with no adsorbable group attached. The data in Example Table XVII show that Compound 67 is able to give good speed increases at much lower concentration than Compound 46 in both the blue and green dyed emulsions. These speed increases were obtained with little or no fog increase in the blue-dyed emulsion. In the green dyed emulsion, these speed increases were accompanied by significant increases in fog. However, the data in Example Table XVII show that a combination of proper choice of Compound 67 concentration with use of the disulfocatechcol compound HB3 allows Compound 67 to give good speed increases with only small increases in fog.

EXAMPLE TABLE XVII

Speed and Fog Results for Adsorbable DPED Compound 67 on Emulsion T-2

| Test No. | Comp'd | Amount of Compound added ($10^{-3}$ mol/molAg) | Sens. Dye | Amount of Sens. Dye ($10^{-3}$ mol/molAg) | Amount of HB-3 added ($10^{3}$ mol/molAg) | Photographic Sensitivity $S_{365}$ | $S_{WR2B}$ | Fog | Remarks |
|---|---|---|---|---|---|---|---|---|---|
| 1 | none | 0.00 | D-I | 0.91 | none | 100 | 100 | 0.05 | comparison |
| 2 | none | 0.00 | D-I | 0.91 | 13 | 112 | 110 | 0.04 | comparison |
| 3 | 46 | 4.4 | D-I | 0.91 | none | 158 | 166 | 0.08 | invention |
| 4 | 67 | 0.044 | D-I | 0.91 | 13 | 162 | 170 | 0.07 | invention |
| 5 | 67 | 0.14 | D-I | 0.91 | none | 174 | 186 | 0.06 | invention |

EXAMPLE TABLE XVII-continued

Speed and Fog Results for Adsorbable DPED Compound 67 on Emulsion T-2

| Test No. | Comp'd | Amount of Compound added ($10^{-3}$ mol/molAg) | Sens. Dye | Amount of Sens. Dye ($10^{-3}$ mol/molAg) | Amount of HB-3 added ($10^{3}$ mol/molAg) | Photographic Sensitivity $S_{365}$ | $S_{WR2B}$ | Fog | Remarks |
|---|---|---|---|---|---|---|---|---|---|
| 6 | 67 | 0.14 | D-I | 0.91 | 13 | 178 | 182 | 0.07 | invention |
| 7 | 67 | 0.44 | D-I | 0.91 | 13 | 182 | 200 | 0.10 | invention |
| 8 | none | 0.00 | D-II | 0.86 | none | 100 | 100 | 0.07 | comparison |
| 9 | none | 0.00 | D-II | 0.86 | 13 | 102 | 100 | 0.07 | comparison |
| 10 | 46 | 4.4 | D-II | 0.86 | none | 120 | 132 | 0.24 | invention |
| 11 | 67 | 0.044 | D-II | 0.86 | 13 | 151 | 162 | 0.08 | invention |
| 12 | 67 | 0.14 | D-II | 0.86 | none | — | — | 0.71 | invention |
| 13 | 67 | 0.14 | D-II | 0.86 | 13 | 162 | 174 | 0.13 | invention |
| 14 | 67 | 0.44 | D-II | 0.86 | 13 | 141 | 155 | 0.38 | invention |

EXAMPLE 18

The optimally sensitized blue-dyed emulsion T-2 as described in Example 13 was used to prepare color format coatings containing the adsorbable DPED Compound 67, as described in Example Table XVIII. The hydroxybenzene compound, 2,4-disulfocatechcol (HB3) at a concentration of $13\times10^{-3}$ mole/mole Ag and the antifoggant and stabilizer tetraazaindene at a concentration of 1.75 gm/mole Ag (emulsion T-2) were added to the emulsion melt before the addition of Compound 67 to the melts at 40° C. The melts were then used to prepare color format coatings as described in Example 16. The coating strips obtained were then tested using the 365 nm exposure and the Kodak Wratten 2B exposure described in Example 13. For each exposure, relative sensitivity was set equal to 100 for the control emulsion coating with no deprotonating electron donating sensitizer agent added (test no. 1).

The data in Example Table XVIII indicate that useful sensitivity increases are obtained for both intrinsic and spectral exposures when Compound 67 was added to this fully sensitized, blue-dyed emulsion. These sensitivity increases were accompanied by minor increases in fog. Since the best combination of speed and fog was observed at the lowest concentration of Compound 67, the data in the table indicate that the optimum concentration for Compound 67 this emulsion is probably lower than the lowest concentration studies in this example.

EXAMPLE TABLE XVIII

Speed and Fog Results for Compound 67 on Fully Sensitized Blue Dyed Emulsion T-2 in Color Format

| Test No. | Amount of Compound 67 ($10^{-3}$ mol/mol Ag) | Photographic Sensitivity $S_{365}$ | $S_{WR2B}$ | Fog | Remarks |
|---|---|---|---|---|---|
| 1 | none | 100 | 100 | 0.06 | comparison |
| 2 | 0.44 | 143 | 138 | 0.11 | invention |
| 3 | 1.4 | 140 | 135 | 0.12 | invention |
| 4 | 4.4 | 140 | 129 | 0.14 | invention |

EXAMPLE 19

The sulfur sensitized AgBrI tabular emulsion T-2 as described in Example 4 was used to prepare coatings containing various deprotonating electron-donating sensitizing agents in combination with blue spectral sensitizing dye D-I, or green spectral sensitizing dye D-II as Table XIX. The sensitizing dyes were added to the emulsion at 40° C., followed by the deprotonating electron donating compounds and the coatings were prepared as described in Example 1.

$S_{365}$, relative sensitivity at 365 nm, was evaluated as described in Example 1. For each dye, relative sensitivity for this exposure was set equal to 100 for the control emulsion coating with no deprotonating electron donating sensitizer agent added (test nos. 1 and 5).

The data in Example Table XIX compare the sensitivity increases obtained when compounds 44 or 55 were added to the sulfur sensitized, dyed emulsion T-2. Compound 55 is an example of a deprotonating electron donating compound with two X—H moieties attached to each other via methylene chain linking the two aniline nitrogens. Compound 44 is the analog of Compound 55 with only a single X—H moiety. In both compounds, the X—H moiety contains ortho dimethyl substituents on the phenyl ring of the aniline structure. The data in Example Table XIX show that Compound 55 is similar in activity to Compound 29. Both compounds gave good speed increases in the blue and green dyed emulsions with only very slight fog increases.

EXAMPLE TABLE XIX

Speed and Fog Results for DPED Compounds on Emulsion T-2

| Test No. | Comp'd | Amount of Compound added ($10^{-3}$ mol/molAg) | Sens. Dye | Amount of Sens. Dye ($10^{-3}$ mol/molAg) | Photographic Sensitivity $S_{365}$ | Fog | Remarks |
|---|---|---|---|---|---|---|---|
| 1 | none | 0.00 | D-I | 0.91 | 100 | 0.05 | comparison |
| 2 | 44 | 4.4 | D-I | 0.91 | 200 | 0.07 | invention |
| 3 | 55 | 2.2 | D-I | 0.91 | 195 | 0.06 | invention |
| 4 | 55 | 22 | D-I | 0.91 | 191 | 0.07 | invention |
| 5 | none | 0.00 | D-II | 0.86 | 100 | 0.08 | comparison |
| 6 | 44 | 4.4 | D-II | 0.86 | 158 | 0.09 | invention |
| 7 | 55 | 2.2 | D-II | 0.86 | 141 | 0.10 | invention |
| 8 | 55 | 22 | D-II | 0.86 | 158 | 0.15 | invention |

EXAMPLE XX

The sulfur sensitized AgBrI tabular emulsion T-2 as described in Example 4 was used to prepare coatings containing the deprotonating electron-donating sensitizing agent compound 31 in combination with blue spectral sensitizing dye D-I or green spectral sensitizing dye D-II as listed in Example Table XX. The sensitizing dyes were added to the emulsion at 40° C., followed by the deprotonating electron donating compound and the coatings were prepared as described in Example 1.

EXAMPLE TABLE XX

Speed and Fog Results for DPED Compound 31 with Dyed Emulsion T-2

| Test No. | Compound | Amount of Compound added ($10^{-3}$ mol/molAg) | Sens Dye | Amount of Sens. Dye ($10^{-3}$ mol/molAg) | Photographic Sensitivity $S_{WR2B}$ | Fog | Remarks |
|---|---|---|---|---|---|---|---|
| 1 | none | 0 | D-I | 0.91 | 100 | 0.04 | comparison |
| 2 | 31 | 4.4 | D-I | 0.91 | 123 | 0.04 | invention |
| 3 | 31 | 44 | D-I | 0.91 | 110 | 0.04 | invention |
| 4 | none | 0 | D-II | 0.86 | 100 | 0.07 | comparison |
| 5 | 31 | 4.4 | D-II | 0.86 | 100 | 0.07 | invention |
| 6 | 31 | 44 | D-II | 0.86 | 112 | 0.07 | invention |

$S_{WR2B}$, relative sensitivity for a spectral exposure was evaluated as described in example 13, except that the exposure time used was 0.1 s. For each dye, relative sensitivity for the exposure was set equal to 100 for the control emulsion coating with no deprotonating electron donating sensitizer agent added (test nos. 1 and 4).

Compound 31 is a deprotonating electron donating sensitizer with an aryl carboxylate base attached to the ortho position of the aniline nitrogen. This attachment is via a keto linkage, which causes the compound to absorb light in the blue region of the spectrum. The data in Example Table XX shows that at the lower concentration, Compound 31 gives a moderate spectral speed increase for the blue dyed emulsion but that at the higher concentration, loss of speed is seen owing to a filtering effect of the compound on the blue light reaching the emulsion. For the green dyed emulsion, the filtration effect is absent in the spectrally sensitized region and small speed gains are seen for spectral exposures at the larger compound concentration. These data indicate that the attached aryl carboxylate moiety in this ortho position gives a photographically useful deprotonating electron donating compound.

EXAMPLE 21

The optimally sensitized blue-dyed emulsion T-2 as described in Example 13 was used to prepare color format coatings containing the adsorbable DPED compounds 109, 111, 113, and 115, as detailed in Table XXI. The antifoggant 2,4-disulfocatechcol (HB3) at a concentration of $13\times10^{-3}$ mole/mole Ag and the antifoggant and stabilizer tetraazaindene at a concentration of 1.75 gm/mole Ag were added to the emulsion melt before the addition of the adsorbable DPED compounds to the melts at 40° C. The melts were used to prepare color format coatings as described in Example 16. The coating strips obtained were then tested using the 365 nm exposure and the Kodak Wratten 2B exposure as described in Example 13. Development was for 3¼ minutes in Kodak C-41 color developer. For each exposure, relative sensitivity was set equal to 100 for the control emulsion coating with no deprotonating electron donating sensitizer agent added (test no. 1).

The data in Example Table XXI show the sensitivity increases obtained when the adsorbable DPED compounds 109, 111, 113, and 115 were added to the fully sensitized blue dyed emulsion T-2. At the optimum compound concentrations, speed increases of up to 1.6× could be obtained with only small increases in fog.

TABLE XXI

Speed and Fog Results for Adsorbable DPED Compounds on Fully Sensitized Blue Dyed Emulsion T-2, Color Format

| Test No. | Compound | Amount Compound ($10^{-3}$ mol/mol Ag) | Photographic Sensitivity $S_{365}$ | $S_{WR2B}$ | Fog | Remarks |
|---|---|---|---|---|---|---|
| 1 | none | none | 100 | 100 | 0.06 | comparison |
| 2 | 109 | 0.0045 | 145 | 141 | 0.08 | invention |
| 3 | 109 | 0.014 | 158 | 158 | 0.09 | invention |
| 4 | 111 | 0.014 | 148 | 145 | 0.09 | invention |
| 5 | 111 | 0.045 | 162 | 162 | 0.13 | invention |
| 6 | 113 | 0.045 | 145 | 145 | 0.12 | invenfion |
| 7 | 113 | 0.14 | 145 | 141 | 0.38 | invention |
| 8 | 115 | 0.045 | 141 | 138 | 0.13 | invention |
| 9 | 115 | 0.14 | 145 | 145 | 0.37 | invention |

EXAMPLE 22

The optimally sensitized green-dyed emulsion T-3 as described in Example 14 was used to prepare black and white format coatings containing the adsorbable DPED compounds 109, 110, 111, and 112, as detailed in Table XXII. The antifoggant 2,4-disulfocatechcol (HB3) at a concentration of $13\times10^{-3}$ mole/mole Ag and the antifoggant and stabilizer tetraazaindene at a concentration of 1.00 gm/mole Ag were added to the emulsion melt before the addition of the adsorbable DPED compounds to the melts at 40° C. The melts were used to prepare black and white format coatings as described in Example 16. The coating strips obtained were then tested using the 365 nm exposure and the Kodak Wratten 2B exposure as described in Example 13. Development was for 6 min in Kodak Rapid X-ray Developer (KRX). For each exposure, relative sensitivity was set equal to 100 for the control emulsion coating with no deprotonating electron donating sensitizer agent added (test no. 1).

The data in Example Table XXII show the sensitivity increases obtained when the adsorbable DPED compounds 109, 110, 111, and 112 were added to the fully sensitized green-dyed emulsion T-3. At the optimum compound concentrations, speed increases of up to 1.2× could be obtained with only small increases in fog.

TABLE XXII

Speed and Fog Results for Adsorbable DPED Compounds on Fully Sensitized Green Dyed Emulsion T-3, Black and White Format

| Test No. | Compound | Amount Compound ($10^{-3}$ mol/mol Ag) | Photographic Sensitivity $S_{365}$ | $S_{WR2B}$ | Fog | Remarks |
|---|---|---|---|---|---|---|
| 1 | none | | 100 | 100 | 0.09 | comparison |
| 2 | 109 | 0.45 | 123 | 115 | 0.12 | invention |
| 3 | 109 | 1.4 | 141 | 141 | 0.24 | invention |
| 4 | 110 | 0.23 | 107 | 112 | 0.10 | invention |
| 5 | 110 | 0.7 | 112 | 117 | 0.15 | invention |
| 6 | 110 | 2.3 | 129 | 132 | 0.24 | invention |
| 7 | 111 | 1.4 | 107 | 110 | 0.10 | invention |
| 8 | 111 | 4.5 | 117 | 120 | 0.16 | invention |
| 9 | 111 | 14 | 132 | 145 | 0.30 | invention |
| 10 | 112 | 0.7 | 100 | 105 | 0.10 | invention |
| 11 | 112 | 2.3 | 102 | 107 | 0.11 | invention |
| 12 | 112 | 7 | 107 | 110 | 0.13 | invention |

EXAMPLE 23

The sulfur sensitized AgBrI tabular emulsion T-1 described in Example 1 was used to prepare the black and white format coatings containing the DPED compound INV 32 in combination with a blue spectral sensitizing dye D-I or green spectral sensitizing dye D-II. The sensitizing dyes were added to the emulsion at 40 C, followed by the DPED and the coatings were prepared as described in Example 1. The coating strips were then tested using the 365 nm exposure and the Kodak Wratten 2B exposure as described in example 13.

TABLE XXIII

| Test No. | Sensitizing Dye | Amount of INV 32 added ($10^{-3}$ mol/mol Ag) | Photographic Sensitivity Fog | $S_{365}$ | $S_{WR2B}$ |
|---|---|---|---|---|---|
| 1 | D-I | 0 | 0.04 | 100 | 100 |
| 2 | D-I | 4.4 | 0.04 | 110 | 110 |
| 3 | D-I | 44 | 0.04 | 148 | 145 |
| 4 | D-II | 0 | 0.07 | 100 | 100 |
| 5 | D-II | 1.4 | 0.08 | 110 | 110 |
| 6 | D-II | 14 | 0.09 | 112 | 110 |

The data of Table XIII show the DPED compound INV 32, which contains the covalently attached basic moiety N—O, provides sensitivity increases on the AgBrI emulsions containing either the blue or green spectral sensitizing dye. At the optimum compound concentration, speed increases up to 1.4× could be obtained with little or no increase in fog.

The invention has been described in detail with particular reference to preferred embodiments, but it will be understood that variations and modifications can be effected within the spirit and scope of the invention.

What is claimed is:

1. A photographic element comprising at least one silver halide emulsion layer in which the silver halide is sensitized with a compound of the formula X—H, wherein X is an electron donor moiety to which a base, $B^-$, is covalently linked and H is a leaving hydrogen atom, and wherein:

1) X—H has an oxidation potential between 0 and about 1.4 V; and 2) the oxidized form of X—H undergoes deprotonation reaction with the base $B^-$ to give the radical $X^{\bullet}$ and the protonated base B—H.

2. A photographic element comprising at least one silver halide emulsion layer in which the silver halide is sensitized with a compound of the formula X—H, wherein X is an electron donor moiety to which a base, $B^-$, is covalently linked and H is a leaving hydrogen atom, and wherein:

1) X—H has an oxidation potential between 0 and about 1.4 V;

2) the oxidized form of X—H undergoes deprotonation reaction with the base, $B^-$, to give the radical $X^{\bullet}$ and the protonated base $B^-$ H; and 3) the radical $X^{\bullet}$ has an oxidation potential $\leqq -0.7$V.

3. A photographic element according to claim 1 or claim 2, wherein the base $B^-$ is carboxylate or sulfate.

4. A photographic element according to claim 1 or claim 2, wherein the base $B^-$ is an amine oxide.

5. A photographic element according to claim 1 or 2, wherein the base is covalently linked to X through a linking group, L'.

6. A photographic element according to claim 5, wherein L' is a substituted or unsubstituted alkylene group, that may contain a heteroatom, or a carbonyl, a carboxyl, an amide, a sulfonyl, or a sulfonamide group.

7. A photographic element according to claim 6, wherein L' is a substituted or unsubstituted methylene group of the formula: $—(CH_2)_t—$ where t is an integer of 2–10.

8. A photographic element according to claim 1 or claim 2, wherein the X—H compound is of structure (I):

(I)

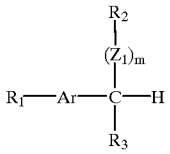

wherein:

m is 0, 1;

$Z_1$ is O, S, Se or Te;

Ar is an aryl group or a heterocyclic group;

$R_1$ is R, carboxyl, amide, sulfonamide, halogen, $N(R)_2$, $(OH)_f$, $(OR')_f$, or $(SR)_f$, R' is alkyl or substituted alkyl;

f is 1–3;

$R_2$ is R, Ar';

$R_3$ is R, Ar';

$R_2$ and $R_3$ together can form 5- to 8- membered ring;

$R_2$ and Ar can be linked to form 5- to 8- membered ring;

$R_3$ and Ar can be linked to form 5- to 8- membered ring;

Ar' is aryl group; and

R is a hydrogen atom or an unsubstituted or substituted alkyl group.

9. A photographic element according to claim 8, wherein the X—H compound is selected from the group consisting of:

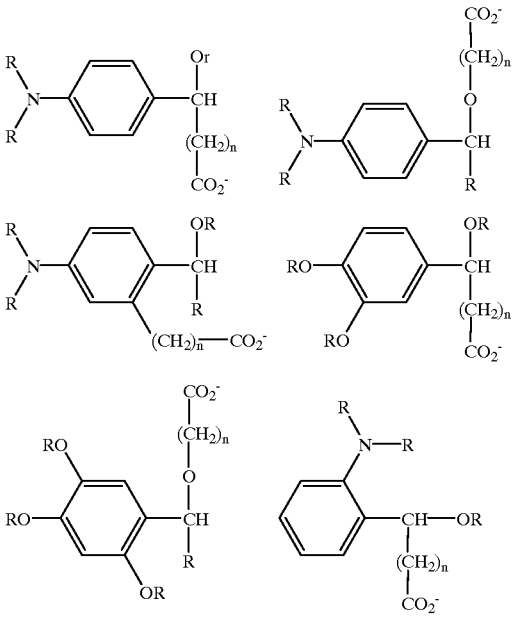

-continued

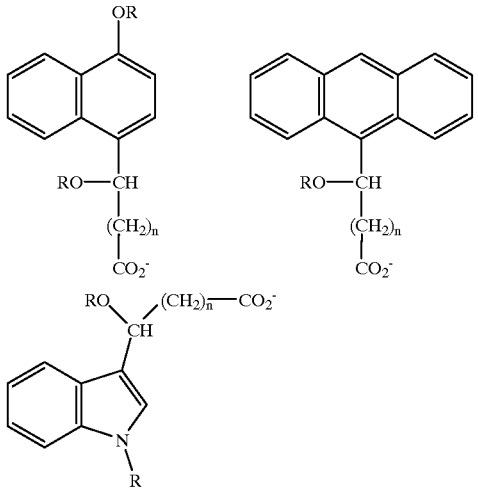

wherein:

R is a hydrogen atom or an unsubstituted or substituted alkyl group; and n=1–8.

10. A photographic element according to claim 1 or claim 2, wherein the X—H compound is of structure (II):

(II)

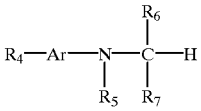

wherein:

Ar is an aryl group;

$R_4$ is a substituent having a Hammett sigma value of −1 to +1, preferably −0.7 to +0.7;

$R_5$ is R or Ar'

$R_6$ and $R_7$ are independently R or Ar'

$R_5$ and Ar can be linked to form 5- to 8- membered ring;

$R_6$ and Ar can be linked to form 5- to 8- membered ring (in which case, $R_6$ can be a hetero atom);

$R_5$ and $R_6$ can be linked to form 5- to 8- membered ring;

$R_6$ and $R_7$ can be linked to form 5- to 8- membered ring;

Ar' is an aryl group; and

R is a hydrogen atom or an unsubstituted or substituted alkyl group.

11. A photographic element according to claim 10, wherein the compound X—H is selected from the group consisting of:

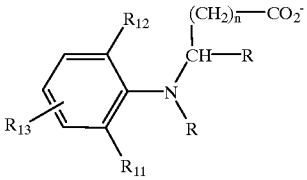

-continued

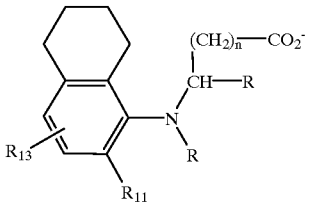

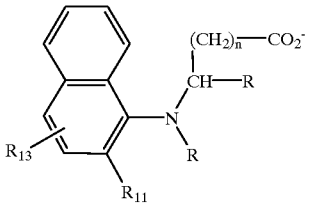

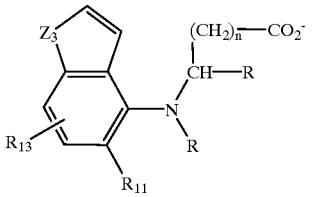

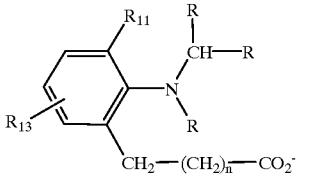

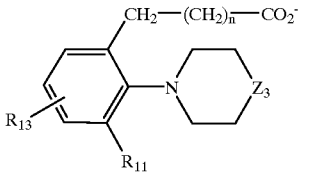

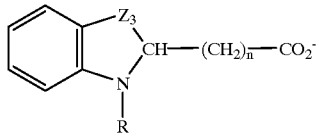

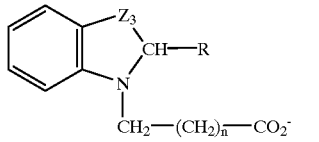

wherein:

$R_{11}$ through $R_{13}$ are independently chosen from H, alkyl, substituted alkyl, halo, alkoxy, alkylthio, carboxyl, amido, sulfonyl, formyl, acyl, or $R_{11}$ and $R_{13}$ or $R_{12}$ and $R_{13}$ are fused 5- to 8-membered ring;

$Z_3$=S, O, Se, NR, $C(R)_2$;

R is a hydrogen atom or a substituted or unsubstituted alkyl group; and n=1–8.

12. A photographic element according to claim 1 or claim 2, wherein the compound H—X is of structure (III):

(III)

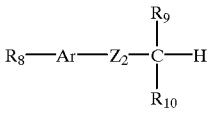

wherein:

$Z_2$ is O, S, Se;

Ar is an aryl group;

$R_8$ is R, carboxyl, $N(R)_2$, $(OR)_f$, or $(SR)_f$, where f is 1–3;

$R_9$ and $R_{10}$: are independently R or Ar';

$R_9$ and Ar can be linked to form 5- to 8- membered ring;

Ar': is an aryl group; and

R is a hydrogen atom or an unsubstituted or substituted alkyl group.

13. A photographic element according to claim 12, wherein the X—H compound is selected from the group consisting of:

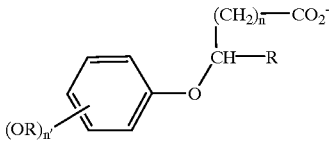

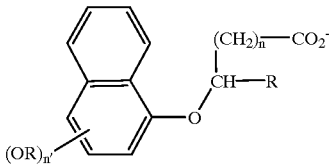

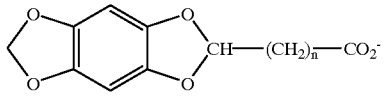

wherein:

R is a hydrogen atom or an unsubstituted or substituted alkyl group; and n=1–8; and n'=0–3.

14. A photographic element according to claim 1 or claim 2, wherein the X—H compound is of structure (IV):

(IV)

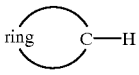

wherein:

"ring" represents a substituted or unsubstituted 5-, 6-, or 7-membered unsaturated ring.

15. A photographic element according to claim 14, wherein the X—H compound is selected from the group consisting of:

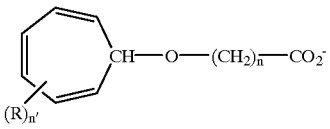

-continued

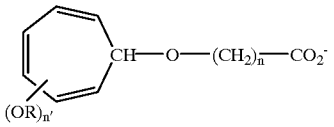

wherein:

R is a hydrogen atom or a substituted or unsubstituted alkyl group; and n is 1–8;and n'=0–3.

16. A photographic element according to claim 1 or claim 2, wherein the X—H compound is of the formula:

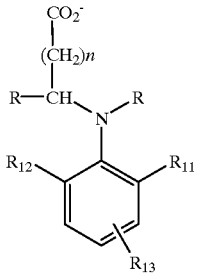

wherein:

R is a hydrogen atom or a substituted or unsubstituted alkyl group;

one or both of $R_{11}$ and $R_{12}$ is a group that has a steric parameter which is equal to or larger than that of fluorine;

$R_{13}$ is a substituent having a Hammett sigma value of −1 to +1;

$R_{11}$ and $R_{13}$ can form a fused 5- to 8- membered, saturated or unsaturated ring that may contain heteroatoms; and n is 1–8.

17. A photographic element according to claim 1 or claim 2, wherein the X—H compound is of the formula:

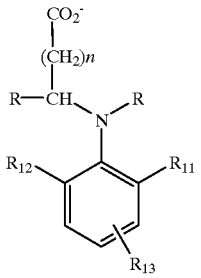

wherein:

R is a hydrogen atom or a substituted or unsubstituted alkyl group;

$R_{11}$ or $R_{12}$ or both $R_{11}$ and $R_{12}$ are independently chosen to be a halogen atom, a substituted or unsubstituted alkyl, an alkoxy group, an alkylthio group, an aryl group, a heterocyclic moiety, a carboxylate group or an acyl group;

$R_{13}$ is a hydrogen atom, a halogen atom, a substituted or unsubstituted alkyl group, a carboxylate group, an amido group, a formyl group, an acyl group, a sulfonate or sulfonamide group, an alkoxy or an alkylthio group;

$R_{11}$ and $R_{12}$ can form a fused 5- to 8- membered, saturated or unsaturated ring that may contain heteroatoms; and n is 1–8.

18. A photographic element according to claim 17, wherein at least one of $R_{11}$ and $R_{12}$ is a substituted or unsubstituted alkyl group.

19. A photographic element according to claim 1 or claim 2, wherein the emulsion layer further contains a sensitizing dye.

20. A photographic element according to claim 19, wherein the sensitizing dye is selected from dyes of the formulae 75–79 below:

75

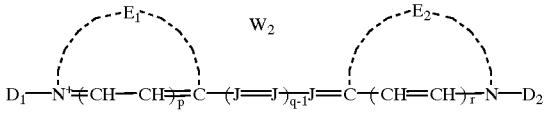

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

76

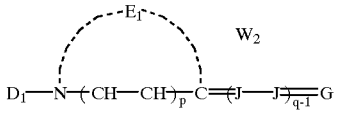

wherein $E_1$, $D_1$, J, p, q and $W_2$ are as defined above for formula 75 and G represents

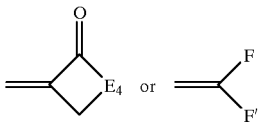

wherein $E_4$ represents the atoms necessary to complete a substituted or unsubstituted heterocyclic nucleus, and F and F' each independently represents a cyano group, an ester group, an acyl group, a carbamoyl group or an alkysulfonyl group;

77

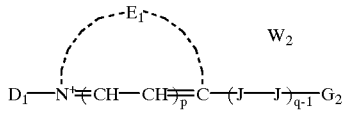

wherein $D_1$, $E_2$, J, p, q and $W_2$ are as defined above for formula 75, and $G_2$ represents a substituted or unsubstituted amino group or a substituted or unsubstituted aryl group;

78

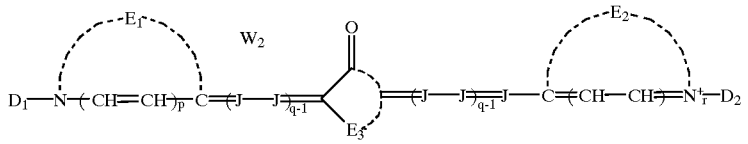

wherein $D_1$, $E_1$, $D_2$, $E_1$, J, p, q, r and $W_2$ are as defined for formula 75 above, and $E_3$ is defined the same as $E_4$ for formula 76 above;

79

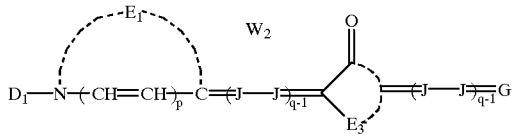

wherein $D_1$, $E_1$, J, G, p, q, r, $W_2$ and $E_3$ are as defined above.

21. A photographic element according to claim 1 or claim 2, comprising a plurality of layers wherein one or more of the layers of the element contains a hydroxybenzene compound.

22. A photographic element according to claim 21, wherein the hydroxybenzene compound has the formula:

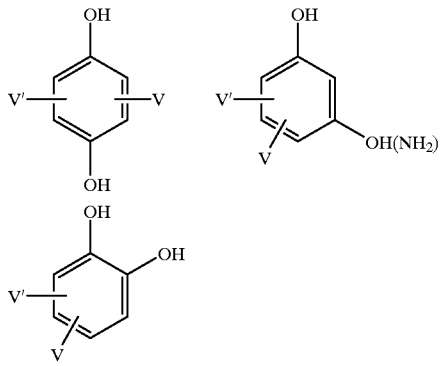

wherein V and V' each independently represent —H, —OH, a halogen atom, —OM (where M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

23. A photographic element of claim 1 or claim 2, wherein, the electron donor X—H is added to the emulsion layer after exposure.

24. A photographic element comprising at least one silver halide emulsion layer in which the silver halide is sensitized with a compound of the formula:

$$A—(L—X—H)_k$$

or $$(A—L)_k—X—H$$

wherein A is a silver halide adsorptive group that contains at least one atom of N, S, P, Se, or Te that promotes adsorption to silver halide, and L represents a linking group containing at least one C, N, S or O atom, k is 1 or 2, and X—H is a deprotonating one-electron or two-electron donor wherein X is an electron donor moiety to which a base, $B^-$, is covalently linked and H is a leaving hydrogen atom, and wherein:

1) X—H has an oxidation potential between 0 and about 1.4 V; and
2) the oxidized form of X—H undergoes deprotonation reaction with the base $B^-$, to give the radical $X^\bullet$ and the protonated base B—H.

25. A photographic element comprising at least one silver halide emulsion layer in which the silver halide is sensitized with a compound of the formula:

$$A—(L—X—H)_k$$

or $$(A—L)_k—X—H$$

wherein A is a silver halide adsorptive group that contains at least one atom of N, S, P, Se, or Te that promotes adsorption to silver halide, and L represents a linking group containing at least one C, N, S or O atom, k is 1 or 2, and X—H is a deprotonating one-electron or two-electron donor wherein X is an electron donor moiety to which a base, $B^-$, is covalently linked and H is a leaving hydrogen atom, and wherein:

1) X—H has an oxidation potential between 0 and about 1.4 V;
2) the oxidized form of X—H undergoes deprotonation reaction with the base, $B^-$, to give the radical $X^\bullet$ and the protonated base B—H; and
3) the radical $X^\bullet$ has an oxidation potential $\leqq -0.7$V.

26. A photographic element according to claim 24 or claim 25, wherein the base $B^-$ is carboxylate or sulfate.

27. A photographic element according to claim 24 or claim 25, wherein the base $B^-$ is an amine oxide.

28. A photographic element according to claim 24 or claim 25, wherein the base is covalently linked to X through a linking group, L'.

29. A photographic element according to claim 28, wherein L' is a substituted or unsubstituted alkylene group, that may contain a heteroatom, or a carbonyl, a carboxyl, an amide, a sulfonyl, or a sulfonamide group.

30. A photographic element according to claim 25, wherein the compound of the formula A—(L—X—H)$_k$ or (A—L)$_k$—X—H is selected from the group consisting of:

69

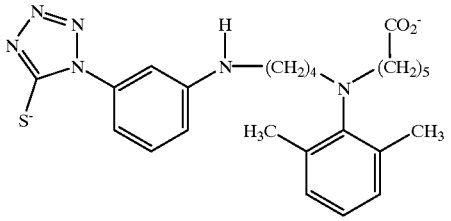

70

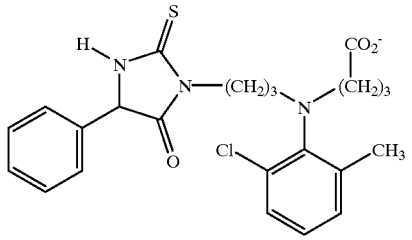

69

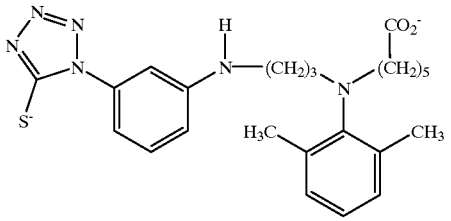

70

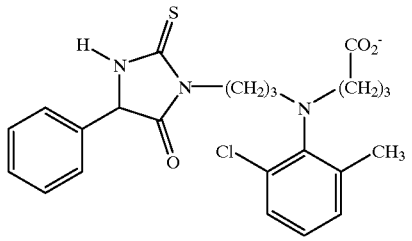

71

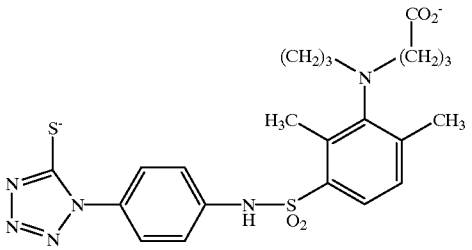

72

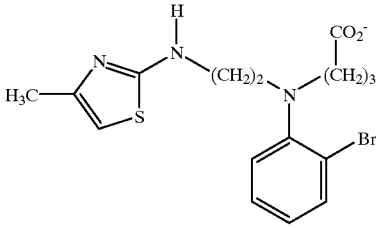

-continued

73

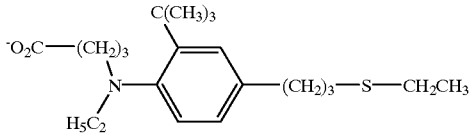

74

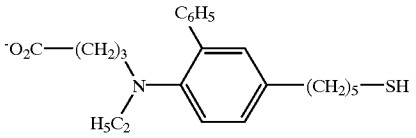

31. A photographic element according to claim 25, wherein the compound of the formula A—(L—X—H)$_k$ or (A—L)$_k$—X—H is selected from the group consisting of:

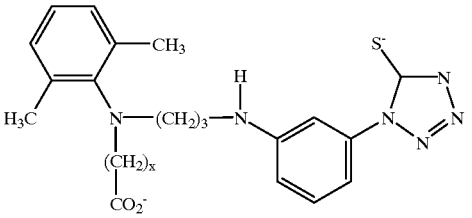

wherein x is 3–6; and

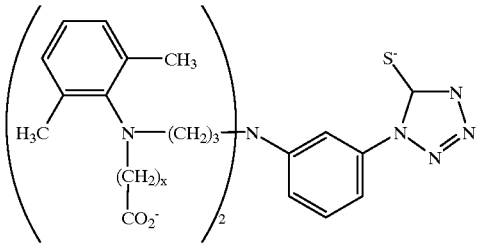

wherein x is 3–6.

32. A photographic element comprising at least one silver halide emulsion layer in which the silver halide is sensitized with a compound of formula $$Z—(L—X—H)_k$$

wherein:

Z is a light absorbing group;

L is a linking group containing a least one C, N, S, or O atom;

k is 1 or 2; and

X—H represents a deprotonating electron donor moiety to which a base, $B^-$, is covalently linked wherein X is an electron donor moiety and H is a leaving hydrogen atom, and wherein:

1) X—H has an oxidation potential between 0 and about 1.4 V; and 2) the oxidized form of X—H undergoes deprotonation reaction with the base $B^-$, to give the radical $X^{\bullet}$ and the protonated base B—H.

33. A photographic element comprising at least one silver halide emulsion layer in which the silver halide is sensitized with a compound of formula $Z—(L—X—H)_k$ wherein:

Z is a light absorbing group;

L is a linking group containing a least one C, N, S, or O atom; k is 1 or 2; and X—H represents a deprotonating electron donor moiety to which a base, $B^-$, is covalently linked wherein X is an electron donor moiety and H is a leaving hydrogen atom, and wherein:

1) X—H has an oxidation potential between 0 and about 1.4 V;

2) the oxidized form of X—H undergoes deprotonation reaction with the base, $B^-$, to give the radical $X^{\bullet}$ and the protonated base B—H; and 3) the radical $X^{\bullet}$ has an oxidation potential $\leqq -0.7$V.

34. A photographic element according to claim 32 or claim 33, wherein the base $B^-$ is a carboxylate or a sulfate.

35. A photographic element according to claim 32 or claim 33, wherein the base $B^-$ is an amine oxide.

36. A photographic element according to claim 32 or claim 33, wherein the base is covalently linked to X through a linking group, L'.

37. A photographic element according to claim 36, wherein L' is a substituted or unsubstituted alkylene group, that may contain a heteroatom, or a carbonyl, a carboxyl, an amide, a sulfonyl, or a sulfonamide group.

38. A photographic element according to claim 33, wherein the compound of formula Z—(L—X—H) is selected from:

Compound No. 80

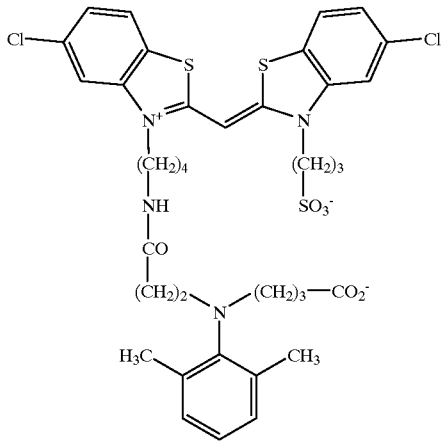

-continued

81

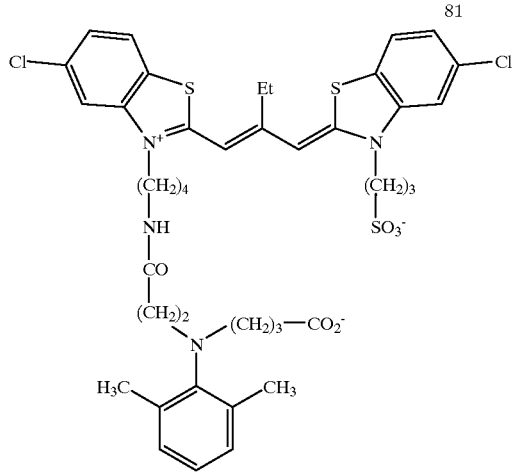

Compound No. 82

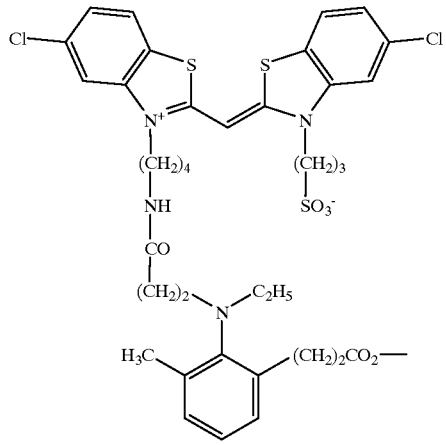

-continued

83

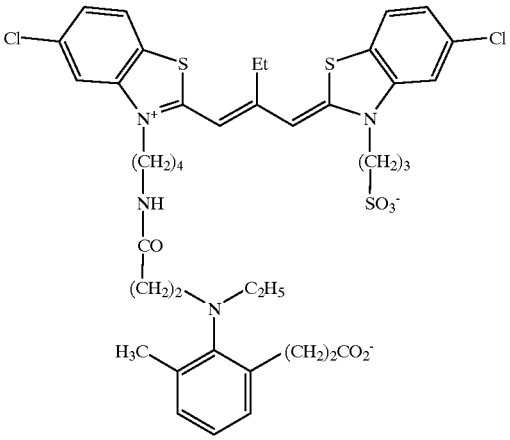

Compound No.
84

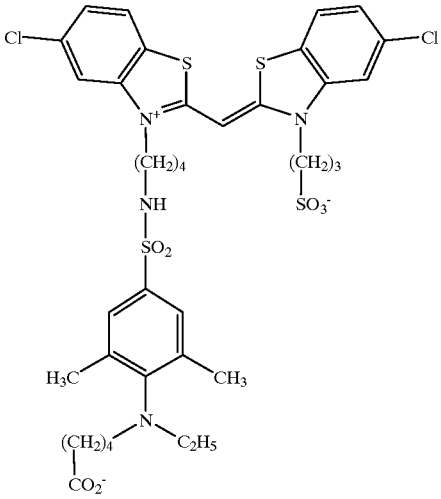

85

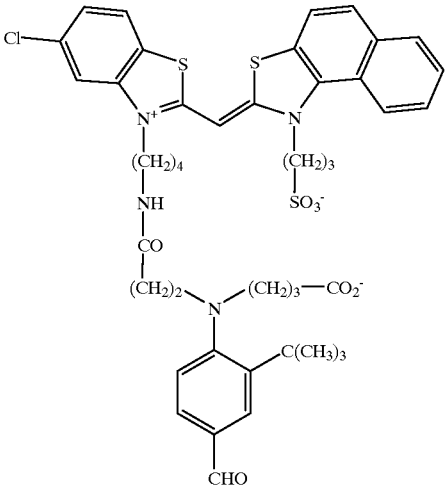

-continued

Compound No.
86

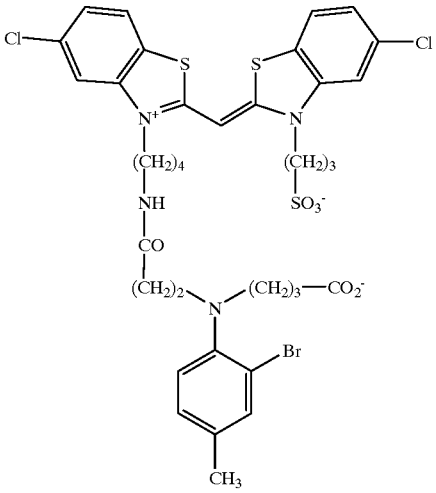

87

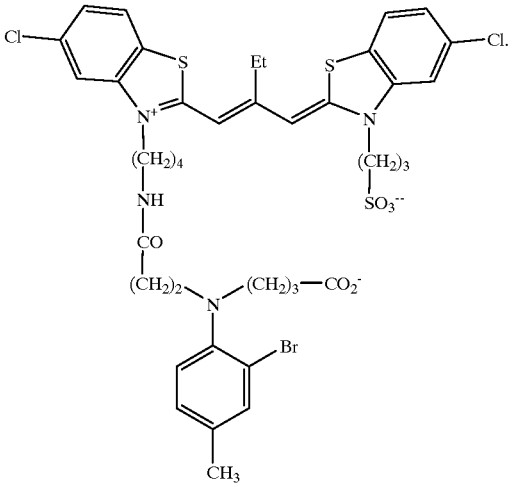

39. A photographic element comprising at least one silver halide emulsion layer in which the silver halide is sensitized with a compound of the formula:

Q—X—H wherein Q represents the atoms necessary to form a chromophore comprising an amidinium-ion, a carboxyl-ion or dipolar-amidic chromophoric system when conjugated with X—H, and X—H represents a deprotonating electron donor moiety wherein:

X is an electron donor moiety to which a base, $B^-$, is covalently linked and H is a leaving hydrogen atom, and wherein:

1) X—H has an oxidation potential between 0 and about 1.4 V; and 2) the oxidized form of X—H undergoes deprotonation reaction with the base $B^-$, to give the radical $X^{\bullet}$ and the protonated base B—H.

40. A photographic element comprising at least one silver halide emulsion layer in which the silver halide is sensitized with a compound of the formula:

Q—X—H wherein Q represents the atoms necessary to form a chromophore comprising an amidinium-ion, a carboxyl-ion or dipolar-amidic chromophoric system when conjugated with X—H, and X—H represents a deprotonating electron donor moiety wherein:

X is an electron donor moiety to which a base, $B^-$, is covalently linked and H is a leaving hydrogen atom, and wherein:

1) X—H has an oxidation potential between 0 and about 1.4 V;

2) the oxidized form of X—H undergoes deprotonation reaction with the base, $B^-$, to give the radical $X^{\bullet}$ and the protonated base B—H; and 3) the radical $X^{\bullet}$ has an oxidation potential $\leqq -0.7$V.

41. A photographic element according to claim 39 or claim 40, wherein the base $B^-$ is a carboxylate or a sulfate.

42. A photographic element according to claim 39 or claim 40, wherein the base $B^-$ is an amine oxide.

43. A photographic element according to claim 39 or claim 40, wherein the base is covalently linked to X through a linking group, L'.

44. A photographic element according to claim 43, wherein L' is a substituted or unsubstituted alkylene group, that may contain a heteroatom, or a carbonyl, a carboxyl, an amide, a sulfonyl, or a sulfonamide group.

45. A photographic element according to claim 40, wherein the compound Q—X—H is selected from:

Compound No.

92

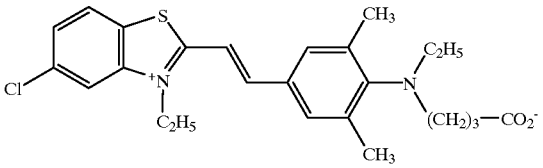

93

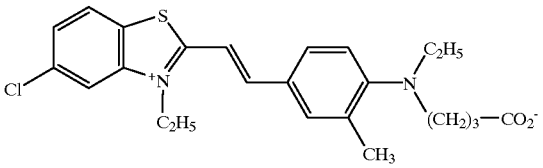

94

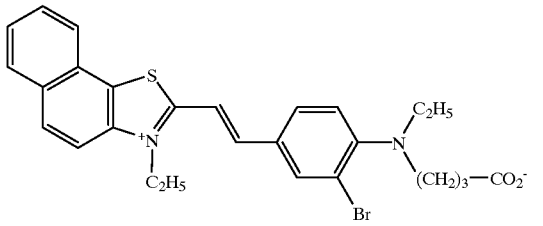

-continued

95

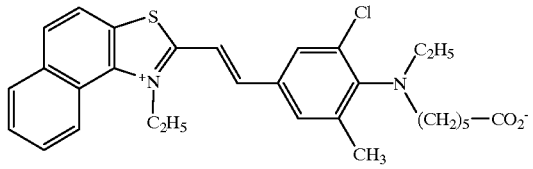

96

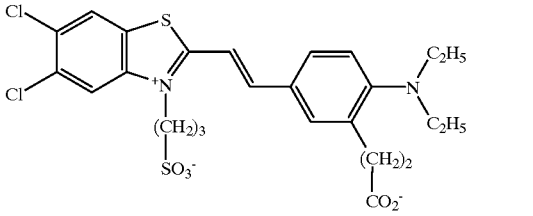

97

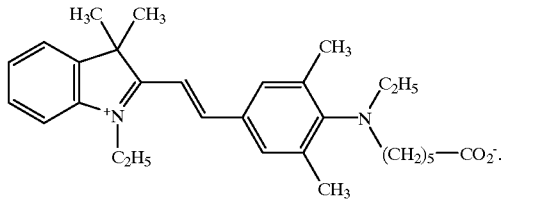

46. A photographic element comprising at least one silver halide emulsion layer in which the silver halide is sensitized with a compound of the formula:

$A—(X—H)_k$ or $(A)_k—X—H$ wherein A is a silver halide adsorptive group that contains at least one atom of N, S, P, Se, or Te that promotes adsorption to silver halide, k is 1 or 2, and X—H is a deprotonating one-electron or two-electron donor group wherein:

X is an electron donor moiety to which a base, $B^-$, is covalently linked and H is a leaving hydrogen atom, and wherein:

1) X—H has an oxidation potential between 0 and about 1.4 V; and 2) the oxidized form of X—H undergoes deprotonation reaction with the base $B^-$, to give the radical $X^{\bullet}$ and the protonated base B—H.

47. A photographic element comprising at least one silver halide emulsion layer in which the silver halide is sensitized with a compound of the formula:

$A—(X—H)_k$ or $(A)_k—X—H$ wherein A is a silver halide adsorptive group that contains at least one atom of N, S, P, Se, or Te that promotes adsorption to silver halide, k is 1 or 2, and X—H is a deprotonating one-electron or two-electron donor group wherein:

X is an electron donor moiety to which a base, $B^-$, is covalently linked and H is a leaving hydrogen atom, and wherein:

1) X—H has an oxidation potential between 0 and about 1.4 V;

2) the oxidized form of X—H undergoes deprotonation reaction with the base, $B^-$, to give the radical $X^\bullet$ and the protonated base B—H; and 3) the radical $X^\bullet$ has an oxidation potential $\leqq -0.7$V.

48. A photographic element according to claim 46 or claim 47, wherein the base $B^-$ is a carboxylate or a sulfate.

49. A photographic element according to claim 46 or claim 47, wherein the base $B^-$ is an amine oxide.

50. A photographic element according to claim 46 or claim 47, wherein the base is covalently linked to X through a linking group, L'.

51. A photographic element according to claim 50, wherein L' is a substituted or unsubstituted alkylene group, that may contain a heteroatom, or a carbonyl, a carboxyl, an amide, a sulfonyl, or a sulfonamide group.

52. A photographic element according to claim 47, wherein the compound of the formula $A—(X—H)_k$ or $(A)_k—X—H$ is selected from:

Compound No.

98

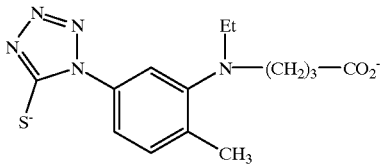

99

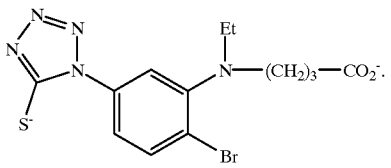

53. A photographic element comprising at least one silver halide emulsion layer in which the silver halide is sensitized with a compound of the formula:

$$Z—(X—H)_k$$

or $$(Z)_k—X—H$$

wherein Z is a light absorbing group; k is 1 or 2; and X—H is a deprotonating one-electron or two-electron donor group wherein X is an electron donor moiety to which a base, $B^-$, is covalently linked and H is a leaving hydrogen atom, and wherein:

1) X—H has an oxidation potential between 0 and about 1.4 V; and 2) the oxidized form of X—H undergoes deprotonation reaction with the base $B^-$, to give the radical $X^\bullet$ and the protonated base B—H.

54. A photographic element comprising at least one silver halide emulsion layer in which the silver halide is sensitized with a compound of the formula:

$$Z—(X—H)_k$$

or $$(Z)_k—X—H$$

wherein Z is a light absorbing group; k is 1 or 2; and X—H is a deprotonating one-electron or two-electron donor group wherein X is an electron donor moiety to which a base, $B^-$, is covalently linked and H is a leaving hydrogen atom, and wherein:

1) X—H has an oxidation potential between 0 and about 1.4 V;

2) the oxidized form of X—H undergoes deprotonation reaction with the base, $B^-$, to give the radical $X^\bullet$ and the protonated base B—H; and 3) the radical $X^\bullet$ has an oxidation potential $\leqq -0.7$V.

55. A photographic element according to claim 53 or claim 54, wherein the base $B^-$ is a carboxylate or sulfate.

56. A photographic element according to claim 53 or claim 54, wherein the base $B^-$ is an amine oxide.

57. A photographic element according to claim 53 or claim 54, wherein the base is covalently linked to X through a linking group, L'.

58. A photographic element according to claim 57, wherein L' is a substituted or unsubstituted alkylene group, that may contain a heteroatom, or a carbonyl, a carboxyl, an amide, a sulfonyl, or a sulfonamide group.

59. A photographic element according to claim 54, wherein the compound of the formula $Z—(X—H)_k$ or $(Z)_k—X—H$ is selected from:

Compound No.

103

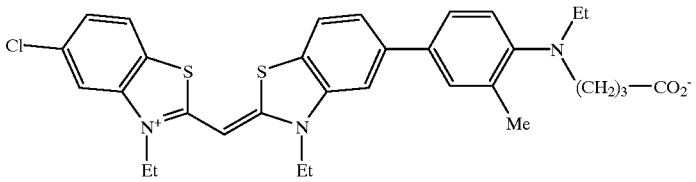

-continued
104
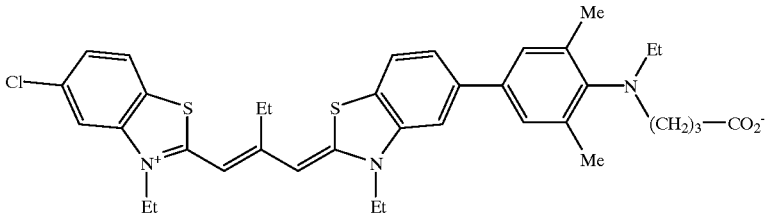
105
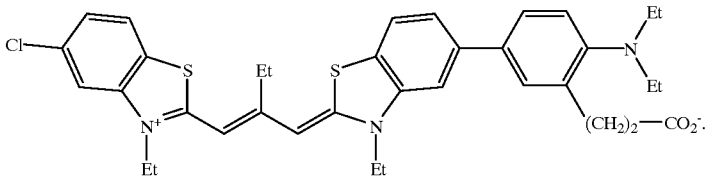
20
* * * * *